US012735166B2

(12) United States Patent
Chan et al.

(10) Patent No.: US 12,735,166 B2
(45) Date of Patent: Sep. 15, 2026

(54) CONTROLLING MOVEMENT OF AT LEAST ONE STEERING DEVICE ON A WATERCRAFT

(71) Applicant: Dometic Marine Canada Inc., Richmond (CA)

(72) Inventors: Anson Chin Pang Chan, Richmond (CA); Geoffrey David Duddridge, Nanaimo (CA); Gabriel Green, New Westminster (CA); Brian James Dudra, Vancouver (CA)

(73) Assignee: Dometic Marine Canada Inc., Richmond (CA)

( * ) Notice: Subject to any disclaimer, the term of this patent is extended or adjusted under 35 U.S.C. 154(b) by 0 days.

(21) Appl. No.: 18/422,236

(22) Filed: Jan. 25, 2024

(65) Prior Publication Data

US 2024/0246653 A1 Jul. 25, 2024

Related U.S. Application Data

(60) Provisional application No. 63/441,106, filed on Jan. 25, 2023.

(51) Int. Cl.
*B63H 25/04* (2006.01)
*B63H 25/02* (2006.01)

(52) U.S. Cl.
CPC ..... *B63H 25/04* (2013.01); *B63H 2025/022* (2013.01)

(58) Field of Classification Search
CPC ..... B63H 25/04; B63H 2025/022
USPC ..... 701/21
See application file for complete search history.

(56) References Cited

U.S. PATENT DOCUMENTS

| | | | |
|---|---|---|---|
| 11,679,853 | B2 | 6/2023 | Wong et al. |
| 2017/0038771 | A1 | 2/2017 | Green |
| 2017/0106959 | A1 | 4/2017 | Davidson et al. |
| 2018/0222565 | A1 | 8/2018 | Davidson et al. |
| 2019/0061898 | A1 | 2/2019 | Davidson et al. |
| 2019/0344868 | A1 | 11/2019 | Davidson et al. |
| 2019/0344869 | A1 | 11/2019 | Chan et al. |
| 2020/0108902 | A1 | 4/2020 | Wong et al. |
| 2020/0115022 | A1 | 4/2020 | Davidson et al. |
| 2020/0255109 | A1 | 8/2020 | Chan et al. |

(Continued)

FOREIGN PATENT DOCUMENTS

| | | | |
|---|---|---|---|
| JP | 2015182665 | A * | 10/2015 |
| WO | 2020069617 | A1 | 4/2020 |

OTHER PUBLICATIONS

English translation of JP2015/182665 (Year: 2015).*

*Primary Examiner* — Tiffany P Young
(74) *Attorney, Agent, or Firm* — CALDERON SAFRAN & WRIGHT P.C.

(57) ABSTRACT

The disclosure relates generally to a method of controlling movement of at least one steering device on a watercraft in response to movement of a steering input relative to the watercraft. The method comprises the steps of controlling a target association, between steering-input positions of the steering input relative to the watercraft and respective steering positions of the at least one steering device relative to the watercraft, and controlling the movement, relative to the watercraft, of the at least one steering device in response to the movement of the steering input relative to the watercraft and according to the target association.

22 Claims, 26 Drawing Sheets

(56) References Cited

U.S. PATENT DOCUMENTS

| | | | | |
|---|---|---|---|---|
| 2020/0255114 | A1 | 8/2020 | Wong et al. | |
| 2022/0041251 | A1 | 2/2022 | Baros et al. | |
| 2022/0089259 | A1 | 3/2022 | Williams | |
| 2022/0306260 | A1 | 9/2022 | Karnick | |
| 2022/0334596 | A1 | 10/2022 | Chan et al. | |
| 2022/0355913 | A1 | 11/2022 | Davidson et al. | |
| 2023/0161360 | A1* | 5/2023 | Inoue | G05D 1/0206 701/21 |
| 2023/0202632 | A1* | 6/2023 | Hirao | B63H 20/12 701/21 |
| 2023/0303235 | A1 | 9/2023 | Wong et al. | |
| 2025/0050995 | A1 | 2/2025 | Chan et al. | |

* cited by examiner

CONTROLLING MOVEMENT OF AT LEAST ONE STEERING DEVICE ON A WATERCRAFT

RELATED APPLICATION

This application claims the benefit of and priority to U.S. provisional patent application No. 63/441,106 filed Jan. 25, 2023. The entire contents of U.S. provisional patent application No. 63/441,106 are incorporated by reference herein.

FIELD

This disclosure relates generally to controlling movement of at least one steering device on a watercraft.

RELATED ART

Movement of a steering input, such as a helm for example, on a watercraft may control movement of at least one steering device to steer the watercraft. However, steering of a watercraft in response to movement of a steering input may not be intuitive or ideal.

SUMMARY

According to at least one embodiment, there is disclosed a method of controlling movement, relative to a watercraft, of at least one steering device on the watercraft in response to movement of a steering input relative to the watercraft, the method comprising controlling a target association, between steering-input positions of the steering input relative to the watercraft and respective steering positions of the at least one steering device relative to the watercraft, in response to at least uncoordinated movement comprising previous movement of the steering input relative to the watercraft uncoordinated with any movement of the at least one steering device relative to the watercraft, previous movement of the at least one steering device relative to the watercraft uncoordinated with any movement of the steering input relative to the watercraft, or both.

According to at least one embodiment, there is disclosed a method of controlling movement, relative to a watercraft, of at least one steering device on the watercraft in response to movement of a steering input relative to the watercraft, the steering input rotatable relative to the watercraft entirely around an axis of rotation, the method comprising: identifying at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation; selecting a selected one of the at least two possible target associations; and controlling a target association, between steering-input positions of the steering input relative to the watercraft and respective steering positions of the at least one steering device relative to the watercraft, wherein controlling the target association comprises causing the target association to be, for at least some time, the selected one of the at least two possible target associations.

According to at least one embodiment, there is disclosed a method of controlling movement, relative to a watercraft, of at least one steering device on the watercraft, the method comprising causing the at least one steering device to move relative to the watercraft in response to, at least: a steering-input position of a steering input relative to the watercraft; and an estimated non-steering influence on movement of the watercraft.

According to at least one embodiment, there is disclosed a method of controlling movement, relative to a watercraft, of at least one steering device on the watercraft, the method comprising causing the at least one steering device to move in response to, at least: a steering-input position of a steering input relative to the watercraft; and an association between steering-input positions of the steering input relative to the watercraft and respective target quantities related to direction of the watercraft.

According to at least one embodiment, there is disclosed a method of controlling movement, relative to a watercraft, of at least one steering device on the watercraft, the method comprising causing the at least one steering device to move in response to, at least, a heading difference between: a measured heading quantity related to a heading of the watercraft; and a measured direction quantity related to a direction of travel of the watercraft.

According to at least one embodiment, there is disclosed an apparatus for controlling movement, relative to a watercraft, of at least one steering device on the watercraft in response to movement of a steering input relative to the watercraft, the apparatus comprising at least one controller configured to, at least, control a target association, between steering-input positions of the steering input relative to the watercraft and respective steering positions of the at least one steering device relative to the watercraft, in response to at least uncoordinated movement comprising previous movement of the steering input relative to the watercraft uncoordinated with any movement of the at least one steering device relative to the watercraft, previous movement of the at least one steering device relative to the watercraft uncoordinated with any movement of the steering input relative to the watercraft, or both.

According to at least one embodiment, there is disclosed an apparatus for controlling movement, relative to a watercraft, of at least one steering device on the watercraft in response to movement of a steering input relative to the watercraft, the steering input rotatable relative to the watercraft entirely around an axis of rotation, the apparatus comprising at least one controller configured to, at least: identify at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation; select a selected one of the at least two possible target associations; and control a target association, between steering-input positions of the steering input relative to the watercraft and respective steering positions of the at least one steering device relative to the watercraft, wherein controlling the target association comprises causing the target association to be, for at least some time, the selected one of the at least two possible target associations.

According to at least one embodiment, there is disclosed an apparatus for controlling movement, relative to a watercraft, of at least one steering device on the watercraft, the apparatus comprising at least one controller configured to, at least, cause the at least one steering device to move relative to the watercraft in response to, at least: a steering-input position of a steering input relative to the watercraft; and an estimated non-steering influence on movement of the watercraft.

According to at least one embodiment, there is disclosed an apparatus for controlling movement, relative to a watercraft, of at least one steering device on the watercraft, the apparatus comprising at least one controller configured to, at least, cause the at least one steering device to move in response to, at least: a steering-input position of a steering input relative to the watercraft; and an association between steering-input positions of the steering input relative to the watercraft and respective target quantities related to direction of the watercraft.

According to at least one embodiment, there is disclosed an apparatus of controlling movement, relative to a watercraft, of at least one steering device on the watercraft, the apparatus comprising at least one controller configured to, at least, cause the at least one steering device to move in response to, at least, a heading difference between: a measured heading quantity related to a heading of the watercraft; and a measured direction quantity related to a direction of travel of the watercraft.

Other aspects and features will become apparent to those ordinarily skilled in the art upon review of the following description of illustrative embodiments in conjunction with the accompanying figures.

DETAILED DESCRIPTION

Figure 1:
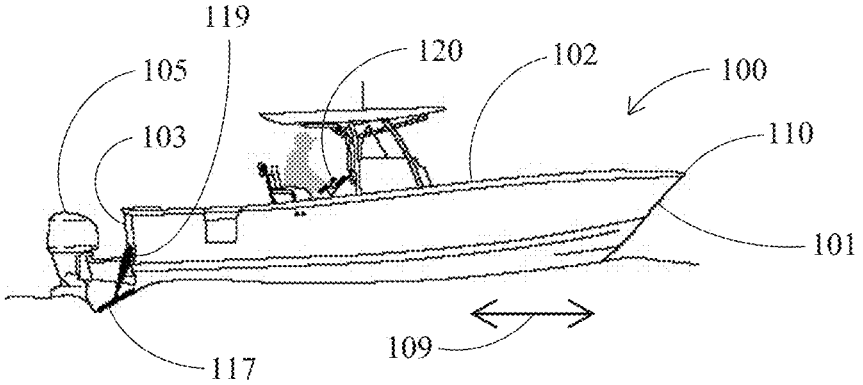
FIG. 1 is a side-elevation view of a watercraft system according to one embodiment.
Figure 2:
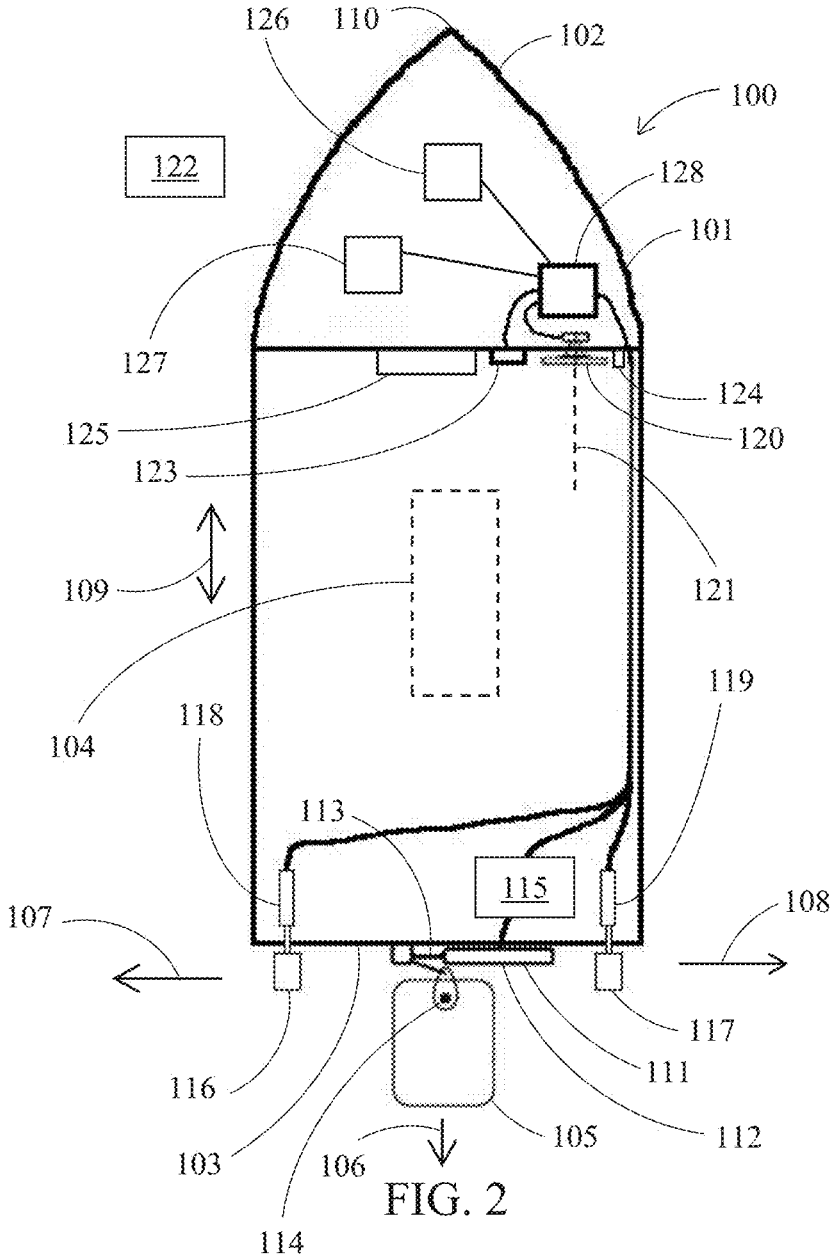
FIG. 2 is a schematic plan view of the watercraft system of FIG. 1.

Referring to FIGS. 1 and 2, a watercraft system according to one embodiment is shown generally at 100 and includes a watercraft 101 including a hull 102 and a transom 103.

In the embodiment shown, the watercraft 101 includes a ballast system 104 in the hull 102 and having a ballast configuration that can be varied to vary an overall distribution of weight of (or on) the watercraft 101, for example to improve hydrostatic stability of the watercraft 101.

In some embodiments, the watercraft 101 may be a wake boat, a water-ski boat, or another boat, aquatic vessel, or marine vessel. However, the watercraft 101 is an example only, and alternative embodiments may differ. For example, alternative embodiments may include a different hull that may or may not include a transom. Further, alternative embodiments may for example, include one or more alternatives to the ballast system 104 or may omit any such ballast system.

The system 100 further includes, on the transom 103 and more generally on the watercraft 101, an outboard engine 105 operable to generate an engine thrust force in an engine-thrust direction 106 relative to the hull 102. In general, "relative to the hull 102" herein may also mean relative to the transom 103, relative to the watercraft 101, or both, and references herein to thrust directions (such as the engine-thrust direction 106) are references to thrust directions laterally relative to such a watercraft, hull, or transom. In general, "laterally" herein may refer to a direction 107 toward port or a direction 108 toward starboard, or to a direction transverse to a longitudinal direction 109 between the transom 103 and a bow 110 of the hull 102.

The outboard engine 105 is an example only, and alternative embodiments may differ. For example, alternative embodiments may include an inboard engine, a sterndrive engine, a jet-drive engine, a thruster engine, a surface-drive engine, a pod-drive engine, or any other engine or propulsion device, and alternative embodiments may include one, two, or more than two such engines or other propulsion devices.

The system 100 further includes, on the watercraft 101, a steering actuator 111. The steering actuator 111 may include a fixed portion 112 fixed to the transom 103. The steering actuator 111 may also include an output shaft 113 movable relative to the fixed portion 112 (and thus relative to the transom 103, relative to the hull 102, and relative to the watercraft 101) in various different steering positions (such as amounts of extension of the output shaft 113 relative to the fixed portion 112, for example) to rotate the outboard engine 105 relative to the hull 102 in a range of motion of the outboard engine 105 relative to the hull 102 around a generally vertical steering axis 114 to change a steering angle of the engine-thrust direction 106 laterally relative to the hull 102 to steer the watercraft 101. The steering actuator 111 is therefore an example of a steering device.

In general, references herein to movements or positions of steering actuators do not necessarily mean movements or positions of an entire steering actuator (such as the steering actuator 111) but may include movements or positions of a portion of a steering actuator (such as the output shaft 113), and amounts of extension of the output shaft 113 relative to the fixed portion 112 are examples of steering positions of the steering actuator 111.

Also, in general, references herein to movements or positions of steering actuators, engines, or other steering devices are references to such movements or positions relative to a watercraft, hull, or transom as described herein. Also, in general, references herein to steering angles are references to angles of thrust forces, or of other steering devices such as rudders, laterally relative to the hull 102 (and, in some embodiments, around one or more generally vertical steering axes) to steer the watercraft 101.

The steering actuator 111 may be an electric actuator or any other actuator such as the electric actuator described in United States patent application publication no. US 2017/0106959 A1, US 2018/0222565 A1, US 2019/0061898 A1, US 2019/0344868 A1, US 2019/0344869 A1, US 2020/0115022 A1, US 2020/0255109 A1, US 2020/0255114 A1, US 2022/0041251 A1, or US 2022/0355913 A1, for example, or one of many other possible actuators or other steering devices.

The system 100 further includes a steering control unit (SCU) 115 operable to control the steering actuator 111, for example by causing the steering actuator 111 to maintain or vary a steering position (for example, an amount of extension of the output shaft 113 relative to the fixed portion 112) of the steering actuator 111 to rotate the outboard engine 105 relative to the hull 102 and steer the watercraft 101 as described above.

However, the steering actuator 111 and the steering control unit 115 are examples only, and alternative embodiments may differ. Alternative embodiments may include one or more steering devices that may be the same as or different from the steering actuator 111 and that may or may not include a steering control unit such as the steering control unit 115. For example, some embodiments may include two outboard engines, each with a respective steering device that may be the same as or different from the steering actuator 111. Also, a steering device according to other embodiments may include various other actuators or other devices that may steer a watercraft.

For example, some embodiments may include one or more rudders and one or more steering devices, each of which may be the same as or different from the steering actuator 111, and one or more such steering devices may be operable to change steering angles of such one or more rudders in response to movement of such one or more steering devices to steer a watercraft. As another example, in embodiments including a sterndrive engine, a steering device (which may or may not be the same as or different from the steering actuator 111) may be operable to change a steering angle of a sterndrive propeller driven by the sterndrive engine to steer a watercraft. As another example, in embodiments including a jet-drive engine, a steering device (which may or may not be the same as or different from the steering actuator 111) may be operable to change a steering angle of a water-jet output of the jet-drive engine to steer a watercraft. As another example, in embodiments including a pod-drive engine, a steering device (which may or may not be the same as or different from the steering actuator 111) may be operable to change a steering angle of a pod-drive propeller driven by the pod-drive engine to steer a watercraft. In general, a steering device may be operable to change a direction of one or more thrust forces in response to movement of the steering device to steer a watercraft.

The system 100 further includes, on the transom 103 and more generally on the watercraft 101, a port trim tab 116 and a starboard trim tab 117. The trim tabs 116 and 117 may be made of metal, and may be positioned and movable such that, when the watercraft 101 is in use in water, the trim tabs 116 and 117 may be removable from the water and may be movable to contact the water at variable angles. A port actuator 118 is coupled to the transom 103 and to the port trim tab 116 and operable to move the port trim tab 116 relative to the hull 102. A starboard actuator 119 is coupled to the transom 103 and to the starboard trim tab 117 and operable to move the starboard trim tab 117 relative to the hull 102 independently of movement of the port trim tab 116. In general, movement of the port trim tab 116 relative to the hull 102 involves rotation of the port trim tab 116 around an axis that is generally transverse relative to the hull 102 such that the port trim tab 116 moves up and down relative to the hull 102, and movement of the starboard trim tab 117 relative to the hull 102 involves rotation of the starboard trim tab 117 in a range of motion of the starboard trim tab 117 around an axis that is generally transverse relative to the hull 102 such that the starboard trim tab 117 moves up and down relative to the hull 102.

The system 100 further includes, on the watercraft 101, an electronic helm 120 rotatable relative to the hull 102 around a helm axis of rotation 121. In the embodiment shown, the helm 120 is rotatable entirely around the helm axis of rotation 121, but alternative embodiments may differ.

In general, rotation of the helm 120 around the helm axis of rotation 121, positions of the helm 120 around the helm axis of rotation 121, or both may indicate user steering input to control one or more steering devices such as the steering actuator 111 as described herein, for example. Therefore, the helm 120 is an example of a steering input, and positions of the helm 120 around the helm axis of rotation 121 are examples of steering-input positions. However, alternative embodiments may include one or more steering inputs that may differ from the helm 120. For example, other steering inputs may be movable in different ways, so rotation of the helm 120 is more generally an example of movement of a steering input. Although the embodiment shown includes one electronic helm 120, alternative embodiments may include two or more than two such helms, each of which may operate as described herein for example.

In general, references herein to rotations, other movements, or positions of a helm or of other steering inputs are references to such rotations, other movements, or positions relative to a watercraft, hull, or transom as described herein. Also, in general, references herein to rotational movements or rotational positions of a helm or of other steering devices are references to such rotational movements or rotational positions around an axis of rotation such as the helm axis of rotation 121.

The system 100 further includes another steering input 122, which may be a remote control or some other device that may be independent of the helm 120.

The system 100 further includes, on the watercraft 101, a trim-tab-input device 123 that may for example, be similar to the trim-tab-input device 126 as described in United States patent application publication no. US 2022/0334596 A1. However, alternative embodiments may differ.

The system 100 further includes, on the watercraft 101, an engine-throttle control 124 operable to control a throttle (and, accordingly, a magnitude of the engine thrust force) of the outboard engine 105.

The system 100 further includes, on the watercraft 101, a display 125 operable to display information to an operator of the watercraft 101.

The system 100 further includes, on the watercraft 101, a heading sensor 126, such as a magnetic compass for example, operable to sense a heading of the watercraft 101, of the hull 102, or both, for example relative to magnetic north or some other stationary or moving reference direction. In some embodiments, the heading sensor 126 may include a gyrocompass, a rate gyro, or other type of gyroscope to measure changes in heading of the watercraft 101, of the hull 102, or both, or to measure heading of the watercraft 101, of the hull 102, or both relative to some reference direction of the gyrocompass, a rate gyro, or other gyroscope.

The system 100 further includes, on the watercraft 101, a geopositioning device 127 such as a global positioning system (GPS) device or other device operable to measure one or more quantities related to direction of movement, position, or both relative to ground or some other stationary or moving frame of reference.

However, the system 100 is an example only, and alternative embodiments may differ. For example, alternative embodiments may include more or fewer components, may omit any one or more of the components described herein, or may include one or more alternatives to one, any two or more, or all of the components described herein.

Controller

Figure 3:
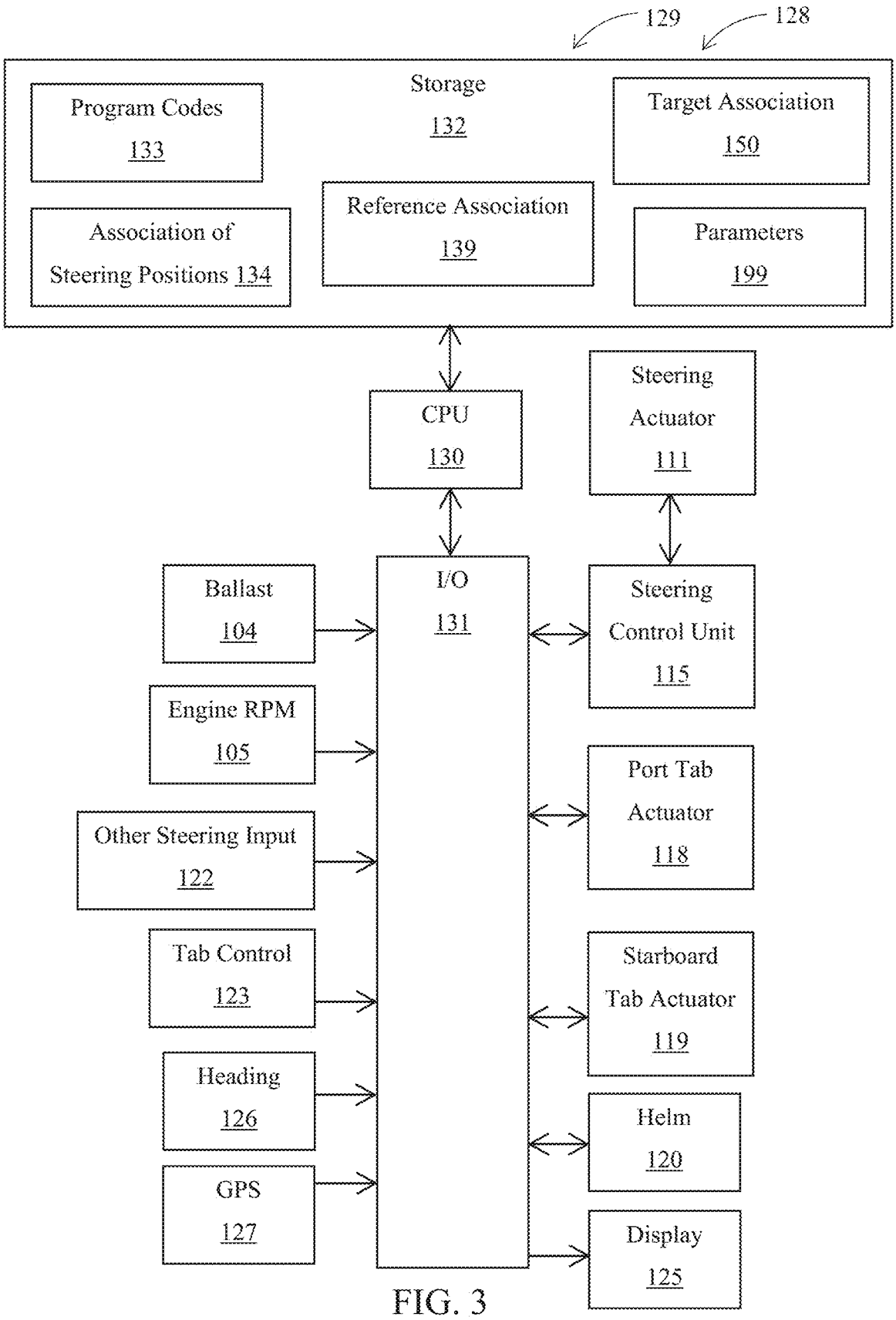
FIG. 3 is a schematic illustration of a controller of the watercraft system of FIG. 1.

Referring to FIG. 3, the system 100 further includes, on the watercraft 101, a controller 128 including a processor circuit shown generally at 129. The processor circuit 129 includes a central processing unit (CPU) 130. However, alternative embodiments may include one or more alternatives to the CPU 130, such as one or more microprocessors, one or more analog circuits, one or more configurable logic blocks, one or more application-specific integrated circuits (ASICs), or one or more field programmable gate arrays (FPGAs), for example. The processor circuit 129 also includes an input/output (I/O) interface 131 and a data-storage device a storage 132 in communication with the CPU 130.

The I/O interface 131 may include various signal interfaces, analog-to-digital converters (ADCs), digital-to-analog converters (DACs), receivers, transmitters, communication buses, and/or other circuitry to receive, produce, and transmit signals as described herein, for example. In general, signals as described herein may include one or more radio signals, one or more optical signals, one or more electronic signals, or a combination of two or more thereof.

The I/O interface 131 may be in communication with the ballast system 104 and operable to receive, from the ballast system 104, one or more signals indicating the ballast configuration of the ballast system 104.

The I/O interface 131 may be in communication with the outboard engine 105 and operable to receive, from the outboard engine 105, one or more signals indicating revolutions per minute (RPM) or one or more other indications of the magnitude of the engine thrust force of the outboard engine 105.

The I/O interface 131 may be in communication with the other steering input 122 and operable to receive, from the other steering input 122, one or more signals indicating user steering input using the other steering input 122 to control one or more steering devices such as the steering actuator 111 as described herein, for example.

The I/O interface 131 may be in communication with the trim-tab-input device 123 and operable to receive, from the trim-tab-input device 123, one or more signals indicating user input using the trim-tab-input device 123 to control one or both of the trim-tab actuators 118 and 119 as described herein, for example.

The I/O interface 131 may be in communication with the heading sensor 126 and operable to receive, from the heading sensor 126, one or more signals indicating a heading of the watercraft 101, of the hull 102, or both, for example relative to magnetic north or some other stationary or moving reference direction.

The I/O interface 131 may be in communication with the geopositioning device 127 and operable to receive, from the geopositioning device 127, one or more signals indicating one or more quantities related to direction of movement, position, or both relative to ground or relative to some other stationary or moving frame of reference.

The I/O interface 131 may be in communication with the steering control unit 115, which may be in communication with the steering actuator 111. The I/O interface 131 may be operable to transmit, to the steering control unit 115, one or more signals causing the steering actuator 111 to move to change the steering angle of the engine-thrust direction 106 to steer the watercraft 101. The I/O interface 131 may be operable to receive, from the steering control unit 115, one or more signals indicating a current steering angle of the engine-thrust direction 106.

The I/O interface 131 may be in communication with the port actuator 118. The I/O interface 131 may be operable to transmit, to the port actuator 118, one or more signals causing the port actuator 118 to move the port trim tab 116 relative to the hull 102. The I/O interface 131 may be operable to receive, from the port actuator 118, one or more signals indicating a current position of the port trim tab 116 relative to the hull 102.

The I/O interface 131 may be in communication with the starboard actuator 119. The I/O interface 131 may be operable to transmit, to the starboard actuator 119, one or more signals causing the starboard actuator 119 to move the starboard trim tab 117 relative to the hull 102. The I/O interface 131 may be operable to receive, from the starboard actuator 119, one or more signals indicating a current position of the starboard trim tab 117 relative to the hull 102.

The I/O interface 131 may be in communication with the helm 120. The I/O interface 131 may be operable to transmit one or more control signals to the helm 120, and the I/O interface 131 may be operable to receive, from the helm 120, one or more signals indicating positions (for example, around the helm axis of rotation 121) of the helm 120, movement (for example, around the helm axis of rotation 121), or both.

The I/O interface 131 may be in communication with the display 125 and may be operable to transmit, to the display 125, one or more signals controlling the display 125.

The I/O interface 131 is an example only, and alternative embodiments may differ. For example, alternative embodiments may include one or more I/O interfaces that may differ from the I/O interface 131, and one or more I/O interfaces of alternative embodiments may be in communication with more, fewer, or different components.

The data-storage device 132 may include one or more of the same or different computer-readable and/or computer-writable data-storage media, which in various embodiments may include one or more of a read-only memory (ROM), a random access memory (RAM), a hard disc drive (HDD), a solid-state drive (SSD), and other computer-readable and/or computer-writable data-storage media. The data-storage device 132 includes a program-codes store 133 storing program codes that, when executed by the CPU 130, cause the processor circuit 129 to implement functions of the controller 128 or of the processor circuit 129 such as those described herein, for example, in which case the processor circuit 129 may be programmed, configured, or operable to implement such functions. Functions of the processor circuit 129 such as those described herein may more generally be functions of the controller 128.

The processor circuit 129 is an example only, and alternative embodiment may differ. For example, alternative embodiments may include more, fewer, or different components. Also, in alternative embodiments, components described herein may be combined or separated into separate components. Alternative embodiments may include one or more alternatives to any one or more, or all, of components as described herein. Further, an alternative to the controller 128 may include multiple devices that collectively function as the controller 128.

Also, in some embodiments, functionality of a controller as described herein may be implemented by one or more steering control units, such as the steering control unit 115. Also, alternative embodiments may have separate controllers (for example, a separate controller for each of one or more of the outboard engine 105, the trim-tab actuators 118 and 119, the helm 120, display 125, the heading sensor 126, and the geopositioning device 127), and a controller area network (CAN) may interconnect any two or more, or all, of such controllers.

Steering Positions

Steering angles of the engine-thrust direction 106 may be associated with respective steering positions (such as amounts of extension of the output shaft 113 relative to the fixed portion 112, for example) of the steering actuator 111.

For example, from known positions, distances, angles, and other configurations of the outboard engine 105, of the steering actuator 111, of any linkages between the steering actuator 111 and the outboard engine 105, and of any other structures involved, trigonometry or other geometric principles may be used to associate steering positions (such as amounts of extension of the output shaft 113 relative to the fixed portion 112, for example) of the steering actuator 111 with respective different steering angles of the engine-thrust direction 106.

Codes representing such an association of steering positions with respective different steering angles of the engine-thrust direction 106 may be stored in an association-of-steering-positions store 134 in the data-storage device 132. Such an association does not necessarily require an actual identified association of any or all of possible steering positions of the steering actuator 111 with respective different steering angles of the engine-thrust direction 106, or of any or all possible steering angles of the engine-thrust direction 106 with respective different steering positions of the steering actuator 111. Rather, for example, such an association may involve one or more proportions or sensitivities, one or more functions, one or more look-up tables, or two or more thereof that allow steering positions of the steering actuator 111 to be associated with respective different steering angles of the engine-thrust direction 106, that allow steering angles of the engine-thrust direction 106 to be associated with respective different steering positions of the steering actuator 111, or both. The codes stored in the association-of-steering-positions store 134 may include codes representing such one or more proportions or sensitivities, one or more functions, one or more look-up tables, or two or more thereof.

Reference Association

Positions of the helm 120, movement of the helm 120, or both may indicate user steering input using the helm 120, and steering-input positions of the helm 120 may be associated with respective steering angles of the engine-thrust direction 106 as described herein, for example.

As indicated above, such steering angles of the engine-thrust direction 106 may be associated with respective steering positions of the steering actuator 111 according to codes stored in the association-of-steering-positions store 134. Therefore, associations of steering-input positions of the helm 120 with respective steering angles of the engine-thrust direction 106 may effectively be associations of steering-input positions of the helm 120 with respective steering positions of the steering actuator 111, and associations of steering-input positions of the helm 120 with respective steering positions of the steering actuator 111 may effectively be associations of steering-input positions of the helm 120 with respective steering angles of the engine-thrust direction 106.

Figure 4:
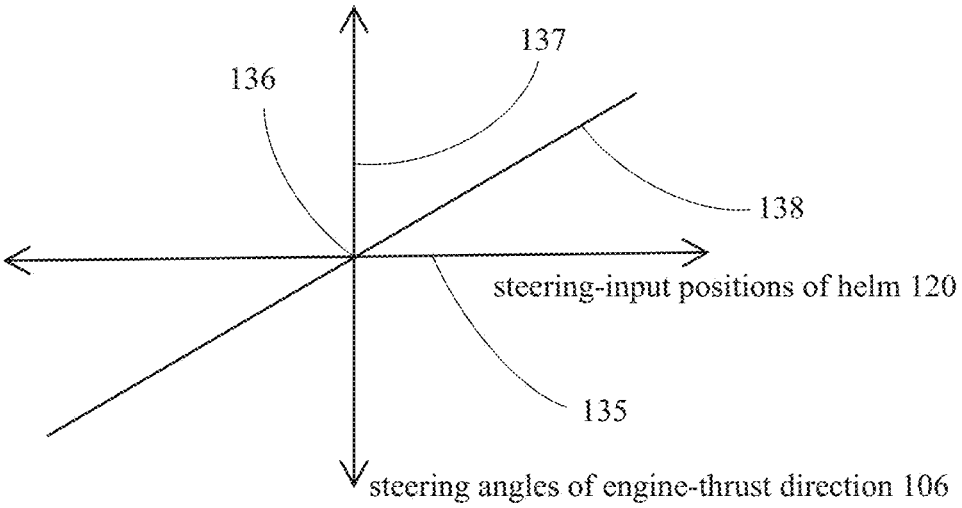
FIG. 4 illustrates an example of a reference association according to one embodiment.
Figure 5:
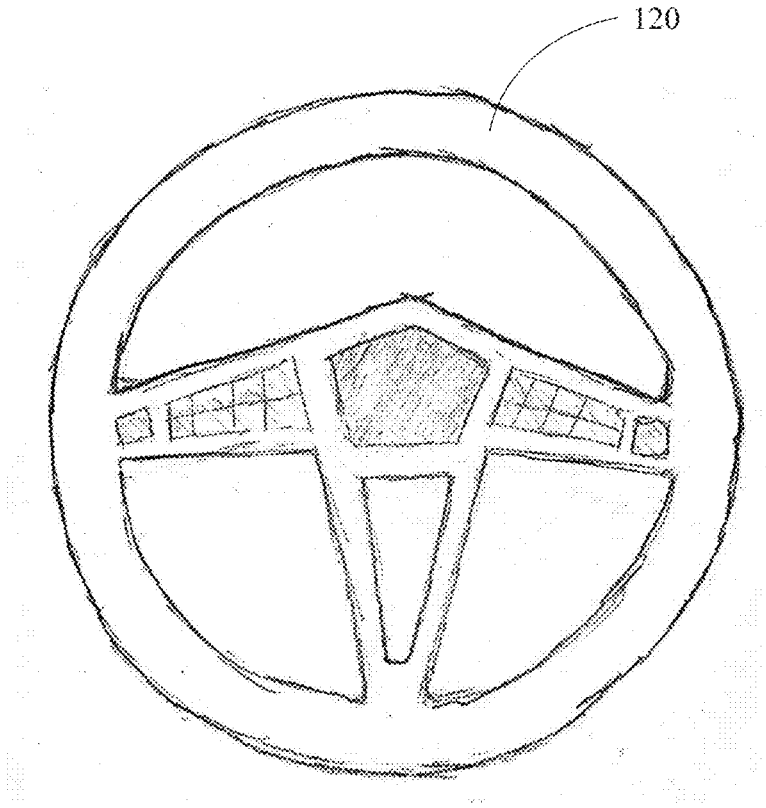
FIG. 5 illustrates a helm, of a watercraft of the watercraft system of FIG. 1, upright relative to a hull of the watercraft of the watercraft system of FIG. 1.

In the example of FIG. 4, a horizontal axis 135 illustrates a range of possible steering-input positions, around the helm axis of rotation 121, of the helm 120. For example, such possible steering-input positions of the helm 120 may be respective different amounts of rotation of the helm 120. In the example of FIG. 4, at a point 136, the horizontal axis represents a central steering position of the helm 120 around the helm axis of rotation 121, for example when the helm 120 is upright relative to the hull 102 as shown in the example of FIG. 5. In general, in such a central steering position in some embodiments, the helm 120 may be laterally symmetric, one or more indicia on the helm 120 may be upright, one or more shapes of the helm 120 may be upright, or a combination of two or more thereof.

In the example of FIG. 4, steering-input positions of the helm 120, resulting from rotation of the helm 120 counterclockwise from the central steering position, are represented by negative amounts of rotation to the left of the point 136 on the horizontal axis 135, and steering-input positions of the helm 120, resulting from rotation of the helm 120 clockwise from the central steering position, are represented by positive amounts of rotation to the right of the point 136 on the horizontal axis 135. However, alternative embodiments may differ.

In the example of FIG. 4, a vertical axis 137 illustrates a range of possible steering angles of the engine-thrust direction 106, and at the point 136, the vertical axis 137 represents a central steering angle relative to the hull 102. When the engine-thrust direction 106 has such a central steering angle, the engine thrust force from the outboard engine 105 may have no lateral components relative to the hull 102, but may instead be entirely in the longitudinal direction 109. In the example of FIG. 4, steering angles of the engine-thrust direction 106 that are port relative to the hull 102 are represented by negative steering angles below the point 136 on the vertical axis 137, and steering angles of the engine-thrust direction 106 that are starboard relative to the hull 102 are represented by positive steering angles above the point 136 on the vertical axis 137.

The example of FIG. 4 illustrates an example of an association 138 of steering-input positions of the helm 120 around the helm axis of rotation 121 with respective steering angles of the engine-thrust direction 106. The association 138 may be a default or typical association in the absence of any movement of the helm 120 that is uncoordinated with any movement of the steering actuator 111, and in the absence of any movement of the steering actuator 111 that is uncoordinated with any movement of the helm 120. Such a default or typical association, such as the association 138, may be referred to as a reference association. Codes representing such a reference association may be stored in a reference-association store 139 in the data-storage device 132.

In general, positions, around the helm axis of rotation 121, of the helm 120 are not necessarily limited to a range less than or equal to 360°. Rather, the helm 120 may be rotatable by more than one complete rotation around the helm axis of rotation 121. Therefore, for example, the association 138 may include a point along the horizontal axis 135 representing 100° clockwise from the central steering position and another point along the horizontal axis 135 representing 460° clockwise from the central steering position. Those points differ by an integer multiple of 360° are therefore represent the same absolute position of the helm 120 around the helm axis of rotation 121. Likewise, a point representing 100° counterclockwise from the central steering position and a point representing 260° clockwise from the central steering position differ by an integer multiple of 360° are therefore represent the same absolute position of the helm 120 around the helm axis of rotation 121.

However, such points may be associated with different respective steering angles of the engine-thrust direction 106. For example, according to the association 138, the point representing 460° clockwise from the central steering position may be associated with a greater steering angle of the engine-thrust direction 106 than the point representing 100° clockwise from the central steering position, even though both points represent the same absolute position of the helm 120 around the helm axis of rotation 121. As another example, according to the association 138, the point representing 100° counterclockwise from the central steering position may be associated with a steering angle of the engine-thrust direction 106 in an opposite direction from a steering angle of the engine-thrust direction 106 associated with a point representing 260° clockwise from the central steering position, even though both points represent the same absolute position of the helm 120 around the helm axis of rotation 121.

Therefore, in some embodiments, the association 138, and other associations described herein, do not necessarily simply associate absolute position of the helm 120 around the helm axis of rotation 121 with respective steering angles of the engine-thrust direction 106, but rather can recognize more than one rotation of the helm 120 around the helm axis of rotation 121 or rotation of the helm 120 around the helm axis of rotation 121 in different directions such that the same absolute position of the helm 120 around the helm axis of rotation 121 may be associated with different respective steering angles of the engine-thrust direction 106 depending on how many times, and in which direction, the helm 120 has been rotated around the helm axis of rotation 121.

Therefore, in some embodiments, steering-input positions of the helm 120 as described herein are not necessarily simply absolute position of the helm 120 around the helm axis of rotation 121, but rather may be steering-input positions recognizing absolute position of the helm 120 around the helm axis of rotation 121 and also how many times, and in which direction, the helm 120 has been rotated around the helm axis of rotation 121.

In the example of FIG. 4, the association 138 is a linear association of positions of the helm 120 with respective steering angles of the engine-thrust direction 106 because a proportion of changes of steering angles of the engine-thrust direction 106 to associated changes of steering-input position of the helm 120 (represented by a slope of the association 138, and representing steering sensitivity) is constant. In embodiments in which a reference association is a linear association, codes stored in the reference-association store 139 may simply indicate a sensitivity (for example, a ratio of amounts of change of the steering angle of the engine-thrust direction 106 to amounts of change of steering-input position of the steering actuator 111) or may indicate different or additional information.

Figure 6:
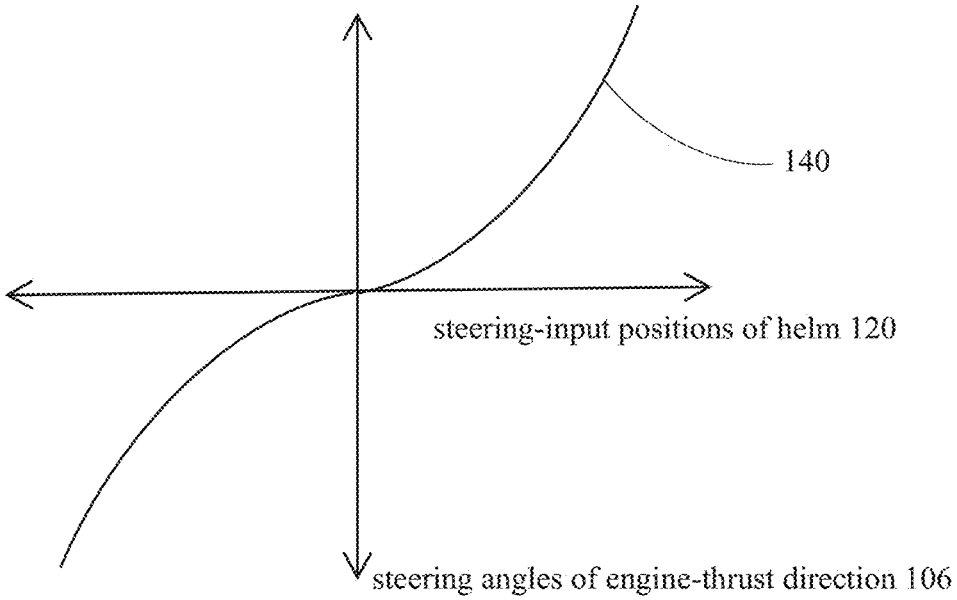
FIG. 6 illustrates another example of a reference association according to one embodiment.

However, such associations may not be linear in some embodiments. For example, FIG. 6 is similar to FIG. 4 as described above but illustrates a non-linear association 140 of steering-input positions of the helm 120 with respective steering angles of the engine-thrust direction 106. In the example of FIG. 6, a proportion of changes of steering angles of the engine-thrust direction 106 to associated changes of steering-input position of the helm 120 (represented by a slope of the association 138, and representing steering sensitivity) is not constant. Rather, in the example of FIG. 6, steering sensitivity is relatively low at steering-input positions near the central steering position of the helm 120 and relatively at steering-input positions high farther from the central steering position of the helm 120. In embodiments in which a reference association is a non-linear association, codes stored in the reference-association store 139 may indicate sensitivity (for example, ratios of amounts of change of the steering angle of the engine-thrust direction 106 to amounts of change of steering-input position of the steering actuator 111) as a function of position of the steering actuator 111, or may indicate different or additional information.

In general, associations as described herein may be linear or non-linear.

Also, in general, an association as described herein does not necessarily require an actual identified association of any or all of possible steering-input positions with respective steering angles. Rather, for example, such an association may involve one or more proportions or sensitivities, one or more functions, one or more look-up tables, or two or more thereof that allow steering-input positions to be associated with respective different steering angles, that allow steering angles to be associated with respective different steering-input positions, or both. The codes stored in the reference-association store 139 may include codes representing such one or more proportions or sensitivities, one or more functions, one or more look-up tables, or two or more thereof. Further, an association as described herein may vary according to or more inputs, such as one, any two or more, or all of example inputs shown in FIG. 8.

FIGS. 4 and 6 are examples only, and alternative embodiments may differ. For example, reference associations of other embodiments may include different linear or different non-linear associations, or may include a piecewise continuous combination of both at least one linear and at least one non-linear association.

Uncoordinated Movement

In some embodiments, the helm 120 may move uncoordinated with any movement of the steering actuator 111. Movement of the helm 120, uncoordinated with any movement of the steering actuator 111, is an example of uncoordinated movement. In general, such uncoordinated movement may be movement of a steering input (such as the helm 120), of a steering device (such as the steering actuator 111), or both such that a steering-input position of the steering input and a steering position of the steering device are no longer according to a reference association (or are no longer within some acceptable threshold from respective positions according to a reference association).

Figure 7:
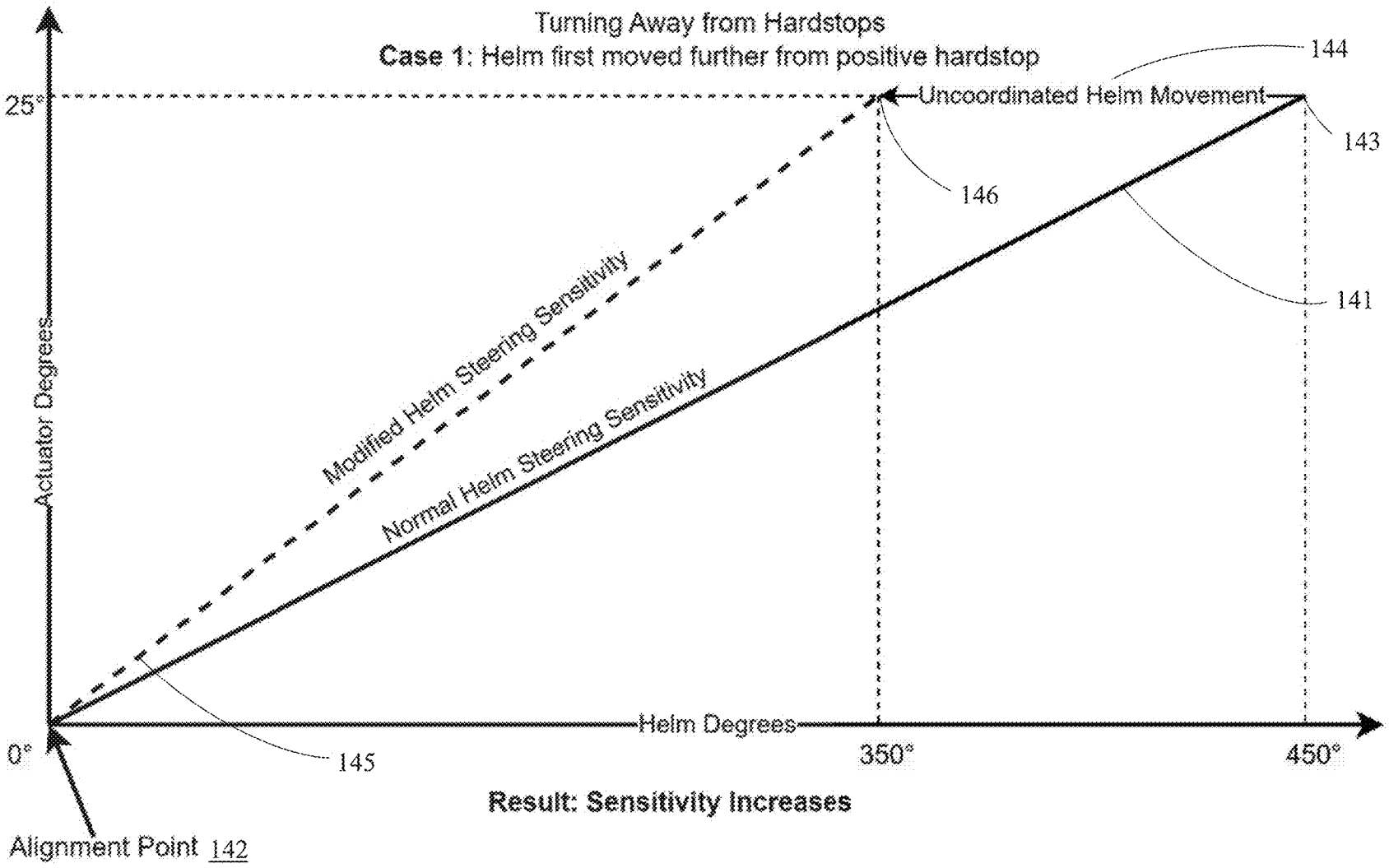
FIG. 7 illustrates an example of a reference association and of a modified association according to one embodiment.

For example, FIG. 7 includes axes similar to those of FIG. 4 as described above and includes a reference association 141 similar to the reference association 138. Like the reference association 138 as described above, the reference association 141 is a default or typical association in the absence of any movement of the helm 120 that is uncoordinated with any movement of the steering actuator 111, and in the absence of any movement of the steering actuator 111 that is uncoordinated with any movement of the helm 120.

In the example of FIG. 7, an alignment point 142 represents the central steering position of the helm 120 and the central steering angle relative to the hull 102. Also, in the example of FIG. 7, a point 143 indicates that the helm 120 was previously at a steering-input position 450° clockwise from the central steering position of the helm 120. The point 143 also indicates that, when the helm 120 was at the steering-input position 450° clockwise from the central steering position, the steering actuator 111 had a steering position associated with the engine-thrust direction 106 being 25° starboard relative to the hull 102. The point 143 was on the reference association 141, so the steering-input position 450° clockwise from the central steering position is associated, according to the reference association 141, with the engine-thrust direction 106 being 25° starboard relative to the hull 102.

In the example of FIG. 7, the helm 120 moved, as shown at 144, from 450° clockwise from the central steering position of the helm 120 to 350° clockwise from the central steering position of the helm 120, and such movement as shown at 144 was uncoordinated with any movement of the steering actuator 111.

In general, in some embodiments, such uncoordinated movement of the helm 120 may be movement of the helm 120 when the helm 120 was powered off or otherwise in a mode in which movement of the helm 120 does not control movement of the steering actuator 111.

Also, in some embodiments, uncoordinated movement of the helm 120 may be movement of the helm 120 beyond a steering-input position associated with an end of a steering range of the steering actuator 111.

For example, the engine-thrust direction 106 may be limited to a limited steering range, and movement of the steering actuator 111 may be limited to maintain the engine-thrust direction 106 within the limited steering range. In general, one or more ends of a steering range may be configured (for example, by programming or otherwise configuring the steering actuator 111, the steering control unit 115, the processor circuit 129, or two or more thereof), or one or more ends of a steering range may be at one or more ends of possible motion of the outboard engine 105, of the steering actuator 111, or both.

In some embodiments, the helm 120 may be freely rotatable around the helm axis of rotation 121 except when the helm 120 resists rotation around the helm axis of rotation 121. The helm 120 may resist rotation around the helm axis of rotation 121 to simulate one or more ends of a steering range, to simulate other resistance to changing the engine-thrust direction 106, or for one or more other reasons. The helm 120 may resist rotation around the helm axis of rotation 121 in response to one or more control signals from the processor circuit 129 or in response to one or more other causes.

However, in some embodiments (such as the embodiment of FIG. 9, 17, or 20 described below, for example), even when the helm 120 resists rotation around the helm axis of rotation 121, a user may apply a sufficiently strong force or torque to the helm 120 to rotate the helm 120 around the helm axis of rotation 121, and such rotation the helm 120 around the helm axis of rotation 121 may be uncoordinated with any movement of the steering actuator 111.

As a result of the uncoordinated movement 144, in the example of FIG. 7, the helm 120 is at a steering-input position (namely 350° clockwise from the central steering position) different from a steering-input position (namely 450° clockwise from the central steering position) that is associated, according to the reference association 141, with a steering position of the steering actuator 111 associated with the engine-thrust direction 106 (namely 25° starboard relative to the hull 102), so the reference association 141 can no longer associate positions of the helm 120 relative to the hull 102 with respective steering angles of the engine-thrust direction 106.

Modified Association

In response to such movement of the helm 120 uncoordinated with any movement of the steering actuator 111, program codes stored in the program-codes store 133 may when executed by the CPU 130, cause the processor circuit 129 to identify a modified association 145 of positions of the helm 120 with respective steering angles of the engine-thrust direction 106.

For example, in the embodiment shown in FIG. 7, the modified association 145 is an association including the alignment point 142, including a point 146 representing the current steering-input position (namely 350° clockwise from the central steering position) of the helm 120 and the current steering angle of the engine-thrust direction 106 (namely 25° starboard relative to the hull 102), and including points between the points 142 and 146. In the embodiment shown, the modified association 145 is a linear association, but alternative embodiments may differ.

Also, in the embodiment shown, the modified association 145 has a greater slope than the reference association 141, so the modified association 145 is associated with greater steering sensitivity than the reference association 141.

Figure 8:
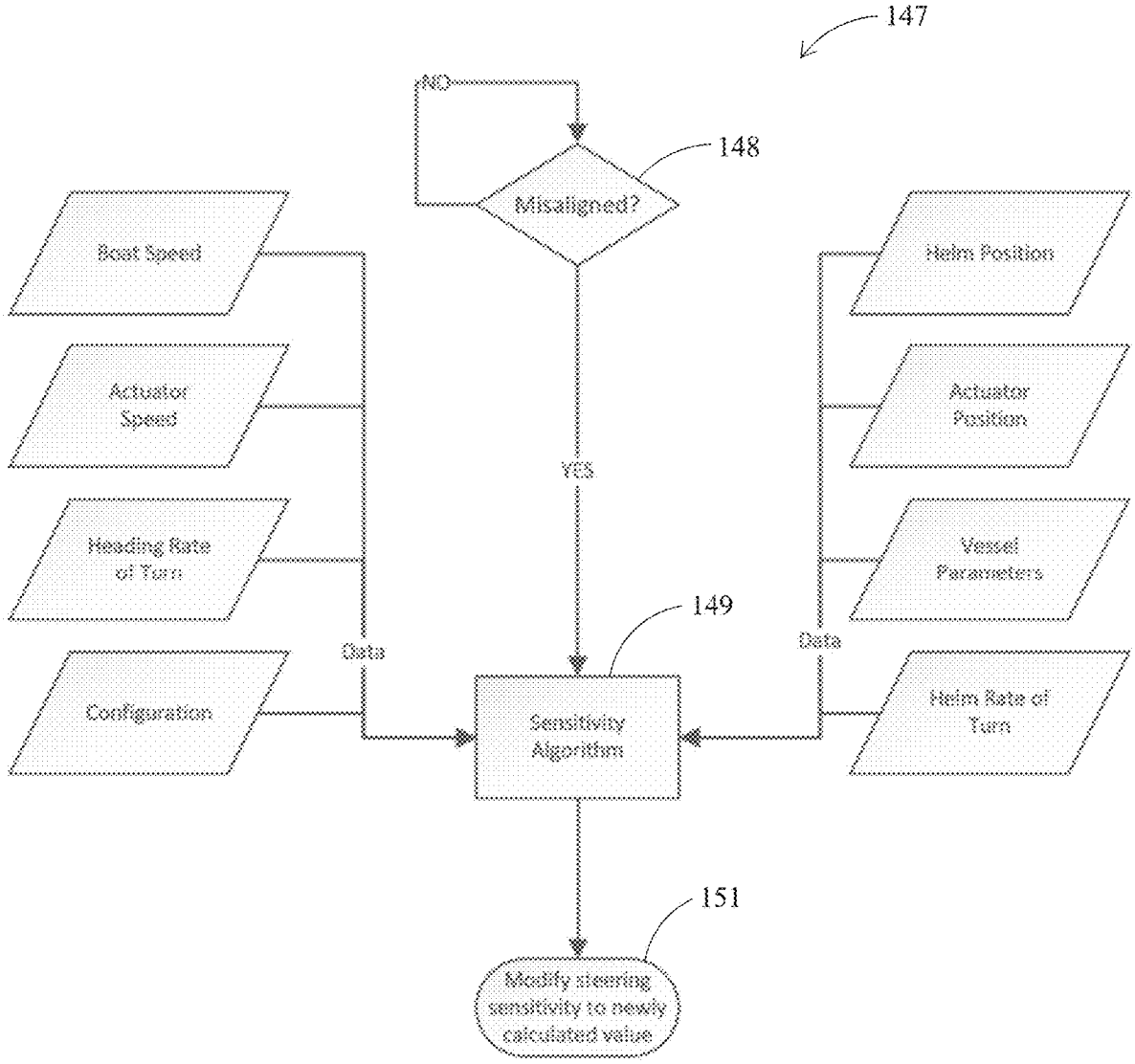
FIG. 8 illustrates blocks of program codes that may be stored in a data-storage device of a processor circuit of the controller of FIG. 3.

In general, in some embodiments, such a modified association may be identified as illustrated in the example of FIG. 8, which illustrates blocks shown generally at 147 of program codes that may be stored in the program-codes store 133 and that, when executed by the CPU 130, may cause the processor circuit 129 to implement a process for identifying and implementing a modified association such as the modified association 145, for example.

In the example of FIG. 8, a block 148 includes program codes that, when executed by the CPU 130, may cause the processor circuit 129 to determine whether a steering-input position of the helm 120 is aligned with a steering angle of the engine-thrust direction 106 according to a reference association, such as the reference association 141 for example.

In some embodiments, the program codes at the block 148 may when executed by the CPU 130, cause the processor circuit 129 to determine that the steering-input position of the helm 120 is aligned with the steering angle of the engine-thrust direction 106 according to a reference association if a difference between 1. the steering angle of the engine-thrust direction 106 and
2. a steering angle of the engine-thrust direction 106 according to
   a. the steering-input position of the helm 120 and
   b. the reference association is zero or less than an acceptable threshold.

If at the block 148 the steering-input position of the helm 120 is aligned with the steering angle of the engine-thrust direction 106 according to the reference association, then the blocks 147 may remain at the block 148.

However, if at the block 148 the steering-input position of the helm 120 is not aligned with the steering angle of the engine-thrust direction 106 according to the reference association, then the blocks 147 may continue at a block 149, which includes program codes that, when executed by the CPU 130, may cause the processor circuit 129 to identify a modified association such as the modified association 145.

In some embodiments, the program codes at the block 149 may when executed by the CPU 130, cause the processor circuit 129 to 1. identify an alignment point (the point 142 in the example of FIG. 7, or more generally any point at which the association of positions of the helm 120 with respective steering angles of the engine-thrust direction 106 may return to a reference association), and
2. identify a modified association (such as the modified association 145) as an association including
   a. the alignment point,
   b. a current point (the point 146 in the example of FIG. 7, or more generally any point representing a current steering-input position of the helm 120 and a current steering angle of the engine-thrust direction 106), and
   c. other points, such as points between such an alignment point and such a current point, points beyond such an alignment point, points beyond such a current point, or a combination of two or more thereof.

In general, such an alignment point may be a point 1. on a reference association (such as the reference association 141), and
2. identified according to one or more factors, such as
   a. causing the modified association, identified as including the alignment point and the current point as described above, to have a desirable slope or sensitivity, such as a slope or sensitivity that is close to a slope or sensitivity of the reference association or within a range of desired or acceptable slopes or sensitivities,
   b. causing the modified association, identified as including the current point as described above, to have one of one or more predefined slopes or sensitivities for modified associations,
   c. representing the central steering position of the helm 120 and the central steering angle relative to the hull 102, or representing some other potentially intuitive or desirable point of alignment of the helm 120 with the steering angle of the engine-thrust direction 106,
   d. causing an amount of rotation of the helm 120, until the helm 120 reaches the alignment point, to be within a desired or acceptable range,
   e. one or more other factors, or
   f. any two or more of the factors described above.

Therefore, in some embodiments, the program codes at the block 149 may when executed by the CPU 130, cause the processor circuit 129 to identify an alignment point, and then to identify a modified association as an association including a current point (the point 146 in the example of FIG. 7, or more generally any point representing a current steering-input position of the helm 120 and a current steering angle of the engine-thrust direction 106) and the alignment point.

However, in other embodiments, the program codes at the block 149 may when executed by the CPU 130, cause the processor circuit 129 to identify a modified association as a modified association including a current point (the point 146 in the example of FIG. 7, or more generally any point representing a current steering-input position of the helm 120 and a current steering angle of the engine-thrust direction 106) and having a desirable slope or sensitivity, such as a slope or sensitivity that is close to a slope or sensitivity of the reference association, as a slope or sensitivity within a range of desired or acceptable slopes or sensitivities, or having one of one or more predefined slopes or sensitivities for modified associations. Then either an alignment point may be identified as a point on both the modified association and a reference association, or an alignment point may not necessarily be identified at all.

In some embodiments, the program codes at the block 149 may when executed by the CPU 130, cause the processor circuit 129 to identify multiple different possible modified associations, and to select a selected one of the different possible modified associations. For example, in some embodiments, multiple different possible modified associations with different alignment points or with different slopes, and the selected one of the different possible modified associations may be selected as the one of the multiple different possible modified associations having a slope or sensitivity that is closest to a slope or sensitivity of the reference association.

Also, in some embodiments, any two or more of the factors described above may have respective weights. For example, similarity of a slope or sensitivity of a possible modified association to a slope or sensitivity of the reference association may have a weight of 40%, intuitiveness of the alignment point of a possible modified association may have a weight of 30%, and desirability of the amount of rotation of the helm 120, until the helm 120 reaches the alignment point according to a possible modified association, may have a weight of 30%, and the selected one of the different possible modified associations may be selected as the one of the multiple different possible modified associations having a highest overall desirability according to such weights.

In the embodiment shown, the modified association 145 may have been identified because the modified association 145 has a slope or sensitivity similar to a slope or sensitivity of the reference association 145, because an amount of rotation of the helm 120 until the helm 120 reaches the alignment point 142 (namely 350°) may be within a desired or acceptable range, because the alignment point 142 representing the central steering position of the helm 120 and the central steering angle relative to the hull 102 may be intuitive or otherwise desirable, because of one or more other factors, or because of any two or more of such factors.

For example, in the example of FIG. 7, the alignment point 142 may be a compromise or tradeoff between 1. a desire for the modified association 145 to have a slope or sensitivity similar to a slope or sensitivity of the reference association 145, which tends to favor the alignment point 142 being relatively far from the points 143 and 146,
2. a desire for an amount of rotation of the helm 120, until the helm 120 reaches the alignment point 142, to be relatively small, which tends to favor the alignment point 142 being relatively close to the points 143 and 146 so that the helm 120 reaches the alignment point 142 relatively quickly, and 3. a desire for an intuitive alignment point, such as the alignment point 142 representing the central steering position of the helm 120 and the central steering angle relative to the hull 102.

For example, such compromise or tradeoff may be the result of weighting such factors as described above.

Reference Positions

As indicated above, in the embodiment shown in FIG. 7, the modified association 145 is an association including the alignment point 142 representing the central steering position of the helm 120 and the central steering angle relative to the hull 102. However, the embodiment shown in FIG. 7 is an example only, and alternative embodiments may differ.

For example, such a central steering position of the helm 120 may more generally be referred to as an example of a reference steering-input position of the helm 120, and such a reference steering-input position may not necessarily be central or upright but may instead be some other reference steering-input position. Also, such a central steering angle may more generally be referred to as an example of a reference steering angle of the engine-thrust direction 106, and such a reference steering angle may not necessarily be central but may instead be some other reference steering angle. Further such a reference steering angle of the engine-thrust direction 106 may be associated with a reference steering position of the steering actuator 111 according to codes stored in the association-of-steering-positions store 134. In some embodiments, an alignment point may represent such a reference steering-input position and such a reference steering angle and may therefore differ from the alignment point 142.

In some embodiments, a reference association, a modified association, a target association, or one or more other associations may associate steering-input positions of the helm 120 with respective steering positions of the steering actuator 111 such that rotation or other movement of the helm 120, by a required amount of rotation or other movement associated with the reference association, causes the helm 120 to reach a reference steering-input position and is associated with causing the steering actuator 111 to reach a reference steering position when the helm 120 reaches the reference steering-input position.

Examples of Possible Inputs

As indicated above, in some embodiments, one factor in identification of an alignment point, of a modified association, or of both may relate to a desirable slope or sensitivity, and another factor in identification of an alignment point may relate to a potentially intuitive or desirable point of alignment of the helm 120 with the steering angle of the engine-thrust direction 106.

In some embodiments, the program codes at the block 149 may when executed by the CPU 130, cause the processor circuit 129 to identify an alignment point, a modified association, or both in response to one or more inputs, which may include (but are not limited to) one, any two or more, or all of example inputs shown in FIG. 8.

For example, the program codes at the block 149 may when executed by the CPU 130, cause the processor circuit 129 to identify an alignment point, a modified association, or both in response to, at least, an estimated or measured speed of the watercraft 101 (indicated as boat speed in FIG. 8) relative to water, relative to ground, or relative to some other stationary or moving frame of reference, for example as estimated according to RPM or one or more other indications of the magnitude of the engine thrust force of the outboard engine 105, as measured by the geopositioning device 127, or both. For example, in some embodiments, when the estimated or measured speed of the watercraft 101 is relatively high, the modified association 145 may have a lower steering sensitivity (and thus, a lower slope the modified association 145) than when the estimated or measured speed of the watercraft 101 is relatively low.

As another example, the program codes at the block 149 may when executed by the CPU 130, cause the processor circuit 129 to identify an alignment point, a modified association, or both in response to, at least, a speed of movement of the steering actuator 111 (indicated as actuator speed in FIG. 8). For example, in some embodiments, when the steering actuator 111 is moving at a relatively high speed, the modified association 145 may have a lower steering sensitivity (and thus, a lower slope the modified association 145) than when the steering actuator 111 is moving at a relatively low speed.

As another example, the program codes at the block 149 may when executed by the CPU 130, cause the processor circuit 129 to identify an alignment point, a modified association, or both in response to, at least, a rate of change over time of the heading (indicated as heading rate of turn in FIG. 8), as measured by the heading sensor 126 for example, of the watercraft 101, of the hull 102, or both, for example relative to magnetic north or some other stationary or moving reference direction. For example, in some embodiments, when the rate of change over time of the heading is relatively high, the modified association 145 may have a lower steering sensitivity (and thus, a lower slope the modified association 145) than when the rate of change over time of the heading is relatively low.

As another example, the program codes at the block 149 may when executed by the CPU 130, cause the processor circuit 129 to identify an alignment point, a modified association, or both in response to, at least, any configuration settings that may be set, for example, by a manufacturer, a distributor, a dealer, a user, or any combination thereof. Such configuration settings may include, for example, a speed threshold, a steering-sensitivity preference, a steering-sensitivity minimum or maximum, a mode such as "eco", "comfort", or "sport", one or more other configuration settings, or a combination of two or more thereof.

As another example, the program codes at the block 149 may when executed by the CPU 130, cause the processor circuit 129 to identify an alignment point, a modified association, or both in response to, at least, a steering-input position of the helm 120 (indicated as helm position in FIG. 8), a steering position of the steering actuator 111 (indicated as actuator position in FIG. 8), or both.

As another example, the program codes at the block 149 may when executed by the CPU 130, cause the processor circuit 129 to identify an alignment point, a modified association, or both in response to, at least, one or more vessel parameters, for example, hull length, hull type, hull shape, beam width, planing time, watercraft weight, one or more other configuration settings, or a combination of two or more thereof.

As another example, the program codes at the block 149 may when executed by the CPU 130, cause the processor circuit 129 to identify an alignment point, a modified association, or both in response to, at least, a speed of movement of the helm 120 (indicated as helm rate of turn in FIG. 8). For example, in some embodiments, when the helm 120 is moving at a relatively high speed, the modified association 145 may have a lower steering sensitivity (and thus, a lower slope the modified association 145) than when the helm 120 is moving at a relatively low speed.

Target Association

In general, program codes stored in the program-codes store 133 may when executed by the CPU 130, cause the processor circuit 129 to control movement of the steering actuator 111 relative to the hull 102 in response to movement of the helm 120 relative to the hull 102 according to a target association of positions of the helm 120 relative to the hull 102 with respective steering angles of the engine-thrust direction 106. Codes representing such a target association may be stored in a target-association store 150 in the data-storage device 132. For example, codes stored in the target-association store 150 may indicate a sensitivity (for example, a ratio of amounts of change of the steering angle of the engine-thrust direction 106 to amounts of change of position of the steering actuator 111), may indicate sensitivity (for example, ratios of amounts of change of the steering angle of the engine-thrust direction 106 to amounts of change of position of the steering actuator 111) as a function of position of the steering actuator 111, or may indicate different or additional information.

Again, in general, an association as described herein does not necessarily require an actual identified association of any or all of possible steering-input positions with respective steering angles. Rather, for example, such an association may involve one or more proportions or sensitivities, one or more functions, one or more look-up tables, or two or more thereof that allow steering-input positions to be associated with respective different steering angles, that allow steering angles to be associated with respective different steering-input positions, or both. Further, an association as described herein may vary according to or more inputs, such as one, any two or more, or all of example inputs shown in FIG. 8. The codes stored in the target-association store 150 may include codes representing such one or more proportions or sensitivities, one or more functions, one or more look-up tables, or two or more thereof.

At some times, for example absent any movement of the helm 120 that is uncoordinated with any movement of the steering actuator 111, and absent any movement of the steering actuator 111 that is uncoordinated with any movement of the helm 120, the target association may be a reference association as described above, for example. In such a case, some or all of the codes stored in the target-association store 150 may be the same as some or all of the codes stored in the reference-association store 139.

However, at other times, for example following movement of the helm 120 relative to the hull 102 uncoordinated with any movement of the steering actuator 111 relative to the hull 102, the target association may be a modified association as described above, for example. In some embodiments, when the target association is a modified association as described above for example, the processor circuit 129 may control the target association in response to at least uncoordinated movement as described above for example.

Therefore, after the block 149, the blocks 147 may continue at a block 151, which includes program codes that, when executed by the CPU 130, may cause the processor circuit 129 to store, in the the target-association store 150, codes representing a modified association as identified at the block 149.

If and when the helm 120 and the steering actuator 111 reach reference positions represented by the alignment point 142, the target association may again be a reference association as described above, for example. In other words, the target association may again be a reference association as described above, for at least some time, in response to the helm 120 reaching a steering-input position when the steering actuator 111 reaches a steering position associated with the steering-input position according to the reference association (at the alignment point 142 in the example of FIG. 7).

Other Examples of Uncoordinated Movement

In the example of FIG. 7, the uncoordinated movement of the helm 120, as shown at 144, was toward the central steering position and in a direction associated with moving the steering angle of the engine-thrust direction 106 away from a starboard end of a steering range of the outboard engine 105 and toward a center of the steering range of the outboard engine 105. Further, in the example of FIG. 7, the helm 120 and the steering actuator 111 reach reference positions represented by the alignment point 142 from movement of the helm 120 toward the central steering position and from movement of the outboard engine 105 toward the center of the steering range of the outboard engine 105. However, alternative embodiments may differ.

Figure 9:
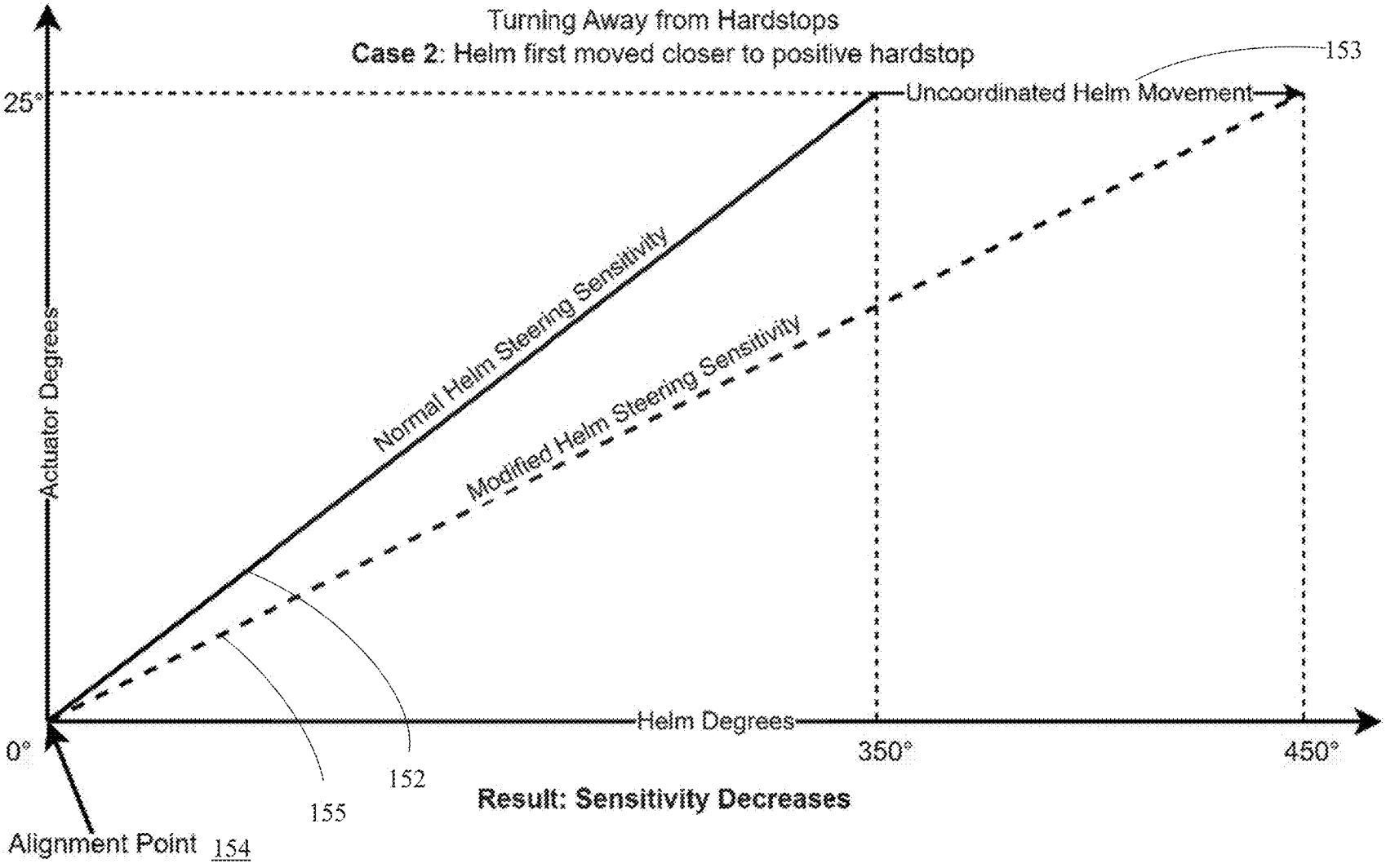
FIGS. 9-21 illustrate other examples of reference associations and of modified associations according to various embodiments.

For example, FIG. 9 illustrates another example similar to the example of FIG. 7. In the example of FIG. 9, a reference association 152 associates a steering angle, of the engine-thrust direction 106 of 25° starboard relative to the hull 102, with a steering-input position of the helm 120 350° clockwise from the central steering position of the helm 120, but movement of the helm 120, uncoordinated with any movement of the steering actuator 111 relative to the hull 102, as shown at 153, is away from the central steering position and in a direction associated with moving the steering angle of the engine-thrust direction 106 toward the starboard end of the steering range of the outboard engine 105 and away from the center of the steering range of the outboard engine 105. As with the example of FIG. 7, the helm 120 and the steering actuator 111 reach reference positions represented by an alignment point 154 from movement of the helm 120 toward the central steering position and from movement of the outboard engine 105 toward the center of the steering range of the outboard engine 105. Like the alignment point 142, the alignment point 154 represents the central steering position of the helm 120 and the central steering angle relative to the hull 102.

Also as with the example of FIG. 7, as a result of the uncoordinated movement as shown at 153, the helm 120 is at a steering-input position (namely 450° clockwise from the central steering position) different from a steering-input position (namely 350° clockwise from the central steering position) that is associated, according to the reference association 152, with the steering angle of the engine-thrust direction 106 of 25° starboard relative to the hull 102, and the reference association 152 can no longer associate positions of the helm 120 with respective steering angles of the engine-thrust direction 106. Therefore, as with the example of FIG. 7, in response to such movement of the helm 120 uncoordinated with any movement of the steering actuator 111, program codes stored in the program-codes store 133 may when executed by the CPU 130, cause the processor circuit 129 to identify a modified association 155 generally according to one or more factors and otherwise as described herein, for example.

Also, in the embodiment shown, the modified association 155 has a lower slope than the reference association 152, so the modified association 155 is associated with less steering sensitivity than the reference association 152.

In the example of FIG. 9, an amount of rotation of the helm 120 required to reach the alignment point 154 according to the modified association 155 is more than 360°, so reaching the alignment point 154 according to the modified association 155 requires passing the central steering position of the helm 120 at least once. However, alternative embodiments may differ.

Figure 10:
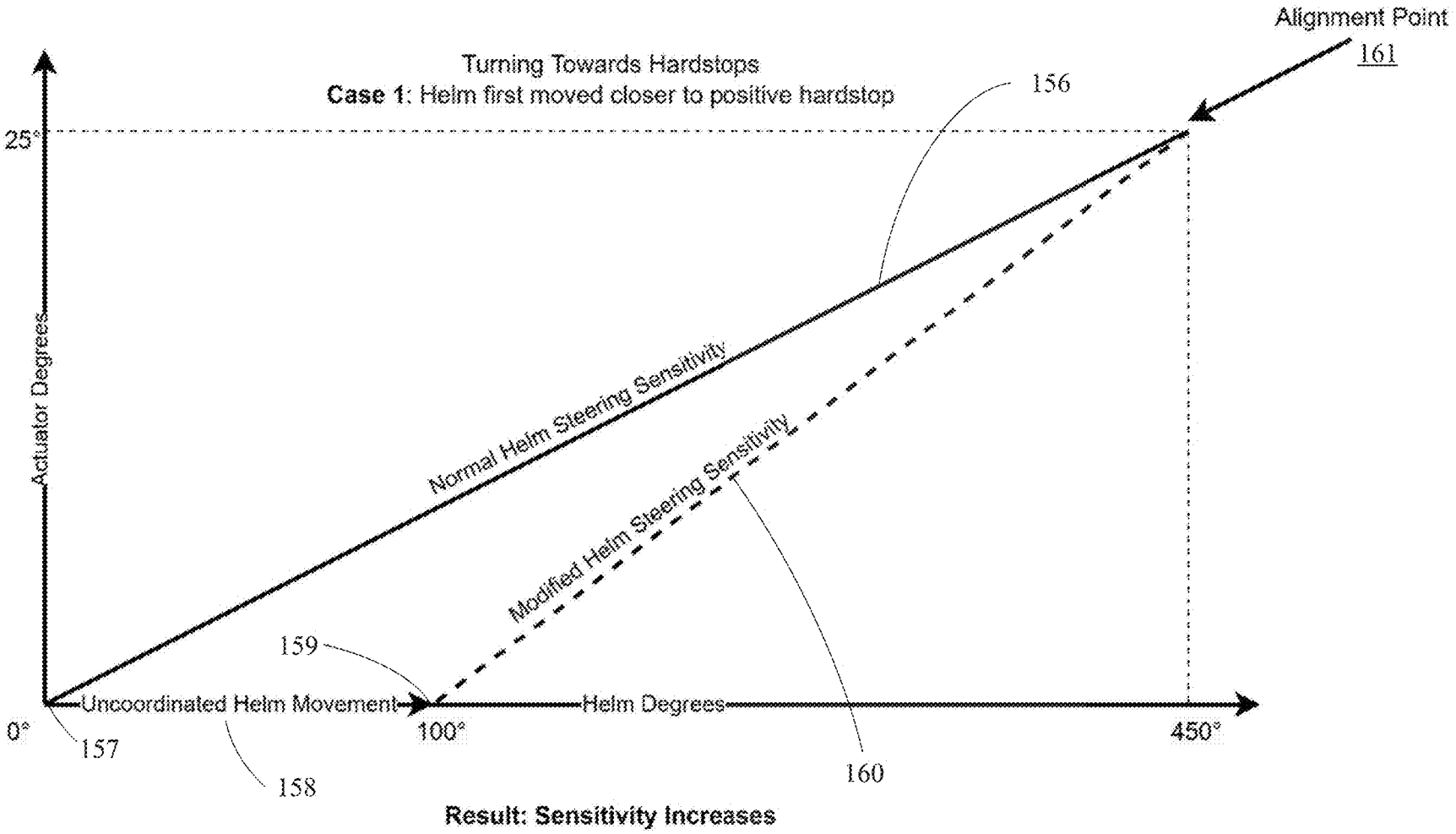

The example of FIG. 10 includes a reference association 156 similar to the reference associations described above. In the example of FIG. 10, a point 157 indicates that the helm 120 was previously at the central steering position of the helm 120. The point 157 also indicates that, when the helm 120 was at the central steering position of the helm 120, the steering actuator 111 had a steering position associated with the engine-thrust direction 106 being at the central steering angle relative to the hull 102. The point 157 was on the reference association 156, so the steering-input position at the central steering position of the helm 120 is associated, according to the reference association 156, with the engine-thrust direction 106 being at the central steering angle relative to the hull 102.

However, in the example of FIG. 10, as shown at 158, the helm 120 moved, uncoordinated with any movement of the steering actuator 111 relative to the hull 102, 100° clockwise away from the central steering position and in a direction associated with moving the steering angle of the engine-thrust direction 106 toward the starboard end of the steering range of the outboard engine 105 and away from the center of the steering range of the outboard engine 105 to a steering-input position as represented by a point 159, which is another example of a current point as described above. As with the examples of FIGS. 7 and 9, in response to such movement of the helm 120 uncoordinated with any movement of the steering actuator 111, program codes stored in the program-codes store 133 may when executed by the CPU 130, cause the processor circuit 129 to identify a modified association 160.

The modified association 160 is similar to the modified association 145 as described above, although the modified association 160 includes an alignment point 161 not representing the central steering position of the helm 120 and the central steering angle relative to the hull 102, but rather representing a steering-input position 450° clockwise from the central steering position and a steering angle of the engine-thrust direction 106 of 25° starboard relative to the hull 102. As indicated above, the modified association 160 may have been identified because the modified association 160 has a slope or sensitivity similar to a slope or sensitivity of the reference association 156, because an amount of rotation of the helm 120 until the helm 120 reaches the alignment point 161 (namely, 450°−100°=350°) may be within a desired or acceptable range, because of one or more other factors, or because of any two or more of such factors.

For example, the alignment point 161 may be a compromise or tradeoff between 1. a desire for the modified association 160 to have a slope or sensitivity similar to a slope or sensitivity of the reference association 156, which tends to favor the alignment point 161 being relatively far from the points 157 and 159, and
2. a desire for an amount of rotation of the helm 120, until the helm 120 reaches the alignment point 161, to be relatively small, which tends to favor the alignment point 161 being relatively close to the point 157 so that the helm 120 reaches the alignment point 161 relatively quickly.

For example, such compromise or tradeoff may be the result of weighting such factors as described above.

Therefore, in the example of FIG. 10, the helm 120 and the steering actuator 111 reach reference positions represented by the alignment point 161, not from movement of the helm 120 toward the central steering position or from movement of the outboard engine 105 toward the center of the steering range of the outboard engine 105 as in the examples of FIGS. 7 and 9, but rather from movement of the helm 120 away from the central steering position and in a direction associated with moving the steering angle of the engine-thrust direction 106 toward a starboard end of a steering range of the outboard engine 105, and from movement of the outboard engine 105 away from the center of the steering range of the outboard engine 105 and toward a starboard end of a steering range of the outboard engine 105.

Also, in the embodiment shown, the modified association 160 has a greater slope than the reference association 156, so the modified association 160 is associated with greater steering sensitivity than the reference association 156.

Figure 11:
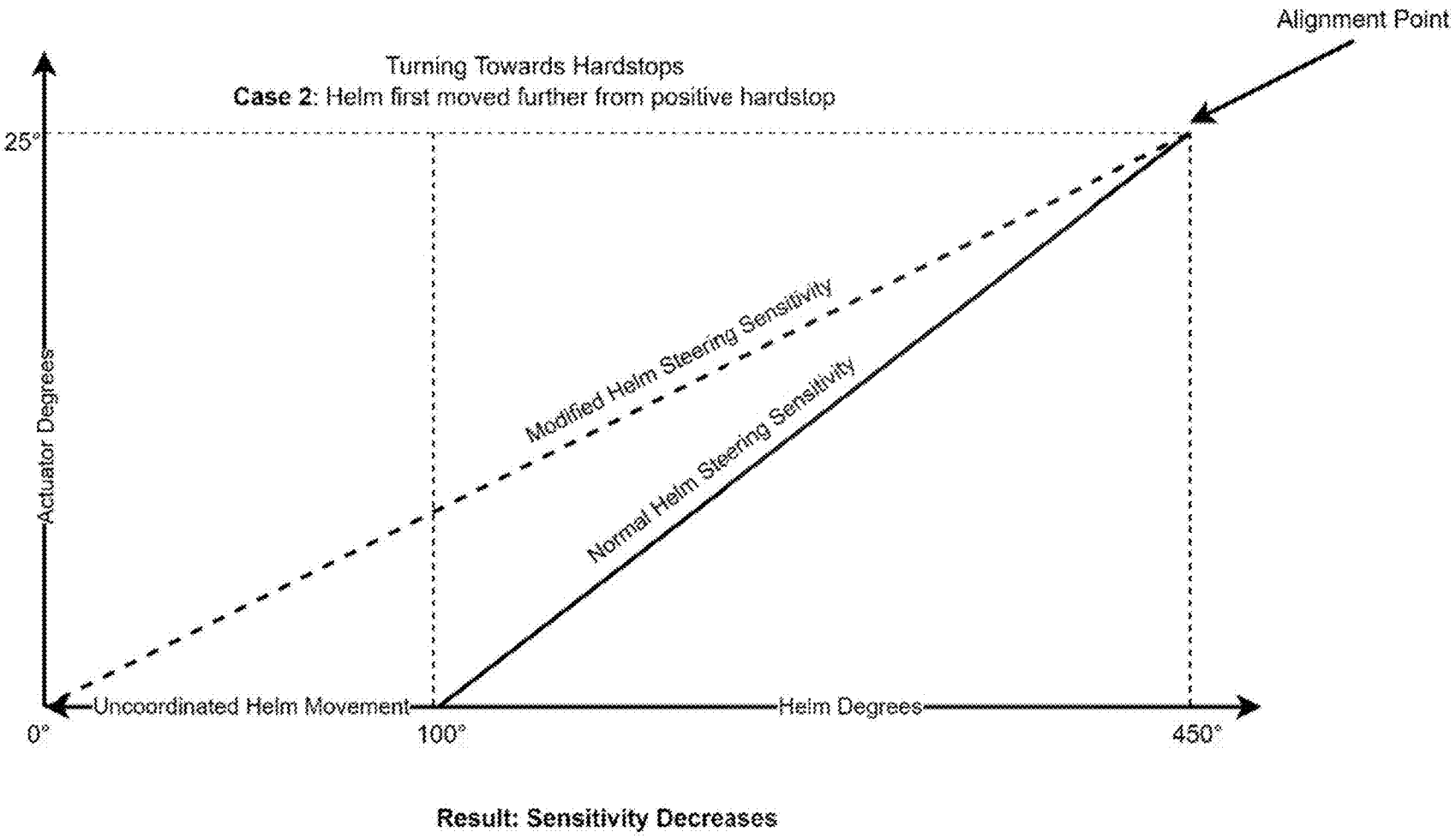

The example of FIG. 11 is similar to the example of FIG. 10 except that, in the example of FIG. 11, movement of the helm 120, uncoordinated with any movement of the steering actuator 111, is toward the central steering position and in a direction associated with moving the steering angle of the engine-thrust direction 106 away from the starboard end of the steering range of the outboard engine 105 and toward the center of the steering range of the outboard engine 105. Also, in the example of FIG. 11, as in the example of FIG. 10, the helm 120 and the steering actuator 111 reach reference positions represented by the alignment point 161 from movement of the helm 120 away from the central steering position and in a direction associated with moving the steering angle of the engine-thrust direction 106 toward a starboard end of a steering range of the outboard engine 105, and from movement of the outboard engine 105 away from the center of the steering range of the outboard engine 105 and toward a starboard end of a steering range of the outboard engine 105. Also, in the example of FIG. 11, the modified association has a lower slope than the reference association, so the modified association is associated with less steering sensitivity than the reference association.

In the example of FIG. 11, an amount of rotation of the helm 120 required to reach the alignment point according to the modified association is more than 360°, so reaching the alignment point according to the modified association requires passing, at least once, a steering position of the helm 120 at the alignment point.

Uncoordinated Movement of Steering Device

In the examples of FIGS. 7 and 9-11, the helm 120 moved uncoordinated with any movement of the steering actuator 111. However, in other embodiments, the steering actuator 111 may move uncoordinated with any movement of the helm 120. Movement of the steering actuator 111, uncoordinated with any movement of helm 120, is another example of uncoordinated movement. In some embodiments, movement of the steering actuator 111, uncoordinated with any movement of helm 120, may be caused by another steering input (such as the other steering input 122).

Figure 12:
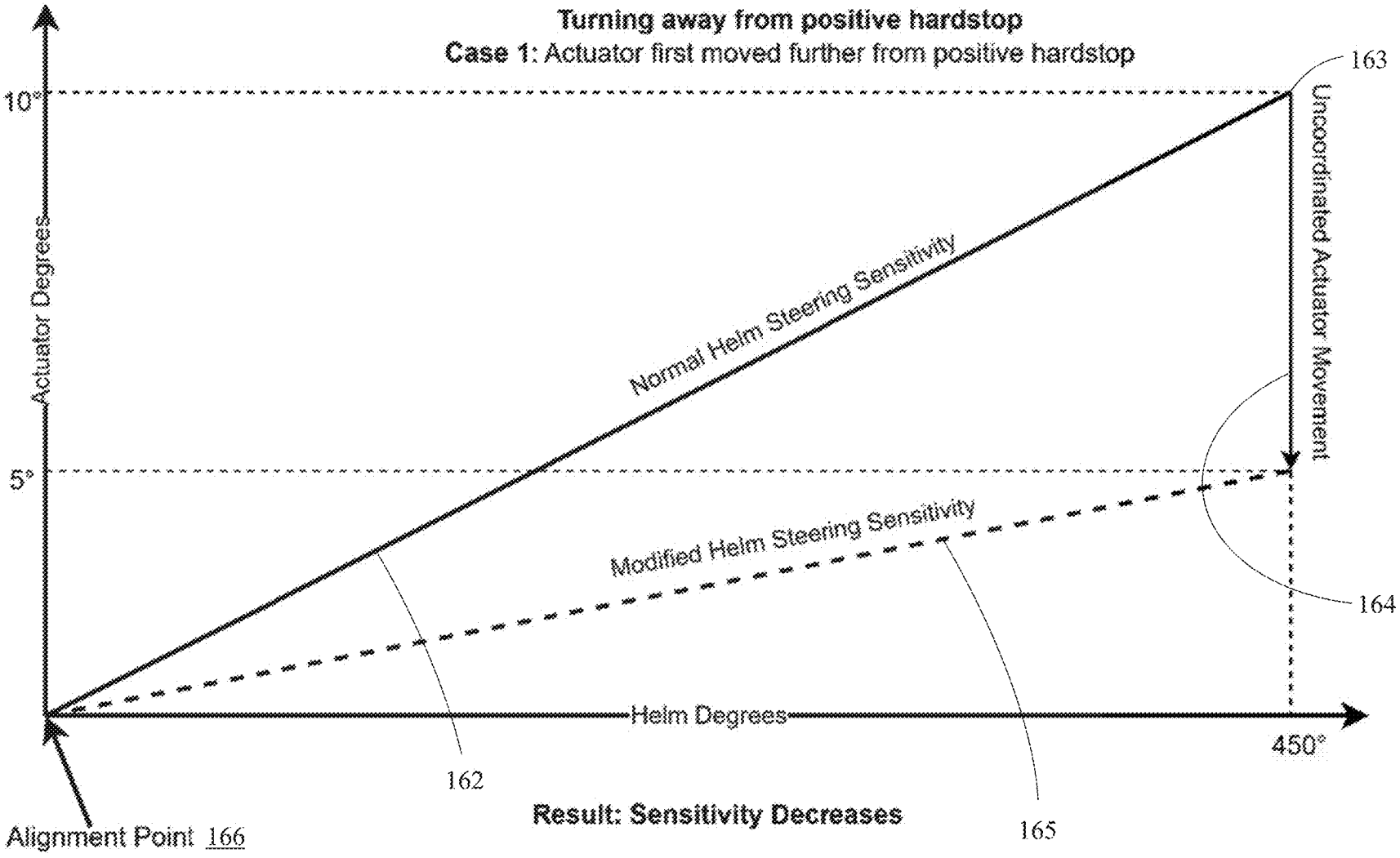

For example, FIG. 12 includes a reference association 162 similar to the reference associations described above. In the example of FIG. 12, a point 163 indicates that the steering actuator 111 previously had a steering position associated with the engine-thrust direction 106 being 10° starboard relative to the hull 102. The point 163 also indicates that, when the steering actuator 111 had the steering position associated with the engine-thrust direction 106 being 10° starboard relative to the hull 102, the helm 120 was at a steering-input position 450° clockwise from the central steering position of the helm 120. The point 163 was on the reference association 162, so the steering-input position 450° clockwise from the central steering position of the helm 120 is associated, according to the reference association 162, with the engine-thrust direction 106 being 10° starboard relative to the hull 102.

However, in the example of FIG. 12, the steering actuator 111 moved, as shown at 164, uncoordinated with any movement of the helm 120, to a position associated with the engine-thrust direction 106 being 5° starboard relative to the hull 102. Therefore, in the example of FIG. 12, the steering actuator 111 moved, uncoordinated with any movement of the helm 120, in a direction associated with moving the steering angle of the engine-thrust direction 106 away from the starboard end of the steering range of the outboard engine 105 and toward the center of the steering range of the outboard engine 105.

As with the examples of FIGS. 7 and 9-11, in response to such movement of the steering actuator 111 uncoordinated with any movement of the helm 120, program codes stored in the program-codes store 133 may when executed by the CPU 130, cause the processor circuit 129 to identify a modified association 165 generally according to one or more factors and otherwise as described herein, for example.

The modified association includes an alignment point 166 representing the central steering position of the helm 120 and the central steering angle relative to the hull 102. Therefore, in the example of FIG. 12, the helm 120 and the steering actuator 111 reach reference positions represented by the alignment point 166 from movement of the helm 120 toward the central steering position and from movement of the outboard engine 105 toward the center of the steering range of the outboard engine 105. Further, the modified association 165 has a lower slope than the reference association 162, so the modified association 165 is associated with less steering sensitivity than the reference association 162.

In the example of FIG. 12, an amount of rotation of the helm 120 required to reach the alignment point 166 according to the modified association 165 is more than 360°, so reaching the alignment point 166 according to the modified association 165 requires passing the central steering position of the helm 120 at least once. However, alternative embodiments may differ.

Figure 13:
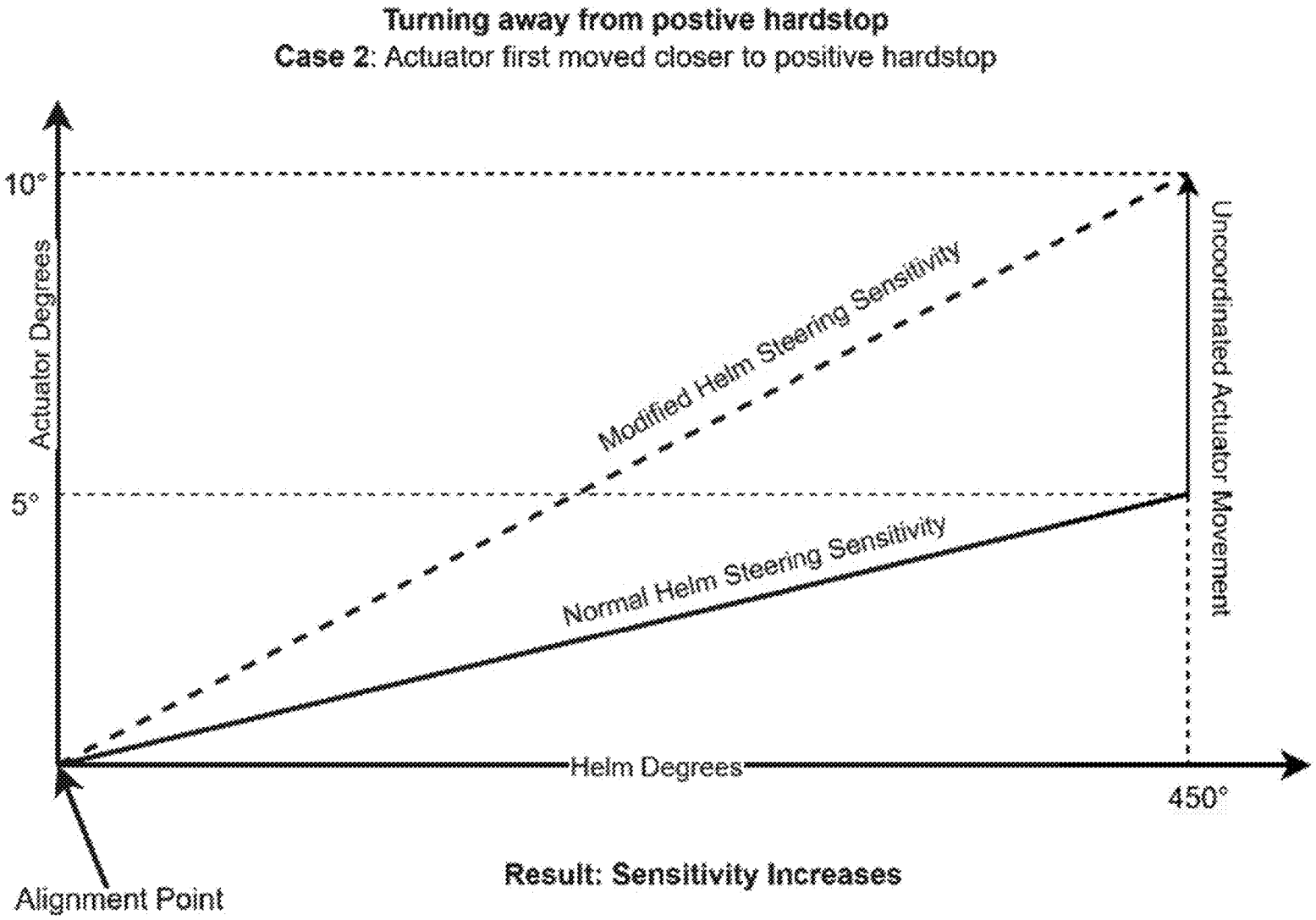

For example, in FIG. 13, the steering actuator 111 moved, uncoordinated with any movement of the helm 120, in a direction associated with moving the steering angle of the engine-thrust direction 106 toward the starboard end of the steering range of the outboard engine 105 and away from the center of the steering range of the outboard engine 105.

As with the examples of FIGS. 7 and 9-12, in response to such movement of the steering actuator 111 uncoordinated with any movement of the helm 120, program codes stored in the program-codes store 133 may when executed by the CPU 130, cause the processor circuit 129 to identify a modified association generally according to one or more factors and otherwise as described herein, for example.

In the example of FIG. 13, as in the example of FIG. 12, an alignment point represents the central steering position of the helm 120 and the central steering angle relative to the hull 102, and the helm 120 and the steering actuator 111 reach reference positions represented by the alignment point from movement of the helm 120 toward the central steering position and from movement of the outboard engine 105 toward the center of the steering range of the outboard engine 105. However, in the example of FIG. 13, the modified association 165 has a greater slope than the reference association, so the modified association is associated with higher steering sensitivity than the reference association.

In the example of FIG. 13, an amount of rotation of the helm 120 required to reach the alignment point according to the modified association is more than 360°, so reaching the alignment point according to the modified association requires passing the central steering position of the helm 120 at least once. However, alternative embodiments may differ.

Figure 14:
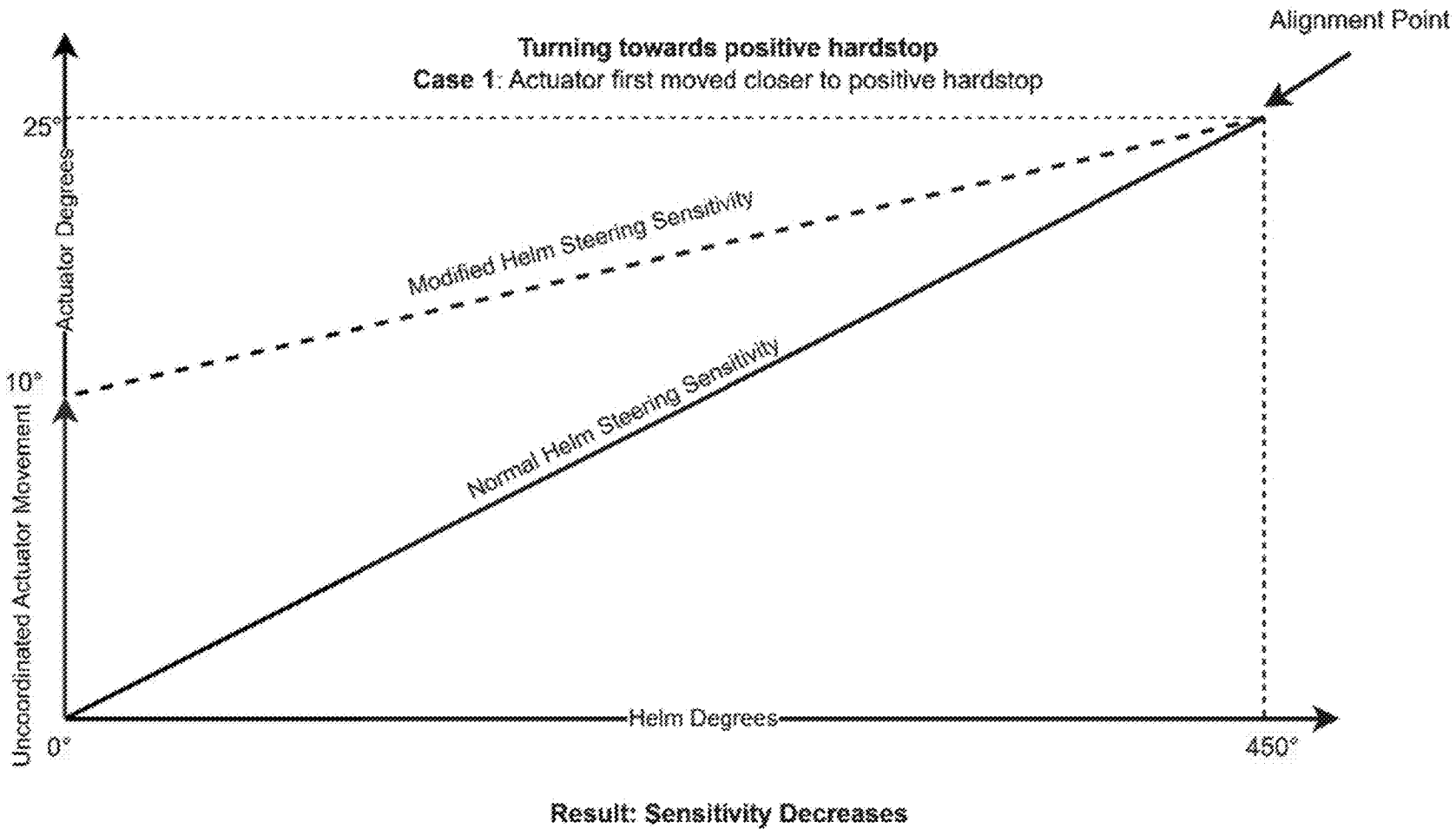

In the example of FIG. 14, the steering actuator 111 moved, uncoordinated with any movement of the helm 120, in a direction associated with moving the steering angle of the engine-thrust direction 106 toward the starboard end of the steering range of the outboard engine 105 and away from the center of the steering range of the outboard engine 105.

As with the examples of FIGS. 7 and 9-13, in response to such movement of the steering actuator 111 uncoordinated with any movement of the helm 120, program codes stored in the program-codes store 133 may when executed by the CPU 130, cause the processor circuit 129 to identify a modified association generally according to one or more factors and otherwise as described herein, for example.

However, in the example of FIG. 14, an alignment point represents a steering-input position 450° clockwise from the central steering position and a steering angle of the engine-thrust direction 106 of 25° starboard relative to the hull 102. Therefore, in the example of FIG. 14, the helm 120 and the steering actuator 111 reach reference positions represented by the alignment point, not from movement of the helm 120 toward the central steering position or from movement of the outboard engine 105 toward the center of the steering range of the outboard engine 105 as in the examples of FIGS. 12 and 13, but rather from movement of the helm 120 away from the central steering position and in a direction associated with moving the steering angle of the engine-thrust direction 106 toward a starboard end of a steering range of the outboard engine 105, and from movement of the outboard engine 105 away from the center of the steering range of the outboard engine 105 and toward a starboard end of a steering range of the outboard engine 105. Also, in the example of FIG. 14, the modified association has a lower slope than the reference association, so the modified association is associated with less steering sensitivity than the reference association.

In the example of FIG. 14, an amount of rotation of the helm 120 required to reach the alignment point according to the modified association is more than 360°, so reaching the alignment point according to the modified association requires passing, at least once, a steering position of the helm 120 at the alignment point. However, alternative embodiments may differ.

Figure 15:
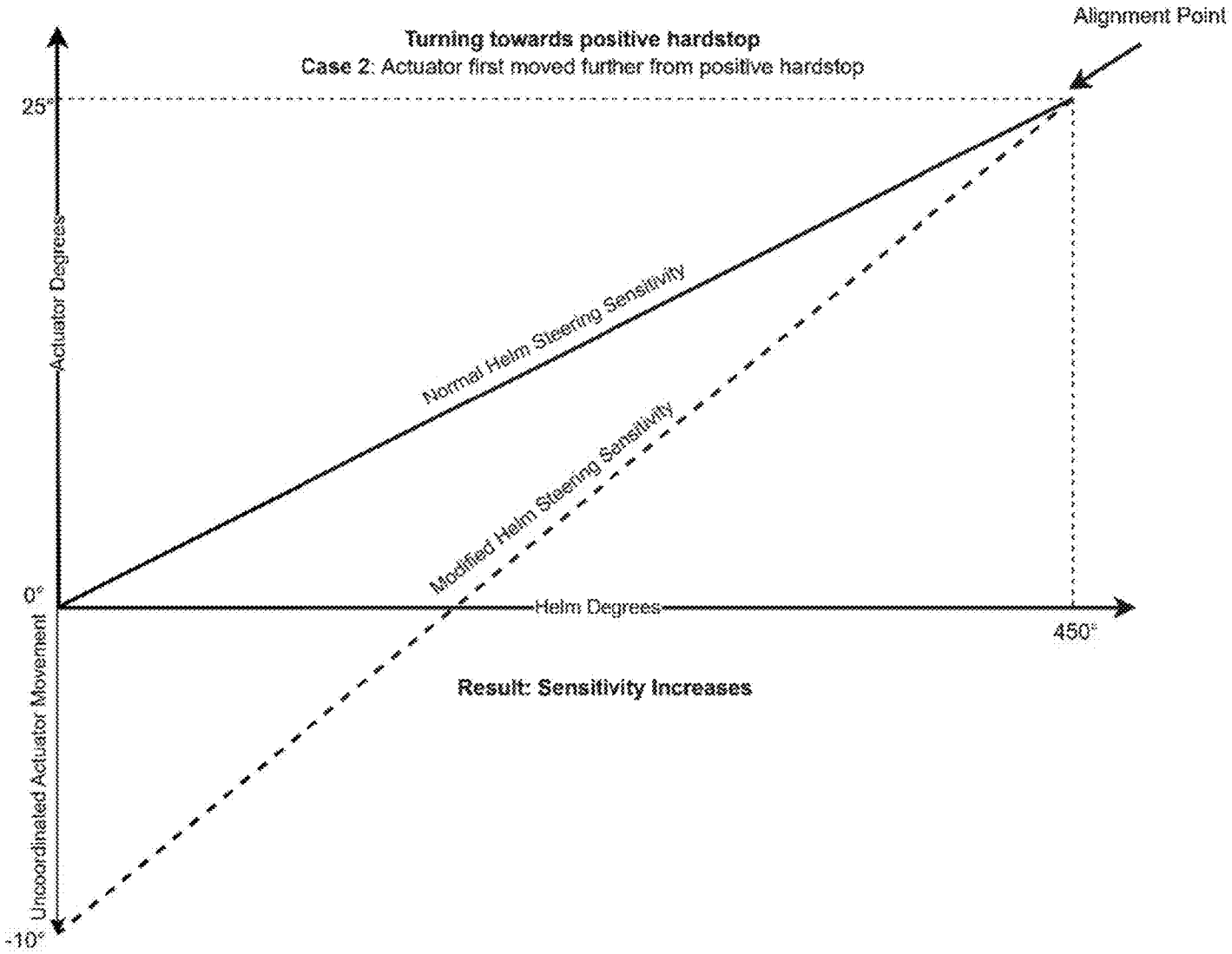

In the example of FIG. 15, the steering actuator 111 moved, uncoordinated with any movement of the helm 120, in a direction associated with moving the steering angle of the engine-thrust direction 106 toward the port end of the steering range of the outboard engine 105 and away from the center of the steering range of the outboard engine 105.

As with the examples of FIGS. 7 and 9-14, in response to such movement of the steering actuator 111 uncoordinated with any movement of the helm 120, program codes stored in the program-codes store 133 may when executed by the CPU 130, cause the processor circuit 129 to identify a modified association generally according to one or more factors and otherwise as described herein, for example. Also, in the example of FIG. 15, as in the example of FIG. 14, the helm 120 and the steering actuator 111 reach reference positions represented by the alignment point from movement of the helm 120 away from the central steering position and in a direction associated with moving the steering angle of the engine-thrust direction 106 toward a starboard end of a steering range of the outboard engine 105, and from movement of the outboard engine 105 away from the center of the steering range of the outboard engine 105 and toward a starboard end of a steering range of the outboard engine 105. Also, in the example of FIG. 15, the modified association has a greater slope than the reference association, so the modified association is associated with greater steering sensitivity than the reference association.

In the example of FIG. 15, an amount of rotation of the helm 120 required to reach the alignment point according to the modified association is more than 360°, so reaching the alignment point according to the modified association requires passing, at least once, a steering position of the helm 120 at the alignment point. However, alternative embodiments may differ.

Predefined Slope of Modified Association

As indicated above, a modified association may be identified as including a current point (the point 146 in the example of FIG. 7, the point 159 in the example of FIG. 10, or more generally any point representing a current steering-input position of the helm 120 and a current steering angle of the engine-thrust direction 106) as described above, and to have one of one or more predefined slopes or sensitivities for modified associations.

Figure 16:
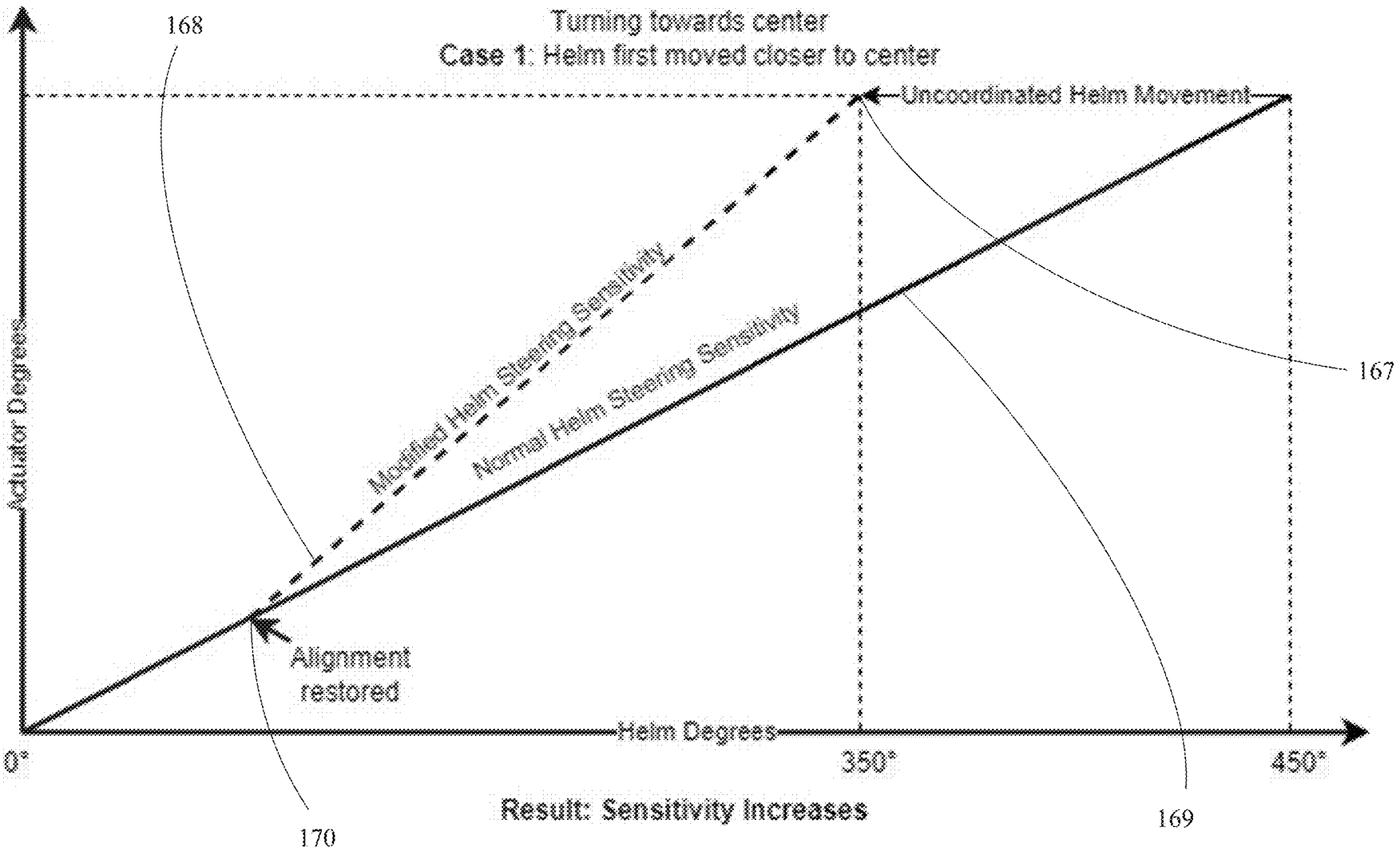

For example, in the example of FIG. 16, movement of the helm 120, uncoordinated with any movement of the steering actuator 111, is toward the central steering position and in a direction associated with moving the steering angle of the engine-thrust direction 106 away from the starboard end of the steering range of the outboard engine 105 and toward the center of the steering range of the outboard engine 105 such that the helm 120 and the steering actuator 111 have positions represented by a current point 167. A modified association 168 has a predefined slope or sensitivity greater than a slope or sensitivity of a reference association 169. In other words, the modified association 168 has a predefined ratio of amounts of change of a steering angle of the engine-thrust direction 106 to amounts of change of steering-input positions of the helm 120.

Such a predefined ratio may be modified. For example, such a predefined ratio may be decreased (to decrease steering sensitivity) when a rate of rotation or movement over time of the helm 120 is relatively high, and such a predefined ratio may be increased (to increase steering sensitivity) when a rate of rotation or movement over time of the helm 120 is relatively low.

As a result of movement of the helm 120 toward the central steering position and of movement of the outboard engine 105 toward the center of the steering range of the outboard engine 105, the helm 120 and the steering actuator 111 reach positions represented by a point 170 on the reference association 169. The point 170 is therefore an alignment point as described above, but the point 170 was not necessarily identified as part of identification of the modified association 168. Rather, the modified association 168 was identified as an association including the current point 167 and having a predefined slope or sensitivity such that the modified association 168 intersects the reference association 169 at the point 170. However, alternative embodiments may differ.

Figure 17:
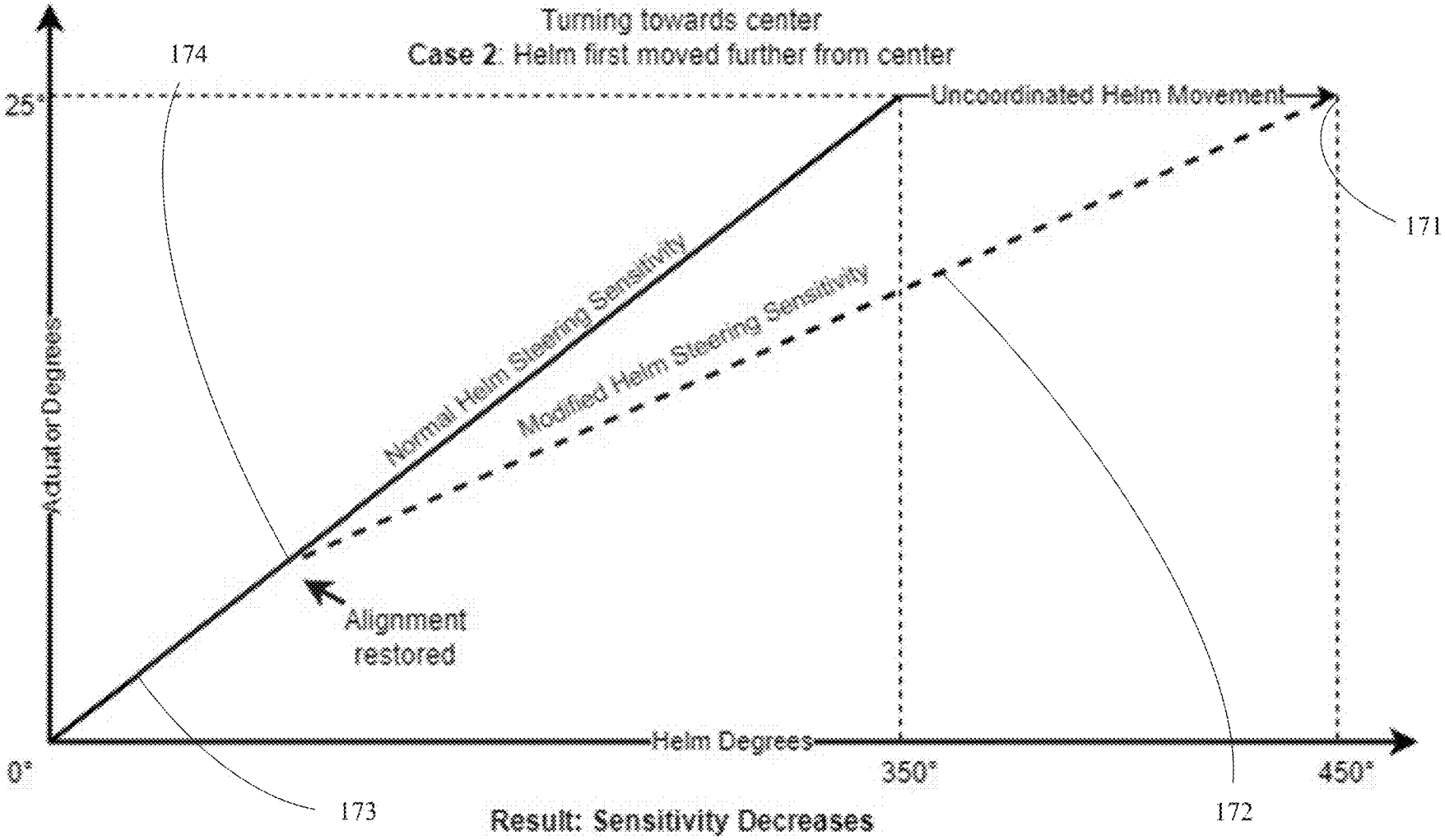

For example, in the example of FIG. 17, movement of the helm 120, uncoordinated with any movement of the steering actuator 111, is away from the central steering position and in a direction associated with moving the steering angle of the engine-thrust direction 106 toward the starboard end of the steering range of the outboard engine 105 such that the helm 120 and the steering actuator 111 have positions represented by a current point 171. A modified association 172 has a predefined slope or sensitivity less than a slope or sensitivity of a reference association 173. In other words, like the modified association 168, the modified association 172 has a predefined ratio of amounts of change of a steering angle of the engine-thrust direction 106 to amounts of change of steering-input positions of the helm 120.

As with the modified association 168, such a predefined ratio may be modified. For example, such a predefined ratio may be decreased (to decrease steering sensitivity) when a rate of rotation or movement over time of the helm 120 is relatively high, and such a predefined ratio may be increased (to increase steering sensitivity) when a rate of rotation or movement over time of the helm 120 is relatively low.

As a result of movement of the helm 120 toward the central steering position and of movement of the outboard engine 105 toward the center of the steering range of the outboard engine 105, the helm 120 and the steering actuator 111 reach positions represented by a point 174 on the reference association 173. The point 174 on the reference association 173 was not necessarily identified as part of identification of the modified association 172. Rather, the modified association 172 was identified as an association including the current point 171 and having a predefined slope or sensitivity such that the modified association 172 intersects the reference association 173 at the point 174.

As indicated above, the modified associations 168 and 172 (which are at least two possible target associations) have predefined slopes or sensitivities, the predefined slope or sensitivity of the modified association 168 being greater than the slope or sensitivity of the reference association 169, and the predefined slope or sensitivity of the modified association 168 being less than the slope or sensitivity of the reference association 173.

In general, in some embodiments, one or more predefined slopes or sensitivities may be greater than a slope or sensitivity of a reference association, one or more predefined slopes or sensitivities may be less than a slope or sensitivity of a reference association. In such embodiments, the program codes at the block 149 may when executed by the CPU 130, cause the processor circuit 129 to identify a modified association as an association having one of such predefined slopes or sensitivities, including a current point, and intersecting a reference association as in the examples of FIGS. 16 and 17, for example. In embodiments where more than one such modified association is possible, a selected modified association may be a modified association according to which an amount of rotation of the helm 120, until the helm 120 and the steering actuator 111 have positions on the reference association, is most desirable, or a selected modified association may be a modified association having a slope or sensitivity closest to a slope or sensitivity of a reference association.

Figure 18:
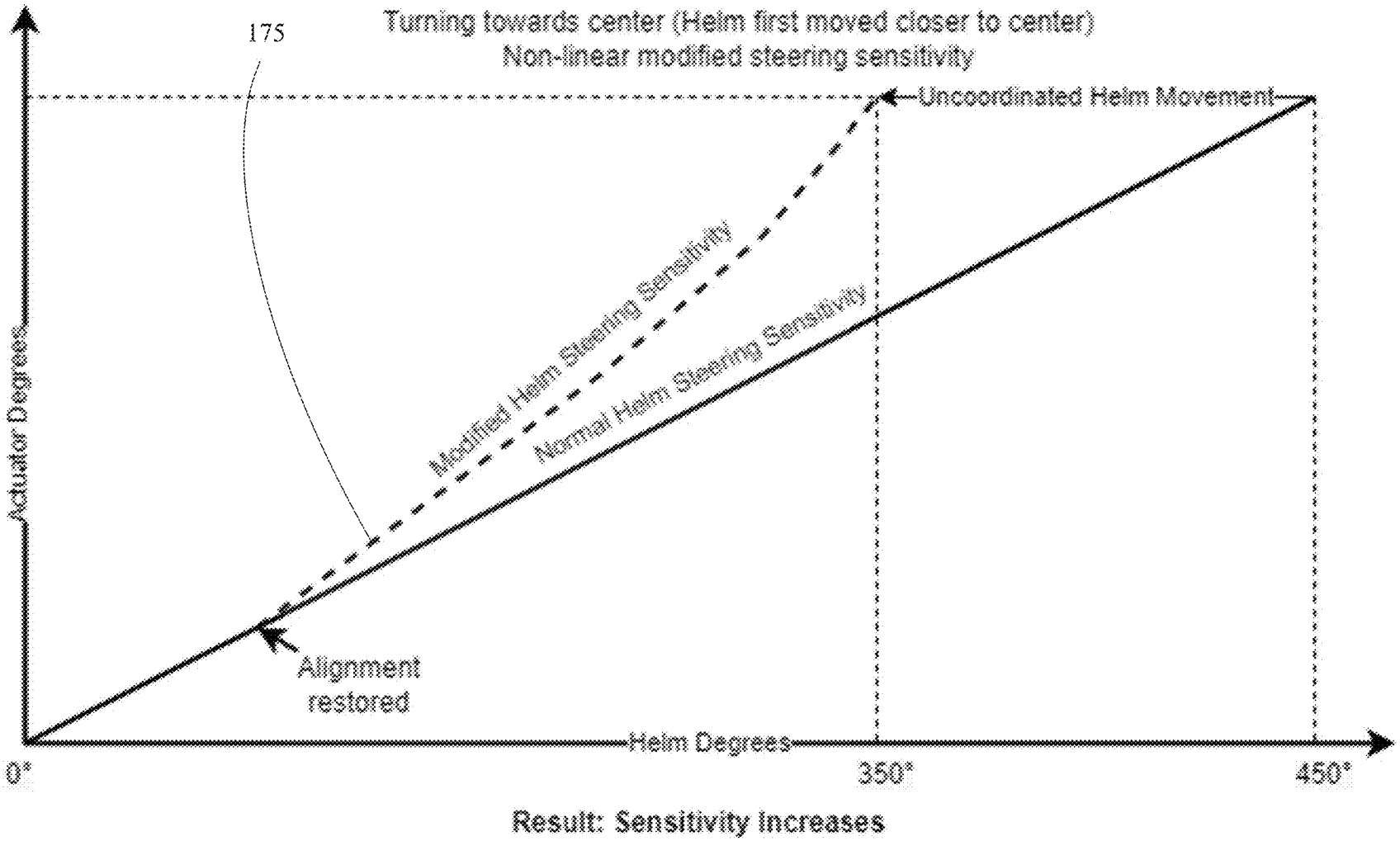

FIG. 18 illustrates an example similar to the example of FIG. 16. However, in the example of FIG. 18, a modified association 175 is non-linear.

Examples of Choosing Between Possible Modified Associations

Figure 19:
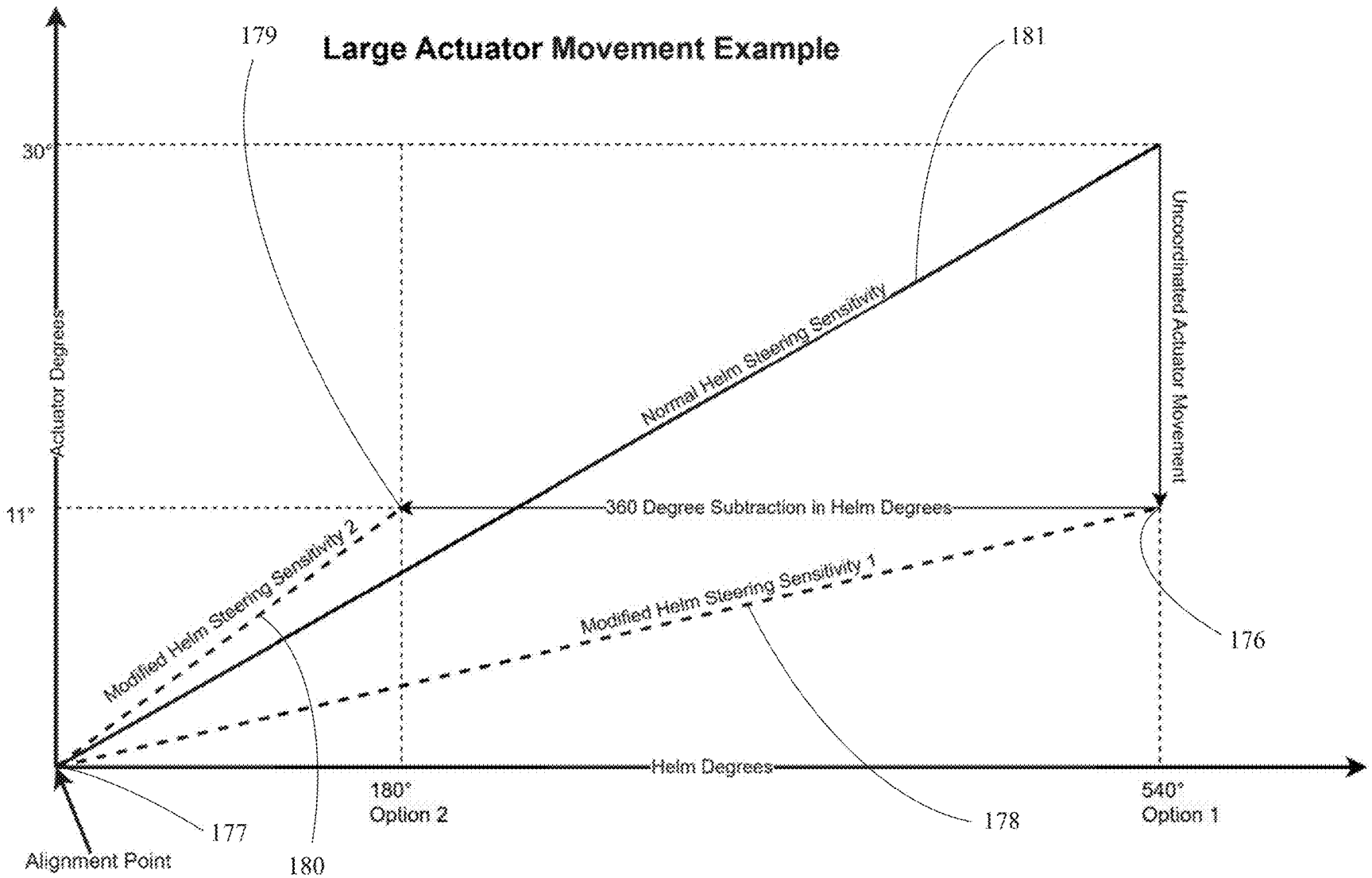

In the example of FIG. 19, the steering actuator 111 moved, uncoordinated with any movement of the helm 120, in a direction associated with moving the steering angle of the engine-thrust direction 106 toward the port end of the steering range of the outboard engine 105 and toward the center of the steering range of the outboard engine 105 such that the helm 120 and the steering actuator 111 have positions represented by a current point 176 representing a steering-input position 540° clockwise from the central steering position. In the example of FIG. 19, an alignment point 177 represents the central steering position of the helm 120 and the central steering angle relative to the hull 102, and a modified association 178 includes the current point 176 and the alignment point 177.

However, another current point 179 represents a steering-input position 180° clockwise from the central steering position. The current points 176 and 179 represent the same absolute position of the helm 120 around the helm axis of rotation 121 because 540° clockwise from the central steering position and 180° clockwise from the central steering position differ by an integer multiple of 360°. Another modified association 180 includes the current point 179 and the alignment point 177. Therefore, according to either the modified association 178 or the modified association 180, the helm 120 and the steering actuator 111 reach reference positions represented by the alignment point 177 from movement of the helm 120 toward the central steering position, and from movement of the outboard engine 105 toward the center of the steering range of the outboard engine 105.

In other words, the program codes at the block 149 may when executed by the CPU 130, cause the processor circuit 129 to identify at least two possible target associations (the modified associations 178 and 180), each associated with a respective amount of rotation required to reach the alignment point 177. The respective amounts of rotation required to reach the alignment point 177 differ by 360°, or more generally an integer multiple of 360°, or more generally by at least one complete rotation of the helm 120 around the helm axis of rotation 121.

The program codes at the block 149 may when executed by the CPU 130, cause the processor circuit 129 to select either the modified association 178 or the modified association 180 as a selected modified association according to one or more factors, such as one or more of the factors described above. For example, in the example of FIG. 19, the modified association 180 has a slope or sensitivity closer to a slope or sensitivity of a reference association 181. Further, the modified association 180 may require less rotation of the helm 120, until the helm 120 reaches the alignment point 177, than the modified association 178. Therefore, in the example of FIG. 19, those two factors may favor the modified association 180, and the program codes at the block 149 may when executed by the CPU 130, cause the processor circuit 129 to select the modified association 180 as the selected modified association.

In the example of FIG. 19, an amount of rotation of the helm 120 required to reach the alignment point 177 according to the modified association 180 differs by 360°, or more generally an integer multiple of 360°, or more generally by at least one complete rotation of the helm 120 around the helm axis of rotation 121, from an amount of rotation of the helm 120 required to reach the alignment point 177 according to the reference association 181.

Figure 20:
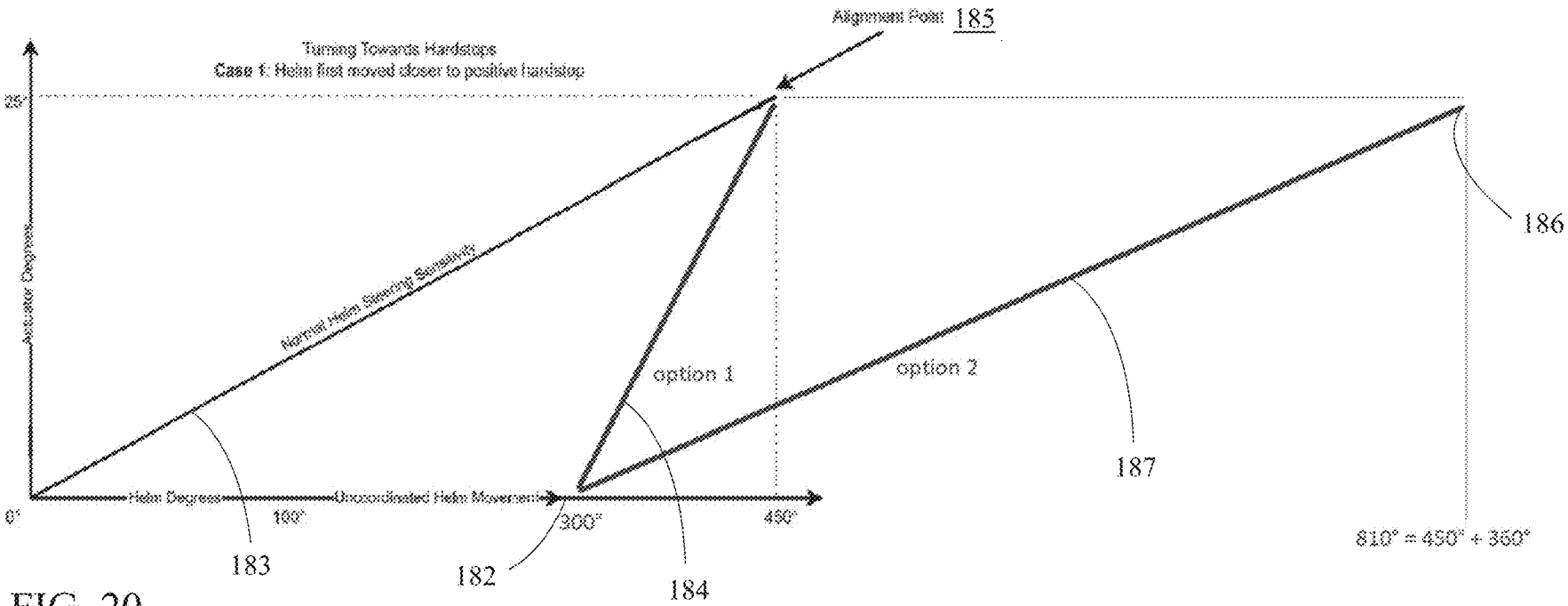

In the example of FIG. 20, the helm 120 moved, uncoordinated with any movement of the steering actuator 111 relative to the hull 102, away from the central steering position and in a direction associated with moving the steering angle of the engine-thrust direction 106 toward the starboard end of the steering range of the outboard engine 105 and away from the center of the steering range of the outboard engine 105 such that the helm 120 and the steering actuator 111 have positions represented by a current point 182. A reference association 183 and a modified association 184 include an alignment point 185 representing a steering-input position 450° clockwise from the central steering position. The modified association 184 also includes the current point 182.

However, another alignment point 186 represents a steering-input position 810° clockwise from the central steering position, which represents the same absolute position of the helm 120 around the helm axis of rotation 121 as the alignment point 185 because 810° clockwise from the central steering position and 450° clockwise from the central steering position differ by an integer multiple of 360°. Another modified association 187 includes the current point 182 and the alignment point 186.

According to either the modified association 184 or the modified association 187, the helm 120 and the steering actuator 111 reach respective different reference positions (represented by respective different alignment points of the modified associations) from movement of the helm 120 away from the central steering position and in a direction associated with moving the steering angle of the engine-thrust direction 106 toward the starboard end of the steering range of the outboard engine 105 and away from the center of the steering range of the outboard engine 105, and from movement of the outboard engine 105 away from the center of the steering range of the outboard engine 105 and toward a starboard end of a steering range of the outboard engine 105.

In other words, the program codes at the block 149 may when executed by the CPU 130, cause the processor circuit 129 to identify at least two possible target associations (the modified associations 184 and 187), each associated with a respective amount of rotation required to reach a respective alignment point. The respective amounts of rotation required to reach the respective alignment points differ by 360°, or more generally an integer multiple of 360°, or more generally by at least one complete rotation of the helm 120 around the helm axis of rotation 121.

The program codes at the block 149 may when executed by the CPU 130, cause the processor circuit 129 to select either the modified association 184 or the modified association 187 as a selected modified association according to one or more factors such as the one of more of the factors described above. For example, in the example of FIG. 20, the modified association 187 has a slope or sensitivity closer to a slope or sensitivity of the reference association 183 than the modified association 184, so the program codes at the block 149 may when executed by the CPU 130, cause the processor circuit 129 to select the modified association 187 as the selected modified association. If the modified association 187 is the selected modified association, then the reference association 183 may be shifted by 360° to include the alignment point 186 instead of the alignment point 185, or the modified association 187 may be shifted by 360° to include the alignment point 185.

Changes of Steering Direction

In the examples of FIGS. 7 and 9-20, the helm 120 is turned in one direction following uncoordinated movement. However, following uncoordinated movement, the helm 120 may be turned in more than one direction.

Figure 21:
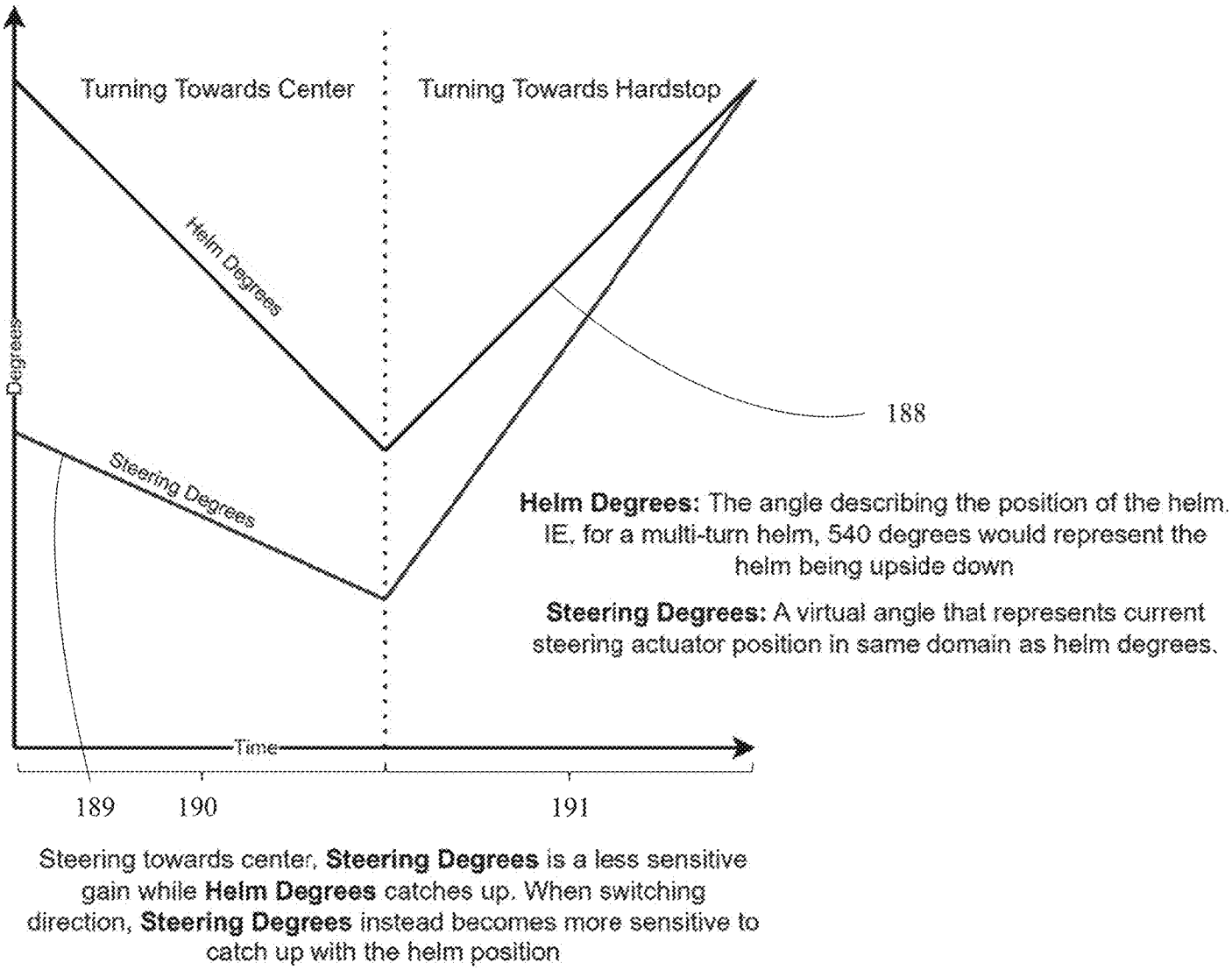

In the example of FIG. 21, lines 188 represent steering-input positions, around the helm axis of rotation 121, of the helm 120 over time, and lines 189 represent steering angles of the engine-thrust direction 106 over time. Therefore, steering sensitivity is represented in the example of FIG. 21 by ratios of absolute values of slopes of the lines 188 and 189. For example, when an absolute value of the slope of the lines 188 is greater than an absolute value of the slope of the lines 189, the steering sensitivity is relatively low, and when an absolute value of the slope of the lines 188 is less than an absolute value of the slope of the lines 189, the steering sensitivity is relatively high.

During a range 190 of times, as in the examples of FIGS. 7, 9, 12, 13, and 16-19, the helm 120 and the steering actuator 111 move toward reference positions or an alignment point from movement of the helm 120 toward the central steering position and from movement of the outboard engine 105 toward the center of the steering range of the outboard engine 105. Therefore, during the range 190 of times, as in the examples of FIGS. 9, 12, and 17, the steering sensitivity may be relatively low, and a modified association may be identified for the range 190 of times as in the examples of FIGS. 9, 12, and 17.

However, during a range 191 of times, as in the examples of FIGS. 10, 11, 14, 15, and 20, the helm 120 and the steering actuator 111 move toward reference positions or an alignment point from movement of the helm 120 away from the central steering position and in a direction associated with moving the steering angle of the engine-thrust direction 106 toward a starboard end of a steering range of the outboard engine 105, and from movement of the outboard engine 105 away from the center of the steering range of the outboard engine 105 and toward a starboard end of a steering range of the outboard engine 105. Therefore, during the range 191 of times, as in the examples of FIGS. 10 and 15, the steering sensitivity may be relatively high, and a modified association may be identified for the range 191 of times as in the examples of FIGS. 10 and 15.

Steering Input Associated with Quantity Related to Direction

In embodiments such as those described above, steering inputs (such as steering-input positions of the helm 120, movement of the helm 120, or both) may be associated with respective steering angles of the engine-thrust direction 106. However, alternative embodiments may differ, and in some embodiments, such steering inputs may be associated instead with respective quantities related to directions, such as directions (for example, relative to ground or some other stationary or moving frame of reference) of travel of the watercraft 101 or headings (for example, relative to magnetic north or some other stationary or moving reference direction) of the watercraft 101.

Figure 22:
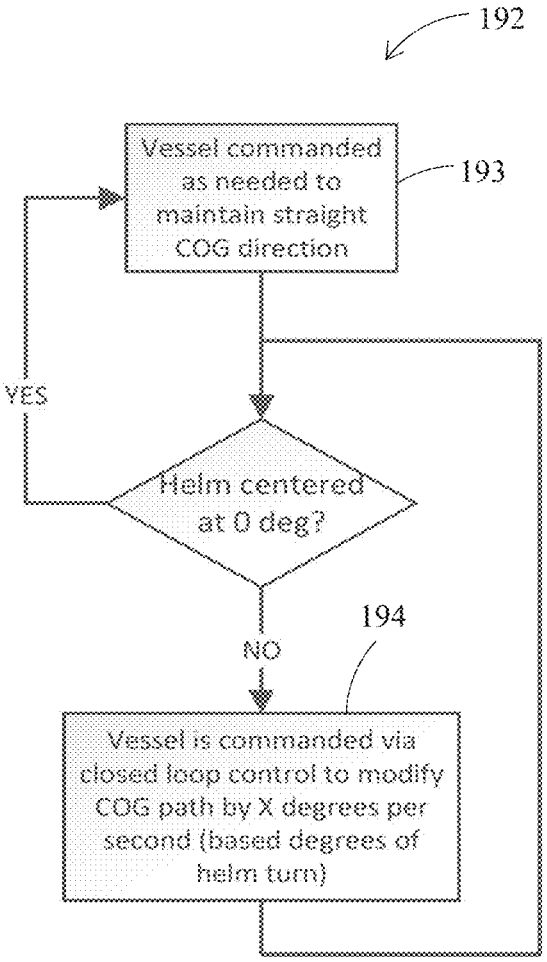
FIGS. 22 and 23 illustrate blocks of program codes that may be stored in the data-storage device of the processor circuit of the controller of FIG. 3.

For example, FIG. 22 illustrates blocks shown generally at 192 of program codes that may be stored in the program-codes store 133 and that, when executed by the CPU 130, may cause the processor circuit 129 to implement a process for controlling directions of travel of the watercraft 101 according to steering inputs.

In the example of FIG. 22, the blocks 192 include a block 193 including program codes that may be executed when the helm 120 is at the central steering position and that, when executed by the CPU 130, may cause the processor circuit 129 to control the steering actuator 111 such that the engine-thrust direction 106 causes the watercraft 101 to travel in a constant direction relative to ground.

Also, in the example of FIG. 22, the blocks 192 include a block 194 including program codes that may be executed when the helm 120 is not at the central steering position and that, when executed by the CPU 130, may cause the processor circuit 129 to control the steering actuator 111 such that the engine-thrust direction 106 causes a direction of travel of the watercraft 101 relative to ground to change at a rate over time associated with an amount and direction of rotation of the helm 120 from the central steering position. For example, rotation of the helm 120 counterclockwise from the central steering position may be associated with change of the direction of travel of the watercraft 101 relative to ground towards port, and rotation of the helm 120 clockwise from the central steering position may be associated with change of the direction of travel of the watercraft 101 relative to ground towards starboard. Also, for example, smaller amounts of rotation of the helm 120 from the central steering position may be associated with relatively small rates of change over time of the direction of travel of the watercraft 101 relative to ground, and larger amounts of rotation of the helm 120 from the central steering position may be associated with relatively large rates of change over time of the direction of travel of the watercraft 101 relative to ground.

In the example of FIG. 22, the steering actuator 111 is controlled in response to, at least, a steering-input position of the helm 120 and an association between steering-input positions of the helm 120 and respective target quantities (rates of change over time of the direction of travel of the watercraft 101 relative to ground) related to direction of the watercraft.

Figure 23:
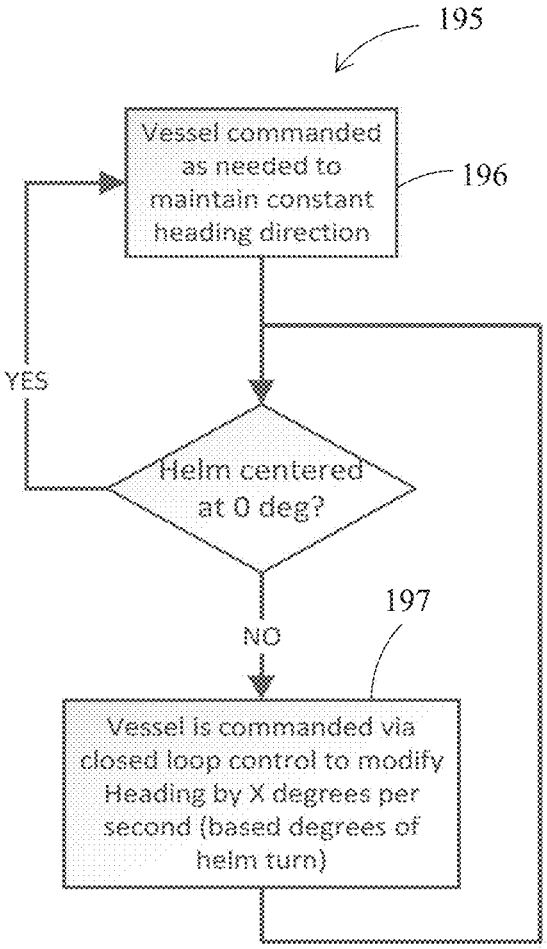

As another example, FIG. 23 illustrates blocks shown generally at 195 of program codes that may be stored in the program-codes store 133 and that, when executed by the CPU 130, may cause the processor circuit 129 to implement a process for controlling headings of the watercraft 101 according to steering inputs.

In the example of FIG. 23, the blocks 195 include a block 196 including program codes that may be executed when the helm 120 is at the central steering position and that, when executed by the CPU 130, may cause the processor circuit 129 to control the steering actuator 111 such that the engine-thrust direction 106 causes the watercraft 101 to have a constant heading (for example relative to magnetic north or some other stationary or moving reference direction).

Also, in the example of FIG. 23, the blocks 195 include a block 197 including program codes that may be executed when the helm 120 is not at the central steering position and that, when executed by the CPU 130, may cause the processor circuit 129 to control the steering actuator 111 such that the engine-thrust direction 106 causes a heading (for example relative to magnetic north or some other stationary or moving reference direction) of the watercraft 101 to change at a rate over time associated with an amount and direction of rotation of the helm 120 from the central steering position. For example, rotation of the helm 120 counterclockwise from the central steering position may be associated with change of the heading of the watercraft 101 towards port, and rotation of the helm 120 clockwise from the central steering position may be associated with change of the heading of the watercraft 101 towards starboard. Also, for example, smaller amounts of rotation of the helm 120 from the central steering position may be associated with relatively small rates of change over time of the heading of the watercraft 101, and larger amounts of rotation of the helm 120 from the central steering position may be associated with relatively large rates of change over time of the heading of the watercraft 101.

In the example of FIG. 23, the steering actuator 111 is controlled in response to, at least, a steering-input position of the helm 120 and an association between steering-input positions of the helm 120 and respective target quantities (rates of change over time of the heading of the watercraft 101) related to direction of the watercraft.

Estimated Non-Steering Influence

The examples of FIGS. 22 and 23 may involve estimating a non-steering influence on movement of the watercraft 101. In some embodiments, such a non-steering influence on movement of the watercraft 101 may include an estimated non-steering influence on a direction of movement of the watercraft 101, or an estimated non-steering influence on a rate of change over time of a direction of movement of the watercraft 101. In some embodiments, such a direction of movement of the watercraft 101 may be a direction of movement of the watercraft 101 relative to ground or some other stationary or moving frame of reference.

In some embodiments, such a non-steering influence may result from positions of one or both of the trim tabs 116 and 117. For example, if the port trim tab 116 is extended farther than the starboard trim tab 117, then a non-steering influence may urge the watercraft 101 towards port. However, alternative embodiments may differ and such a non-steering influence may also result from wind, water current, drag from one or more objects other than a trim tab, one or more other causes, or a combination of two or more thereof.

In some embodiments, such a non-steering influence may be estimated by a feed-forward controller configured to estimate such a non-steering influence in response to one or more inputs. Such a feed-forward controller may be implemented by program codes stored in the program-codes store 133 such that execution of such program codes by the CPU 130 causes the processor circuit 129 to implement such a feed-forward controller. Such a feed-forward controller is indicated schematically at 198 in FIGS. 24-26.

In some embodiments, one or more inputs for the feed-forward controller 198 may include a rate of change over time of the heading of the watercraft 101, for example as measured by the heading sensor 126. For example, a rate of change over time of the heading of the watercraft 101 may indicate one or more non-steering forces or torques applied to the watercraft 101.

Also, in some embodiments, one or more inputs for the feed-forward controller 198 may include characteristics of the watercraft 101, such as size of the watercraft 101, weight or mass of the watercraft 101, a drag coefficient of the watercraft 101, fluid resistance of the watercraft 101, one or more other characteristics, or a combination of two or more thereof. Codes representing one, more than one, or all of such characteristics may be stored in a parameters store 199 in the data-storage device 132.

Also, in some embodiments, one or more inputs for the feed-forward controller 198 may include one or more estimations of speed (relative to water, relative to ground, or relative to some other stationary or moving frame of reference) of the watercraft 101. For example, such speed of the watercraft 101 may be estimated from RPM of the outboard engine 105, one or more other indications of the magnitude of the engine thrust force of the outboard engine 105, the geopositioning device 127, one or more other sources, or a combination of two or more thereof.

Also, in some embodiments, one or more inputs for the feed-forward controller 198 may include positions of the trim tabs 116 and 117.

Also, in some embodiments, one or more inputs for the feed-forward controller 198 may include the ballast configuration of the ballast system 104.

Figure 24:
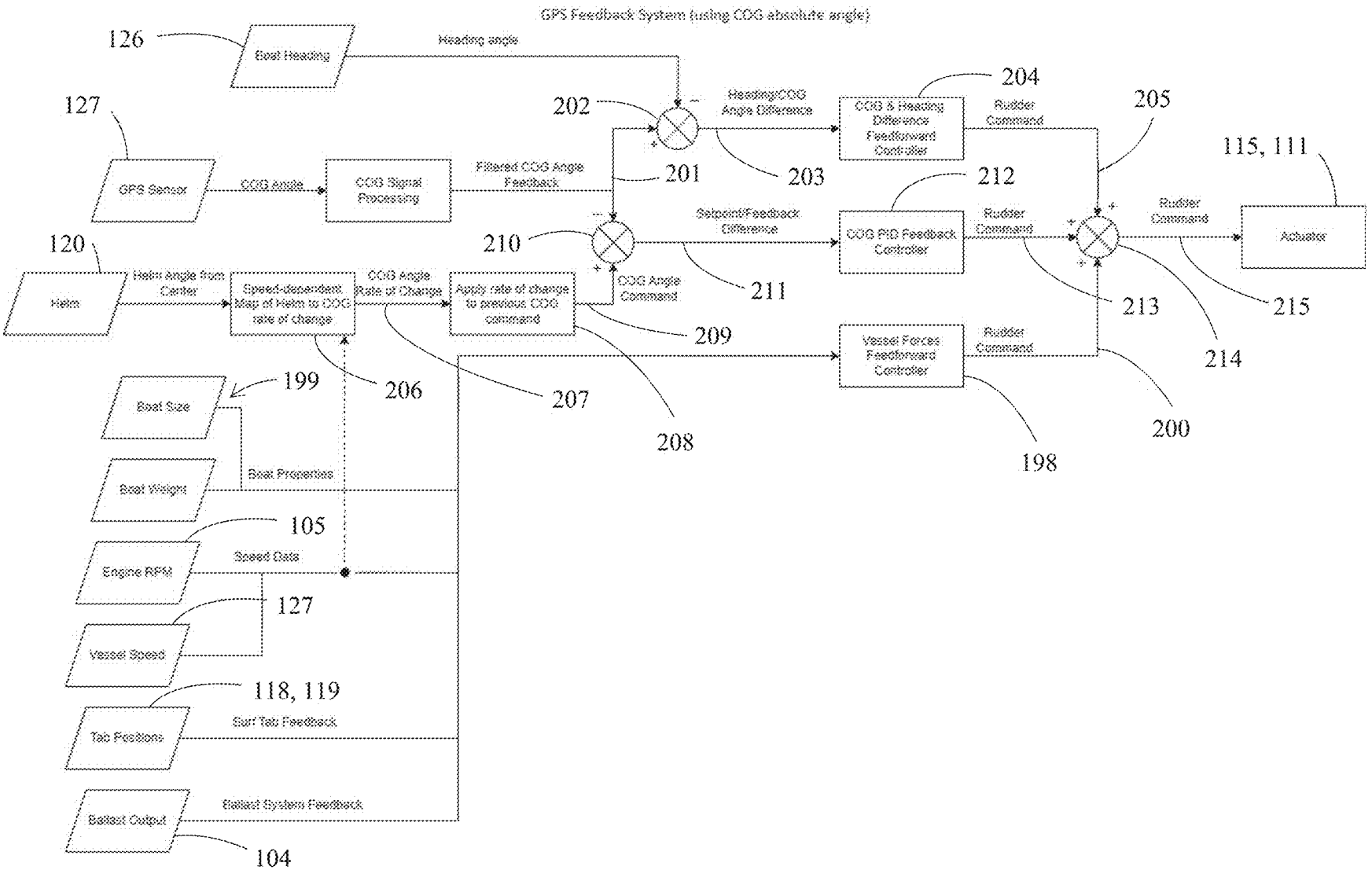
FIGS. 24-26 illustrate examples of steering control according to various embodiments that may be implemented by program codes stored in the data-storage device of the processor circuit of the controller of FIG. 3.
Figure 25:
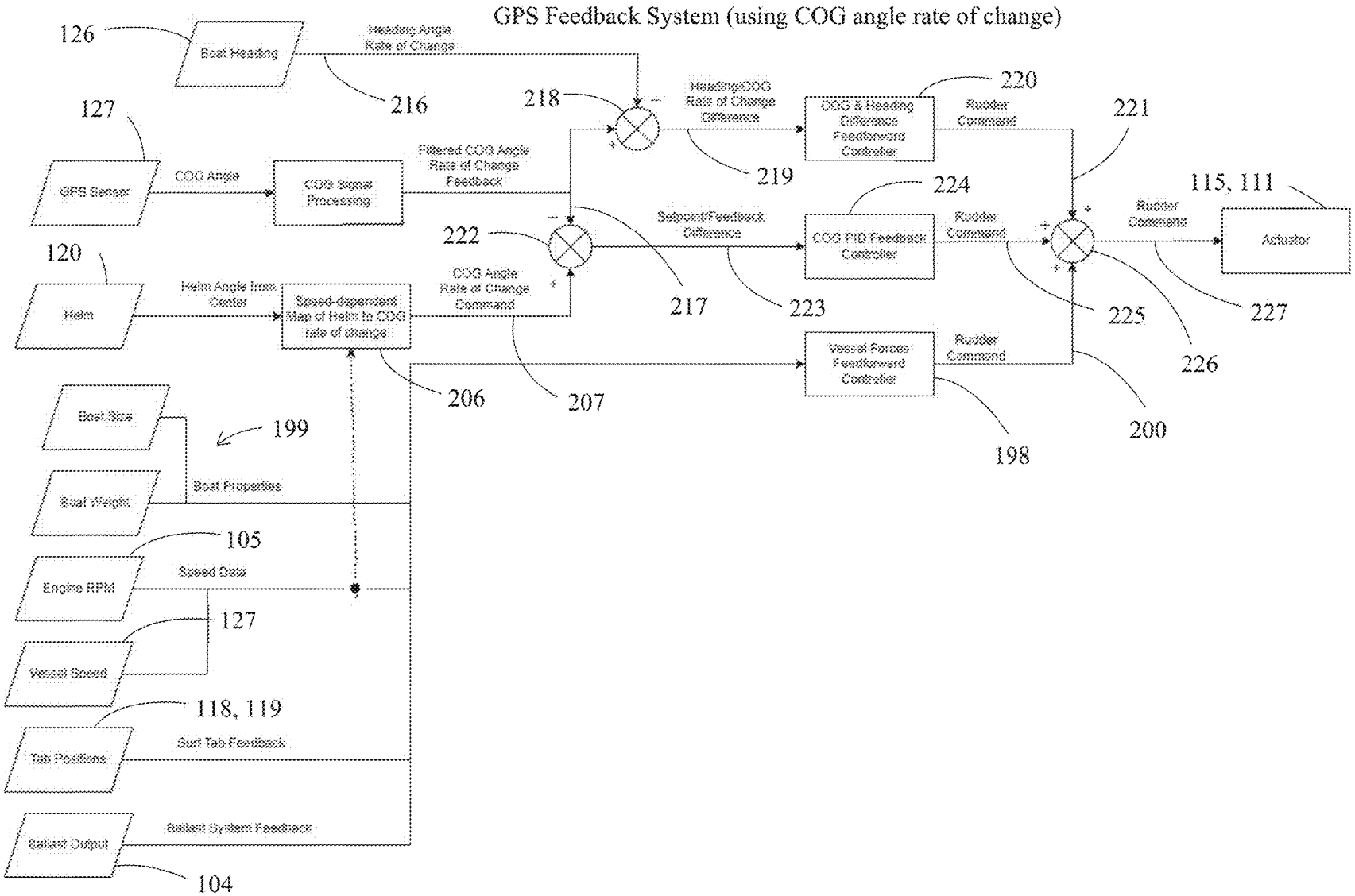
Figure 26:
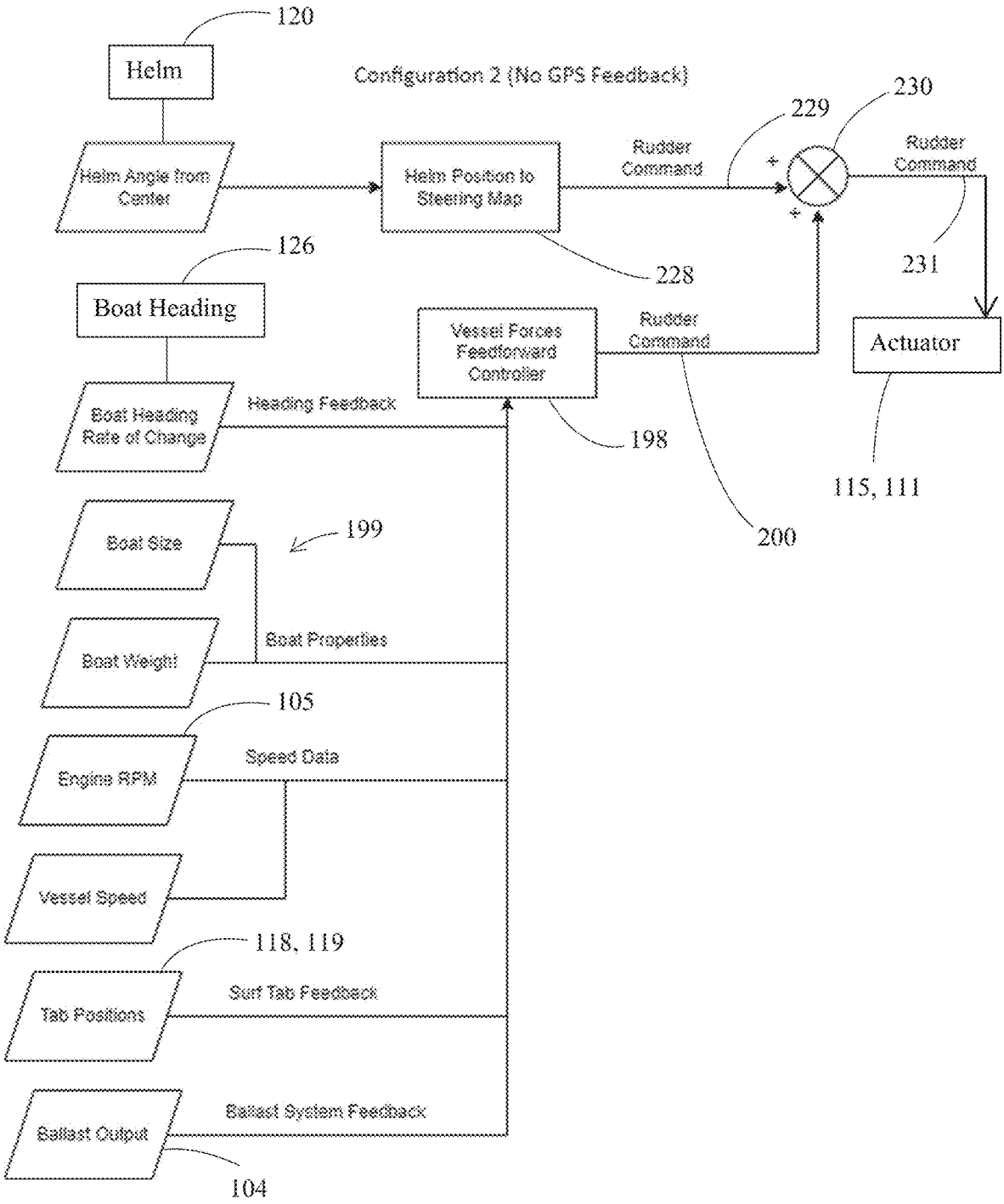

FIGS. 24-26 illustrate schematically such inputs to the feed-forward controller 198. However, alternative embodiments may differ and may include more, fewer, or different inputs, or may include one or more alternatives to the feed-forward controller 198.

In general, the feed-forward controller 198 may be implemented as an empirical model based on principles of physics related to force, torque, acceleration, and drag, or may include a machine-learning or statistical-learning model, and may be refined or trained by experimentation to identify other model parameters (that may also be identified by codes stored in the parameters store 199) to identify a change to the steering angle of the engine-thrust direction 106 to compensate for any non-steering influence on movement of the watercraft 101. Such an identified change to the steering angle of the engine-thrust direction 106 is shown schematically at 200 in FIGS. 24-26.

Steering Control Using Geopositioning Device and Measurement of Heading

In some embodiments, one or more signals from the geopositioning device 127 may facilitate steering control. For example, in the example of FIG. 24, one or more signals from the geopositioning device 127 may be used to produce estimates of direction of travel of the watercraft 101 relative to ground, and such estimates may be filtered to produce a filtered estimate of direction of travel of the watercraft 101 relative to ground, as shown schematically at 201 in FIG. 24.

Also, in some embodiments, one or more signals from the heading sensor 126 may facilitate steering control. For example, in the example of FIG. 24, one or more signals from the heading sensor 126 may be compared (as shown schematically at 202) to the filtered estimate of direction of travel of the watercraft 101 relative to ground (as shown schematically at 201) to produce (as shown schematically at 203) a difference between a measured heading of the watercraft 101 and the filtered estimate of direction of travel of the watercraft 101 relative to ground. In general, such a comparison (and other comparisons, combinations, or other operations as described herein) may be implemented by program codes stored in the program-codes store 133 such that execution of such program codes by the CPU 130 causes the processor circuit 129 to implement such comparison, combination, or other operation.

Also, in general, the measured heading of the watercraft 101 and the filtered estimate of direction of travel of the watercraft 101 relative to ground may differ (at 202 and 203) if some force, torque, or both on the watercraft 101 is causing the watercraft 101 to travel in a direction relative to ground that differs from the heading of the watercraft 101, causing the heading of the watercraft 101 to differ from the direction in which the watercraft 101 is traveling relative to ground, or both.

When the measured heading of the watercraft 101 differs (at 202 and 203) from the filtered estimate of direction of travel of the watercraft 101 relative to ground, the steering angle of the engine-thrust direction 106 may be adjusted in order to maintain the direction of travel of the watercraft 101 relative to ground. For example, if the measured heading of the watercraft 101 is towards the port side of the direction of travel of the watercraft 101 relative to ground, then adjusting the steering angle of the engine-thrust direction 106 towards starboard in response may compensate for the measured heading of the watercraft 101 being towards the port side of the direction of travel of the watercraft 101 relative to ground, and may maintain the direction of travel of the watercraft 101 relative to ground.

In some embodiments, such compensation for a difference (at 202 and 203) between the measured heading of the watercraft 101 and the filtered estimate of direction of travel of the watercraft 101 relative to ground may be estimated by a feed-forward controller indicated schematically at 204 in FIG. 24. Like the feed-forward controller 198, the feed-forward controller 204 may be implemented by program codes stored in the program-codes store 133 such that execution of such program codes by the CPU 130 causes the processor circuit 129 to implement such a feed-forward controller. Also like the feed-forward controller 198, the feed-forward controller 204 may be implemented as an empirical model based on principles of physics related to force, torque, acceleration, and drag, or may include a machine-learning or statistical-learning model, and may be refined or trained by experimentation to identify other model parameters (that may also be identified by codes stored in the parameters store 199) that identify a change to the steering angle of the engine-thrust direction 106 to compensate for any difference (at 202 and 203) between the measured heading of the watercraft 101 and the filtered estimate of direction of travel of the watercraft 101 relative to ground. Such an identified change to the steering angle of the engine-thrust direction 106 is shown schematically at 205 in FIG. 24.

Steering Input Associated with Rate of Change of Direction Relative to Ground

In the examples of FIGS. 24 and 25, as in the example of FIG. 22, amounts and directions of rotation of the helm 120 from the central steering position may be associated with different rates of change over time of directions of travel of the watercraft 101 relative to ground. Such an association is illustrated schematically at 206 in FIGS. 24 and 25 and more generally may be an association between steering-input positions of the helm 120 and respective target quantities (namely rates of change over time of directions of travel of the watercraft 101 relative to ground) related to direction of the watercraft.

For example, positions of the helm 120 counterclockwise from the central steering position may be associated with respective rates of change over time of direction of travel of the watercraft 101 relative to ground towards port, and positions of the helm 120 clockwise from the central steering position may be associated with respective rates of change over time of direction of travel of the watercraft 101 relative to ground towards starboard. Also, for example, smaller amounts of rotation of the helm 120 from the central steering position may be associated with relatively small rates of change over time of direction of travel of the watercraft 101 relative to ground, and larger amounts of rotation of the helm 120 from the central steering position may be associated with relatively large rates of change over time of direction of travel of the watercraft 101 relative to ground.

The association 206 may be (but is not necessarily) speed-dependent and therefore may vary according to estimated speeds of the watercraft 101 (as estimated from RPM of the outboard engine 105, from one or more other indications of the magnitude of the engine thrust force of the outboard engine 105, from the geopositioning device 127, from one or more other sources, or from a combination of two or more thereof). For example, at higher estimated speeds of the watercraft 101, the association 206 may be less sensitive than at lower estimated speeds of the watercraft 101.

A target or desired rate of change over time of the direction of travel of the watercraft 101 relative to ground, shown schematically at 207 in FIG. 24, may be identified as the rate of change over time of direction of travel of the watercraft 101 relative to ground associated with a current steering-input position of the helm 120 according to the association 206. The target or desired rate of change over time of direction 207 may then be applied (as shown schematically at 208) to a previous command for a course over ground to produce a target or desired direction of travel of the watercraft 101 relative to ground, shown schematically at 209 in FIG. 24. For example, if a previous command for a course over ground indicated a particular direction of travel of the watercraft 101 relative to ground, then the target or desired direction of travel 209 of the watercraft 101 relative to ground may be that direction indicated by the previous command for a course over ground, but modified to reflect the target or desired rate of change over time of direction 207.

The target or desired direction of travel 209 of the watercraft 101 relative to ground may be compared (as shown schematically at 210) to the filtered estimate of direction of travel of the watercraft 101 relative to ground (as shown schematically at 201) to produce a difference (as shown schematically at 211) between the target or desired direction 207 and the filtered estimate of direction of travel of the watercraft 101 relative to ground (as shown schematically at 201).

In general, the steering angle of the engine-thrust direction 106 may be changed to reduce or eliminate the difference 211. In some embodiments, such compensation for a difference 211 between the measured heading of the watercraft 101 and the filtered estimate of direction of travel of the watercraft 101 relative to ground may be estimated by a feedback controller indicated schematically at 212 in FIG. 24. Like the feed-forward controllers 198 and 204, the feedback controller 212 may be implemented by program codes stored in the program-codes store 133 such that execution of such program codes by the CPU 130 causes the processor circuit 129 to implement such a feedback controller. Also like the feed-forward controllers 198 and 204, the feedback controller 212 may be implemented as an empirical model based on principles of physics related to force, torque, acceleration, and drag, or may include a machine-learning or statistical-learning model, and may be refined or trained by experimentation to identify other model parameters (that may also be identified by codes stored in the parameters store 199) that identify a change to the steering angle of the engine-thrust direction 106 to reduce or eliminate the difference 211. Alternatively, the feedback controller 212 may be a proportional-integral-derivative (PID) controller operable to identify a change to the steering angle of the engine-thrust direction 106 to reduce or eliminate the difference 211. Such an identified change to the steering angle of the engine-thrust direction 106 is shown schematically at 213 in FIG. 24.

As shown schematically at 214 in FIG. 24, the identified changes 200, 205, and 213 to the steering angle of the engine-thrust direction 106 may be combined to produce one or more signals 215 for the steering control unit 115 to control the steering actuator 111 to implement the identified changes 200, 205, and 213.

In the example of FIG. 24, the steering actuator 111 is controlled in response to, at least, 1. a steering-input position of the helm 120 (as shown schematically at 120, 206, 207, 208, 209, 210, 211, 212, 213, 214, and 215),
2. an association 206 between steering-input positions of the helm 120 and respective target quantities related to direction of the watercraft (as shown schematically at 206, 207, 208, 209, 210, 211, 212, 213, 214, and 215),
3. a heading difference 203 between a measured heading quantity (heading of the watercraft 101) and a measured direction quantity (direction of travel of the watercraft 101 relative to ground), as shown schematically at 126, 202, 203, 204, 205, 215, to reduce the heading difference, 4. an estimated non-steering influence on movement of the watercraft 101 (as shown schematically at 198, 200, 214, and 215), and
5. a direction difference 211 between
   a. a measured direction quantity (the filtered estimate of direction of travel of the watercraft 101 relative to ground, as shown schematically at 201) related to the direction of travel of the watercraft 101, and
   b. a desired direction quantity (the target or desired direction of travel of the watercraft 101 relative to ground, as shown schematically at 209) related to the direction of travel of the watercraft 101, the desired direction quantity identified according to, at least, the steering-input position of the helm 120 and the association 206 to reduce the direction difference (as shown schematically at 120, 206, 207, 208, 209, 210, 211, 212, 213, 214, and 215).

Steering Control Using Rates of Change Over Time

In the example of FIG. 24, the difference 210 is between the filtered estimate of direction of travel of the watercraft 101 relative to ground (as shown schematically at 201) and the target or desired direction of travel of the watercraft 101 relative to ground (as shown schematically at 209). However, in the example of FIG. 25, the steering actuator 111 is controlled in response to, at least, a difference between a filtered estimate of a rate of change over time of direction of travel of the watercraft 101 relative to ground and the target or desired rate of change over time of direction of travel of the watercraft 101 relative to ground.

In the example of FIG. 25, a measured heading rate of change over time 216 is estimated or calculated from one or more signals from the heading sensor 126. Also, in the example of FIG. 25, one or more signals from the geopositioning device 127 may be used to produce estimates of rate of change over time of direction of travel of the watercraft 101 relative to ground, and such estimates may be filtered to produce a filtered estimate of rate of change over time of direction of travel of the watercraft 101 relative to ground, as shown schematically at 217 in FIG. 25.

The measured heading rate of change over time 216 may be compared (as shown schematically at 218) to the filtered estimate 217 of rate of change over time of direction of travel of the watercraft 101 relative to ground to produce (as shown schematically at 219) a difference between the measured heading rate of change over time 216 and the filtered estimate 217 of rate of change over time of direction of travel of the watercraft 101 relative to ground.

In general, as in the example of FIG. 24, the measured heading rate of change over time 216 and the filtered estimate 217 of rate of change over time of direction of travel of the watercraft 101 relative to ground may differ (at 218 and 219) if some force, torque, or both on the watercraft 101 is causing the watercraft 101 to change heading at a rate of change over time different from a rate of change over time of a direction of travel relative to ground, and when the measured heading rate of change over time 216 differs (at 218 and 219) from the filtered estimate 217 of rate of change over time of direction of travel of the watercraft 101 relative to ground, the steering angle of the engine-thrust direction 106 may be adjusted in order to maintain the rate of change over time of the direction of travel of the watercraft 101 relative to ground. In some embodiments, such compensation for a difference (at 218 and 219) between the measured heading rate of change over time 216 and the filtered estimate 217 of rate of change over time of direction of travel of the watercraft 101 relative to ground may be estimated by a feed-forward controller indicated schematically at 220 in FIG. 25.

Like the feed-forward controllers 198 and 204 and the feedback controller 212, the feed-forward controller 220 may be implemented by program codes stored in the program-codes store 133 such that execution of such program codes by the CPU 130 causes the processor circuit 129 to implement such a feed-forward controller. Also like the feed-forward controllers 198 and 204 and the feedback controller 212, the feed-forward controller 220 may be implemented as an empirical model based on principles of physics related to force, torque, acceleration, and drag, or may include a machine-learning or statistical-learning model, and may be refined or trained by experimentation to identify other model parameters (that may also be identified by codes stored in the parameters store 199) that identify a change to the steering angle of the engine-thrust direction 106 to compensate for any difference (at 218 and 219) between the measured heading rate of change over time 216 and the filtered estimate 217 of rate of change over time of direction of travel of the watercraft 101 relative to ground. Such an identified change to the steering angle of the engine-thrust direction 106 is shown schematically at 221 in FIG. 25.

Also, in the example of FIG. 25, the target or desired rate of change over time of direction 207 may then be compared (as shown schematically at 222) to the filtered estimate 217 of rate of change over time of direction of travel of the watercraft 101 relative to ground to produce a difference (as shown schematically at 223) between the target or desired rate of change over time of direction 207 and the rate of change over time of the filtered estimate of direction of travel of the watercraft 101 relative to ground (as shown schematically at 217).

In general, the steering angle of the engine-thrust direction 106 may be changed to reduce or eliminate the difference 223. In some embodiments, such compensation for a difference 223 between the target or desired rate of change over time of direction 207 and the rate of change over time of the filtered estimate of direction of travel of the watercraft 101 relative to ground (as shown schematically at 217) may be estimated by a feedback controller indicated schematically at 224 in FIG. 25. Like the feed-forward controllers 198, 204, and 220 and the feedback controller 212, the feedback controller 224 may be implemented by program codes stored in the program-codes store 133 such that execution of such program codes by the CPU 130 causes the processor circuit 129 to implement such a feedback controller. Also like the feed-forward controllers 198, 204, and 220 and the feedback controller 212, the feedback controller 224 may be implemented as an empirical model based on principles of physics related to force, torque, acceleration, and drag, or may include a machine-learning or statistical-learning model, and may be refined or trained by experimentation to identify other model parameters (that may also be identified by codes stored in the parameters store 199) that identify a change to the steering angle of the engine-thrust direction 106 to reduce or eliminate the difference 223. Alternatively, like the feedback controller 212, the feedback controller 224 may be a proportional-integral-derivative (PID) controller operable to identify a change to the steering angle of the engine-thrust direction 106 to reduce or eliminate the difference 223. Such an identified change to the steering angle of the engine-thrust direction 106 is shown schematically at 225 in FIG. 25.

As shown schematically at 226 in FIG. 25, the identified changes 200, 221, and 225 to the steering angle of the engine-thrust direction 106 may be combined to produce one or more signals 227 for the steering control unit 115 to control the steering actuator 111 to implement the identified changes 200, 221, and 225.

In the example of FIG. 25, the steering actuator 111 is controlled in response to, at least, 1. a steering-input position of the helm 120 (as shown schematically at 120, 206, 207, 222, 223, 224, 225, 226, and 227),
2. an association 206 between steering-input positions of the helm 120 and respective target quantities related to direction of the watercraft (as shown schematically at 206, 207, 222, 223, 224, 225, 226, and 227),
3. a heading difference 219 between a measured heading quantity (rate of change over time of a measured heading of the watercraft 101) and a measured direction quantity (rate of change over time of direction of travel of the watercraft 101 relative to ground), as shown schematically at 126, 216, 218, 219, 220, 221, 227, to reduce the heading difference,
4. an estimated non-steering influence on movement of the watercraft 101 (as shown schematically at 198, 200, 226, and 227), and
5. a direction difference 223 between
   a. a measured direction quantity (the rate of change over time of the filtered estimate of direction of travel of the watercraft 101 relative to ground, as shown schematically at 217) related to the direction of travel of the watercraft 101, and
   b. a desired direction quantity (the target or desired rate of change over time of the direction of travel of the watercraft 101 relative to ground, as shown schematically at 207) related to the direction of travel of the watercraft 101, the desired direction quantity identified according to, at least, the steering-input position of the helm 120 and the association 206 to reduce the direction difference (as shown schematically at 120, 206, 207, 222, 223, 224, 225, 226, and 227).

Steering Control Without Using Geopositioning Device

The examples of FIGS. 24 and 25 involve input from the geopositioning device 127, but alternative embodiments may differ.

For example, the example of FIG. 26 includes an association 228 that may associate different amounts and directions of rotation of the helm 120 from the central steering position with different steering angles of the engine-thrust direction 106. A steering angle (as shown schematically at 229) may be identified as the steering angle associated with a current steering-input position of the helm 120 according to the association 228, and the steering angle 229 may then be modified (as shown schematically at 230) by any change 200 to the steering angle of the engine-thrust direction 106 to produce one or more signals 231 for the steering control unit 115 to control the steering actuator 111 to implement the steering position 229 and any identified change 200.

Because the example of FIG. 26 involves modifying (as shown schematically at 230) the steering angle 229 by any change 200 to the steering angle of the engine-thrust direction 106, the the steering angle 229 (identified as the steering angle associated with a current steering-input position of the helm 120 according to the association 228) may be modified to reflect any estimated non-steering influence on movement of the watercraft 101.

In other words, in the example of FIG. 26, the steering actuator 111 is controlled in response to, at least, a steering-input position of the helm 120 (as shown schematically at 120, 228, 229, 230, and 231) and an estimated non-steering influence on movement of the watercraft 101 (as shown schematically at 198, 200, 230, and 231).

Example

In general, the examples of FIGS. 24-26 may be implemented by program codes stored in the program-codes store 133 such that execution of such program codes by the CPU 130 causes the processor circuit 129 to implement processes according to such examples.

Figure 27:
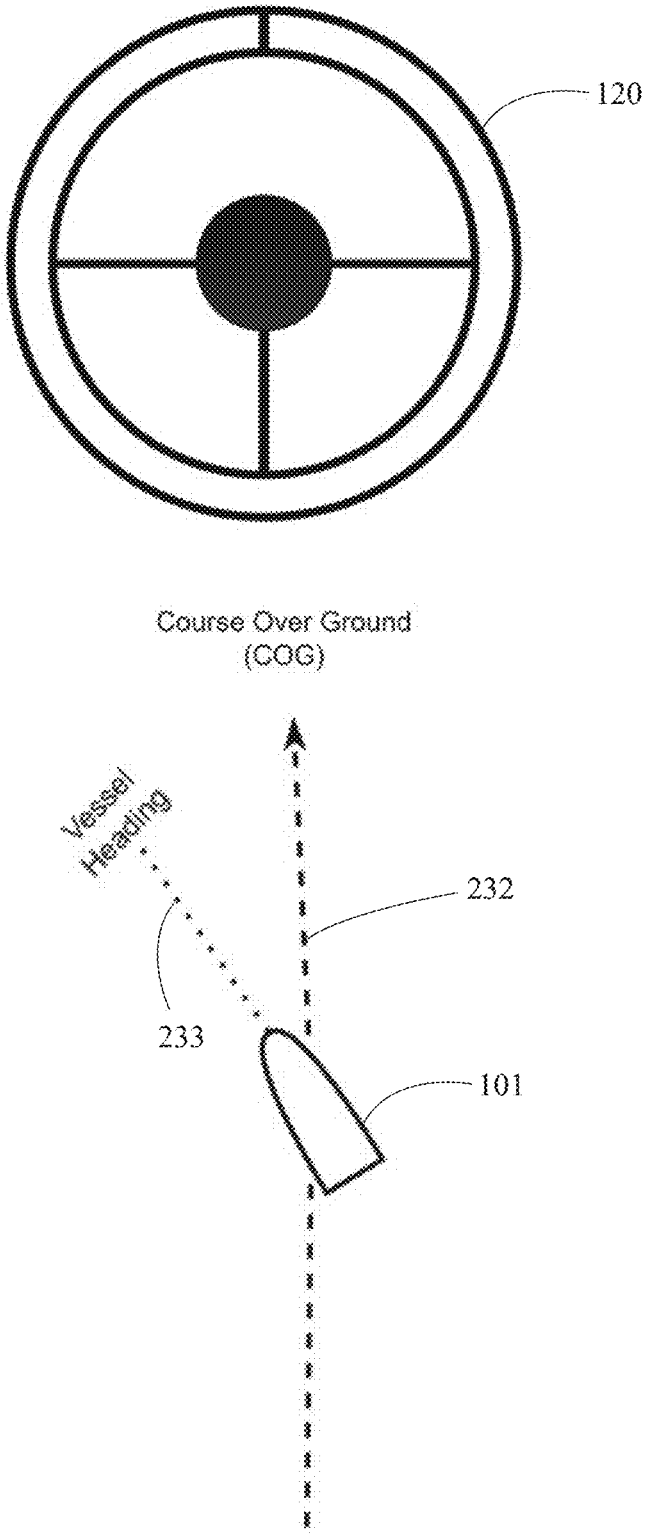
FIGS. 27-29 illustrate an example of steering control according to the example of FIG. 25.
Figure 28:
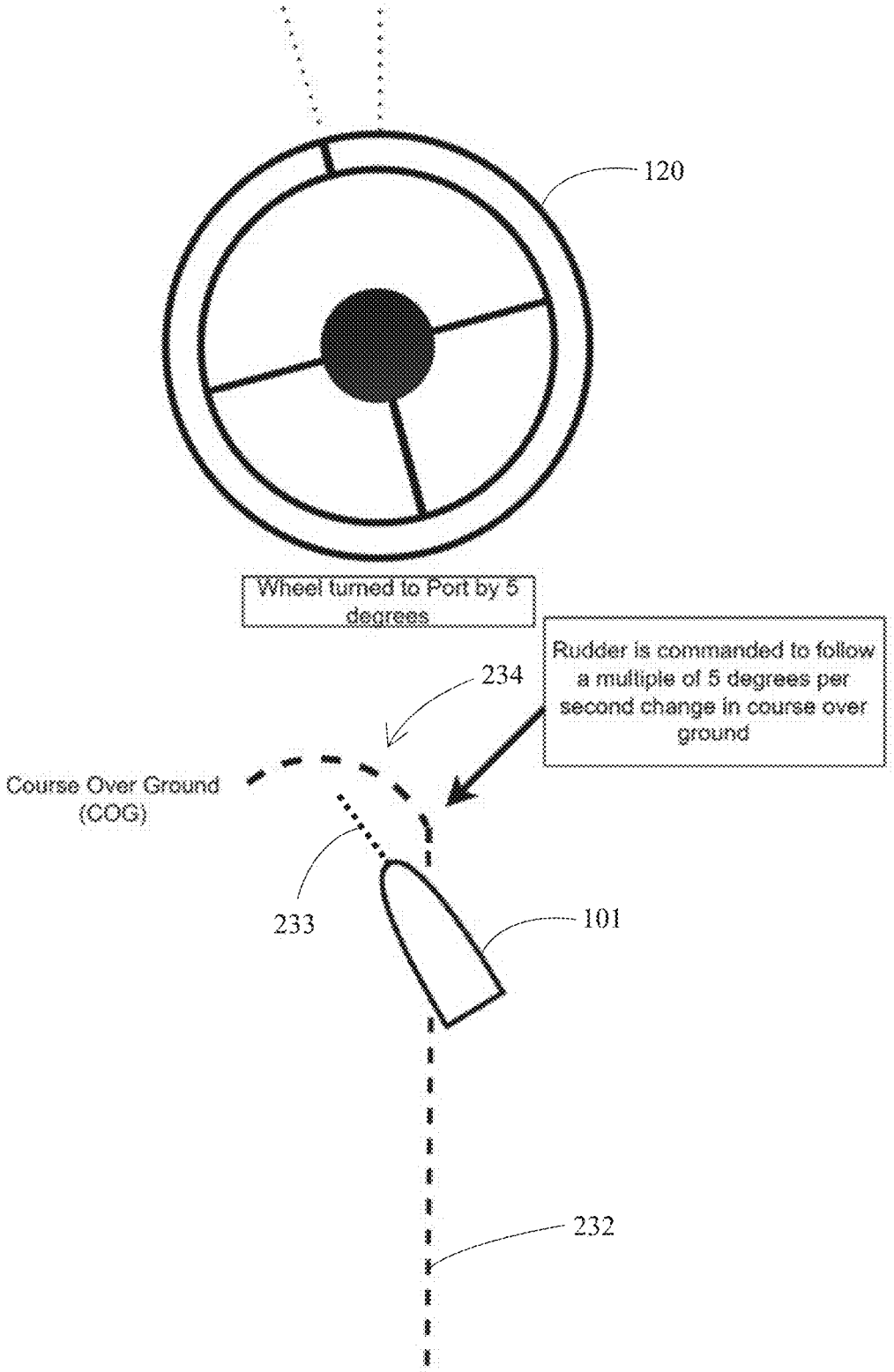
Figure 29:
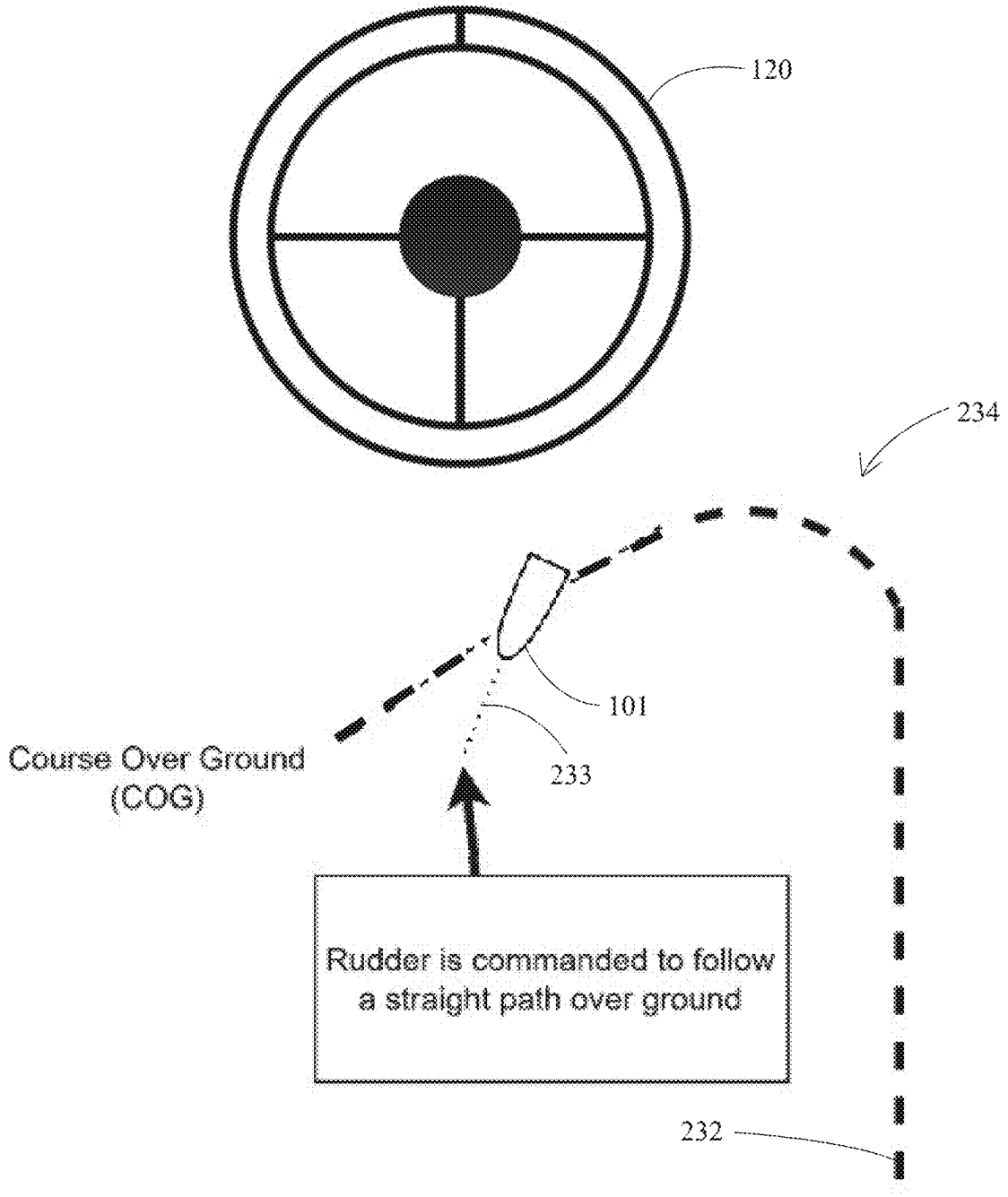

FIGS. 27-29 illustrate an example, according to the example of FIG. 25, in which the watercraft 101 follows a course over ground (COG) 232 while having a heading (for example relative to magnetic north or some other stationary or moving reference direction) 233.

In the example of FIG. 25, steering-input positions of the helm 120 are associated with respective rates of change over time of direction of travel of the watercraft 101 relative to ground according to the association 206. Therefore, 1. as shown in FIG. 27, when the helm 120 is at the central steering position, the COG 232 is a straight line regardless of the heading 233,
2. as shown in FIG. 28, when the helm 120 is turned to port, the COG 232 curves (as shown generally at 234) such that a direction of the COG 232 changes at a rate of time associated with the amount and direction of rotation of the helm 120 as shown in FIG. 27 and regardless of the heading 233, and
3. as shown in FIG. 29, after the curve 234 of FIG. 27, the helm 120 is returned to the central steering position, so after the curve 234, the COG 232 returns to a straight line, regardless of the heading 233.

Also, in the example of FIGS. 27-29, the feed-forward controllers 204 and 220 identify changes 205 and 221 to the steering angle of the engine-thrust direction 106 to compensate for any difference (at 202 and 203, or at 218 and 219) between the measured heading (or rate of change over time of the heading) of the watercraft 101 and the filtered estimate of direction (or rate of change over time of the direction) of travel of the watercraft 101 relative to ground, which may facilitate maintaining a direction of course over ground without any undesired influence from a heading (or rate of change over time of the heading) of the watercraft 101.

Summary

Although specific embodiments have been described and illustrated, such embodiments should be considered illustrative only and not as limiting the invention.

Further Examples

This disclosure also includes the following non-limiting examples, which include examples of embodiments described and illustrated herein.

1. A method of controlling movement, relative to a watercraft, of at least one steering device on the watercraft in response to movement of a steering input relative to the watercraft, the method comprising:

controlling a target association, between steering-input positions of the steering input relative to the watercraft and respective steering positions of the at least one steering device relative to the watercraft, in response to at least uncoordinated movement comprising previous movement of the steering input relative to the watercraft uncoordinated with any movement of the at least one steering device relative to the watercraft, previous movement of the at least one steering device relative to the watercraft uncoordinated with any movement of the steering input relative to the watercraft, or both.

2. The method of example 1, wherein the uncoordinated movement comprises previous movement of the steering input relative to the watercraft uncoordinated with any movement of the at least one steering device relative to the watercraft.

3. The method of example 2, wherein the previous movement of the steering input uncoordinated with any movement of the at least one steering device comprises previous movement of the steering input relative to the watercraft when the steering input is in a mode in which movement of the steering input relative to the watercraft does not control movement of the at least one steering device relative to the watercraft.

4. The method of example 3, wherein the mode in which movement of the steering input relative to the watercraft does not control movement of the at least one steering device relative to the watercraft comprises a mode in which the steering input is powered off.

5. The method of example 2, 3, or 4, wherein the previous movement of the steering input uncoordinated with any movement of the at least one steering device comprises previous movement of the steering input relative to the watercraft beyond a steering-input position associated with an end of a steering range of the at least one steering device.

6. The method of example 5, wherein the end of the steering range is an end of possible motion of the at least one steering device relative to the watercraft.

7. The method of example 5, wherein the end of the steering range is configured.

8. The method of any one of examples 1 to 7, wherein the uncoordinated movement comprises previous movement of the at least one steering device relative to the watercraft uncoordinated with any movement of the steering input relative to the watercraft.

9. The method of example 8, wherein the previous movement of the at least one steering device uncoordinated with any movement of the steering input comprises previous movement of the at least one steering device, relative to the watercraft, caused by another steering input.

10. The method of example 8, wherein the previous movement of the at least one steering device uncoordinated with any movement of the steering input comprises previous movement of the at least one steering device, relative to the watercraft, caused by a device independent from the steering input.

11. The method of any one of examples 1 to 10, wherein the steering input is rotatable relative to the watercraft entirely around an axis of rotation.

12. The method of examples 1 to 11, wherein the target association has a predefined ratio of amounts of change of steering angle relative to the watercraft to amounts of change of steering-input positions of the steering input relative to the watercraft.

13. The method of any one of examples 1 to 11, wherein the target association has a ratio, modified from a predefined ratio, of amounts of change of steering angle relative to the watercraft to amounts of change of steering-input positions of the steering input relative to the watercraft.

14. The method of example 13, wherein the ratio is modified according to at least a rate of movement over time of the steering input relative to the watercraft.

15. The method of example 12, 13, or 14, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and controlling the target association comprises causing the target association to comprise the reference association, for at least some time, in response to the steering input reaching a steering-input position relative to the watercraft when the at least one steering device reaches a steering position relative to the watercraft associated with the steering-input position according to the reference association.

16. The method of example 11, further comprising:

identifying at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation; and selecting a selected one of the at least two possible target associations;

wherein controlling the target association comprises causing the target association to be, for at least some time, the selected one of the at least two possible target associations.

17. A method of controlling movement, relative to a watercraft, of at least one steering device on the watercraft in response to movement of a steering input relative to the watercraft, the steering input rotatable relative to the watercraft entirely around an axis of rotation, the method comprising:

identifying at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation;

selecting a selected one of the at least two possible target associations; and controlling a target association, between steering-input positions of the steering input relative to the watercraft and respective steering positions of the at least one steering device relative to the watercraft, wherein controlling the target association comprises causing the target association to be, for at least some time, the selected one of the at least two possible target associations.

18. The method of example 16 or 17, wherein at least one possible target association of the at least two possible target associations comprises a linear association between steering-input positions of the steering input relative to the watercraft and respective steering positions of the at least one steering device relative to the watercraft.

19. The method of example 16, 17, or 18, wherein at least one possible target association of the at least two possible target associations comprises a non-linear association between steering-input positions of the steering input relative to the watercraft and respective steering positions of the at least one steering device relative to the watercraft.

20. The method of example 16, 17, 18, or 19, wherein selecting the selected one of the at least two possible target associations comprises selecting, as the selected one of the at least two possible target associations, one of the at least two possible target associations closest to a reference association between steering-input positions of the steering input relative to the watercraft and respective steering positions of the at least one steering device relative to the watercraft.

21. The method of example 20, wherein the reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft.

22. The method of example 20 or 21, wherein the reference association associates steering-input positions of the steering input relative to the watercraft with respective steering positions of the at least one steering device relative to the watercraft such that rotation of the steering input relative to the watercraft around the axis of rotation, by a required amount of rotation associated with the reference association, causes the steering input to reach the reference steering-input position relative to the watercraft and is associated with causing the at least one steering device to reach the reference steering position relative to the watercraft when the steering input reaches the reference steering-input position relative to the watercraft.

23. The method of example 16, 17, 18, or 19, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and the reference association associates steering-input positions of the steering input relative to the watercraft with respective steering positions of the at least one steering device relative to the watercraft such that rotation of the steering input relative to the watercraft around the axis of rotation, by a required amount of rotation associated with the reference association, causes the steering input to reach the reference steering-input position relative to the watercraft and is associated with causing the at least one steering device to reach the reference steering position relative to the watercraft when the steering input reaches the reference steering-input position relative to the watercraft.

24. The method of example 22 or 23, wherein the required amount of rotation associated with the reference association and the required amount of rotation associated with at least one possible target association of the at least two possible target associations differ by at least one complete rotation of the steering input relative to the watercraft around the axis of rotation.

25. The method of example 22 or 23, wherein the required amount of rotation associated with the reference association and the required amount of rotation associated with the selected one of the at least two possible target associations differ by at least one complete rotation of the steering input relative to the watercraft around the axis of rotation.

26. The method of any one of examples 20 to 25, wherein controlling the target association comprises causing the target association to comprise the reference association, for at least some time, in response to the steering input reaching the reference steering-input position relative to the watercraft.

27. The method of any one of examples 20 to 26, wherein the at least two possible target associations comprise at least one possible target association having a predefined ratio of amounts of change of steering angle relative to the watercraft to amounts of change of steering-input positions of the steering input relative to the watercraft.

28. The method of any one of examples 20 to 26, wherein each target association of the at least two possible target associations has a respective different predefined ratio of amounts of change of steering angle relative to the watercraft to amounts of change of steering-input positions of the steering input relative to the watercraft.

29. The method of any one of examples 20 to 27, wherein the at least two possible target associations comprise at least one possible target association having a ratio, modified from a predefined ratio, of amounts of change of steering angle relative to the watercraft to amounts of change of steering-input positions of the steering input relative to the watercraft.

30. The method of example 29, wherein the ratio is modified according to at least a rate of movement over time of the steering input relative to the watercraft.

31. The method of any one of examples 20 to 26, wherein each target association of the at least two possible target associations has a respective different ratio, modified from a respective different predefined ratio, of amounts of change of steering angle relative to the watercraft to amounts of change of steering-input positions of the steering input relative to the watercraft.

32. The method of example 31, wherein each respective ratio of the at least two possible target associations is modified according to at least a rate of movement over time of the steering input relative to the watercraft.

33. The method of any one of examples 1 to 11, wherein the target association associates steering-input positions of the steering input relative to the watercraft with respective steering positions of the at least one steering device relative to the watercraft such that movement of the steering input relative to the watercraft, by a required amount of movement associated with the target association, causes the steering input to reach a reference steering-input position relative to the watercraft and is associated with causing the at least one steering device to reach a reference steering position relative to the watercraft when the steering input reaches the reference steering-input position relative to the watercraft.

34. The method of example 33, wherein the required amount of movement associated with the target association comprises movement of the steering input relative to the watercraft past the reference steering-input position at least once.

35. The method of example 33 or 34, when directly or indirectly dependent from example 11, wherein the required amount of movement associated with the target association comprises more than one complete rotation of the steering input relative to the watercraft around the axis of rotation.

36. The method of example 33, 34, or 35, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and controlling the target association comprises causing the target association to comprise the reference association, for at least some time, in response to the steering input reaching the reference steering-input position relative to the watercraft.

37. The method of any one of examples 16 to 32, wherein the target association associates steering-input positions of the steering input relative to the watercraft with respective steering positions of the at least one steering device relative to the watercraft such that rotation of the steering input relative to the watercraft around the axis of rotation, by a required amount of rotation associated with the target association, causes the steering input to reach the reference steering-input position relative to the watercraft and is associated with causing the at least one steering device to reach the reference steering position relative to the watercraft when the steering input reaches the reference steering-input position relative to the watercraft.

38. The method of example 37, wherein the required amount of rotation associated with the target association comprises movement of the steering input relative to the watercraft past the reference steering-input position at least once.

39. The method of example 37 or 38, wherein the required amount of rotation associated with the target association comprises more than one complete rotation of the steering input relative to the watercraft around the axis of rotation.

40. The method of any one of examples 20 to 32, of example 36, or of example 37, 38, or 39 when directly or indirectly dependent from example 20 or 23, wherein the reference association comprises a linear association between steering-input positions of the steering input relative to the watercraft and respective steering positions of the at least one steering device relative to the watercraft.

41. The method of any one of examples 20 to 32, of example 36, of example 37, 38, or 39 when directly or indirectly dependent from example 20 or 23, or of example 40, wherein the reference association comprises a non-linear association between steering-input positions of the steering input relative to the watercraft and respective steering positions of the at least one steering device relative to the watercraft.

42. The method of any one of examples 20 to 32 or 36 to 41, when directly or indirectly dependent from example 1, wherein the uncoordinated movement comprises previous movement of the steering input relative to the watercraft to a steering-input position different from a steering-input position associated, according to the reference association, with a steering position of the at least one steering device.

43. The method of any one of examples 20 to 32 or 36 to 41, when directly or indirectly dependent from example 1, or of example 42, wherein the uncoordinated movement comprises previous movement of the at least one steering device relative to the watercraft to a steering position different from a steering position associated, according to the reference association, with a steering-input position of the steering input.

44. The method of any one of examples 16 to 43, wherein the reference steering position is a central steering position of the at least one steering device relative to the watercraft.

45. The method of any one of examples 16 to 44, wherein the reference steering-input position is a central steering position of the steering input relative to the watercraft.

46. The method of any one of examples 1 to 45, wherein the target association comprises a linear association between steering-input positions of the steering input relative to the watercraft and respective steering positions of the at least one steering device relative to the watercraft.

47. The method of any one of examples 1 to 46, wherein the target association comprises a non-linear association between steering-input positions of the steering input relative to the watercraft and respective steering positions of the at least one steering device relative to the watercraft.

48. The method of any one of examples 1 to 47, further comprising controlling the at least one steering device according to at least the target association.

49. The method of any one of examples 1 to 47, further comprising controlling the at least one steering device according to the target association and according to movement of the steering input relative to the watercraft.

50. The method of any one of examples 1 to 49, wherein controlling the target association comprises modifying the target association in response to a change of direction of movement of the steering input relative to the watercraft.

51. The method of any one of examples 1 to 50, further comprising causing the at least one steering device to move in response to, at least:

a steering-input position of the steering input relative to the watercraft; and an estimated non-steering influence on movement of the watercraft.

52. A method of controlling movement, relative to a watercraft, of at least one steering device on the watercraft, the method comprising:

causing the at least one steering device to move relative to the watercraft in response to, at least:

a steering-input position of a steering input relative to the watercraft; and an estimated non-steering influence on movement of the watercraft.

53. The method of example 51 or 52, wherein the estimated non-steering influence on movement of the watercraft comprises an estimated non-steering influence on a direction of movement of the watercraft.

54. The method of example 51 or 52, wherein the estimated non-steering influence on movement of the watercraft comprises an estimated non-steering influence on a rate of change over time of a direction of movement of the watercraft.

55. The method of example 53 or 54, wherein the direction of movement of the watercraft is a direction of movement of the watercraft relative to ground.

56. The method of any one of examples 51 to 55, further comprising estimating the estimated non-steering influence on movement of the watercraft.

57. The method of example 56, wherein estimating the estimated non-steering influence on movement of the watercraft comprises estimating the estimated non-steering influence on movement of the watercraft in response to at least an estimation of a mass of the watercraft.

58. The method of example 56 or 57, wherein estimating the estimated non-steering influence on movement of the watercraft comprises estimating the estimated non-steering influence on movement of the watercraft in response to at least an estimation of a fluid resistance of the watercraft.

59. The method of example 56, 57, or 58, wherein estimating the estimated non-steering influence on movement of the watercraft comprises estimating the estimated non-steering influence on movement of the watercraft in response to at least an estimation of speed of the watercraft relative to surrounding water.

60. The method of example 56, 57, 58, or 59, wherein estimating the estimated non-steering influence on movement of the watercraft comprises estimating the estimated non-steering influence on movement of the watercraft in response to at least an estimation of engine thrust force on the watercraft.

61. The method of any one of examples 56 to 60, wherein estimating the estimated non-steering influence on movement of the watercraft comprises estimating the estimated non-steering influence on movement of the watercraft in response to at least estimated positions of trim tabs of the watercraft.

62. The method of any one of examples 56 to 61, wherein estimating the estimated non-steering influence on the movement of the watercraft comprises estimating the estimated non-steering influence on the movement of the watercraft in response to at least a ballast configuration of a ballast system of the watercraft.

63. The method of any one of examples 1 to 50, further comprising causing the at least one steering device to move in response to, at least:

a steering-input position of the steering input relative to the watercraft; and an association between steering-input positions of the steering input relative to the watercraft and respective target quantities related to direction of the watercraft.

64. The method of any one of examples 51 to 62, further comprising causing the at least one steering device to move in response to, at least:

the steering-input position of the steering input relative to the watercraft; and an association between steering-input positions of the steering input relative to the watercraft and respective target quantities related to direction of the watercraft.

65. A method of controlling movement, relative to a watercraft, of at least one steering device on the watercraft, the method comprising:

causing the at least one steering device to move in response to, at least:

a steering-input position of a steering input relative to the watercraft; and an association between steering-input positions of the steering input relative to the watercraft and respective target quantities related to direction of the watercraft.

66. The method of example 63, 64, or 65, wherein causing the at least one steering device to move comprises causing the at least one steering device to move in response to, at least, a direction difference between:

a measured direction quantity related to the direction of travel of the watercraft; and a desired direction quantity related to the direction of travel of the watercraft.

67. The method of example 66, further comprising identifying the desired direction quantity according to, at least:

the steering-input position of the steering input; and the association between steering-input positions of the steering input relative to the watercraft and respective target quantities.

68. The method of example 66 or 67, wherein causing the at least one steering device to move in response to at least the direction difference comprises causing the at least one steering device to move to reduce the direction difference.

69. The method of example 66, 67, or 68, wherein the measured direction quantity is measured by at least a geopositioning system.

70. The method of example 66, 67, or 68, wherein the measured direction quantity is measured by at least a global positioning system (GPS).

71. The method of example 66, 67, or 68, further comprising identifying the measured direction quantity from at least one signal from at least a geopositioning system.

72. The method of example 66, 67, or 68, further comprising identifying the measured direction quantity from at least one signal from a GPS.

73. The method of any one of examples 63 to 72, wherein the target, measured, and desired quantities are respective directions of travel of the watercraft.

74. The method of any one of examples 63 to 72, wherein the target, measured, and desired quantities are respective rates of change over time of the direction of travel of the watercraft.

75. The method of any one of examples 63 to 74, wherein the directions of travel of the watercraft are directions of travel of the watercraft relative to ground.

76. The method of example 63, 64, or 65, wherein the target quantities are respective rates of change over time of heading of the watercraft.

77. The method of any one of examples 63 to 76, wherein the association between steering-input positions of the steering input relative to the watercraft and respective target quantities comprises a linear association the association between steering-input positions of the steering input relative to the watercraft and respective target quantities.

78. The method of any one of examples 63 to 77, wherein the association between steering-input positions of the steering input relative to the watercraft and respective target quantities comprises a non-linear the association between steering-input positions of the steering input relative to the watercraft and respective target quantities.

79. The method of any one of examples 1 to 78, further comprising causing the at least one steering device to move in response to, at least, a heading difference between:

a measured heading quantity related to a heading of the watercraft; and a measured direction quantity related to a direction of travel of the watercraft.

80. A method of controlling movement, relative to a watercraft, of at least one steering device on the watercraft, the method comprising:

causing the at least one steering device to move in response to, at least, a heading difference between:

a measured heading quantity related to a heading of the watercraft; and a measured direction quantity related to a direction of travel of the watercraft.

81. The method of examples 79 or 80, wherein the measured heading quantity is a measured heading of the watercraft, and the measured direction quantity is a measured direction of travel of the watercraft.

82. The method of examples 79 or 80, wherein the measured heading quantity is a measured rate of change over time of heading of the watercraft, and the measured direction quantity is a measured rate of change over time of direction of travel of the watercraft.

83. The method of examples 79, 80, 81, or 82, wherein causing the at least one steering device to move in response to at least the heading difference comprises causing the at least one steering device to move to reduce the heading difference.

84. The method of any one of examples 79 to 83, wherein the direction of travel of the watercraft is a direction of travel of the watercraft relative to ground.

85. The method of any one of examples 79 to 84, wherein the measured direction quantity is measured by at least a geopositioning system.

86. The method of any one of examples 79 to 84, wherein the measured direction quantity is measured by at least a GPS.

87. The method of any one of examples 79 to 84, further comprising identifying the measured direction quantity from at least one signal from at least a geopositioning system.

88. The method of any one of examples 79 to 84, further comprising identifying the measured direction quantity from at least one signal from a GPS.

89. The method of any one of examples 79 to 88, wherein the measured heading quantity is measured by at least a magnetic compass.

90. The method of any one of examples 79 to 88, wherein the measured heading quantity is measured by at least a gyroscope.

91. The method of any one of examples 79 to 88, further comprising identifying the measured heading quantity from at least one signal from at least a magnetic compass.

92. The method of any one of examples 79 to 88, further comprising identifying the measured heading quantity from at least one signal from at least a gyroscope.

93. The method of any one of examples 1 to 92, wherein the at least one steering device comprises at least one steering actuator operable to steer the watercraft.

94. The method of example 93, wherein the at least one steering actuator is coupled to at least one engine on the watercraft and operable to change a steering angle of the at least one engine relative to the watercraft to steer the watercraft in response to movement of the at least one steering actuator relative to the watercraft.

95. The method of example 93 or 94, wherein the at least one steering actuator is coupled to at least one rudder on the watercraft and operable to change a steering angle of the at least one rudder relative to the watercraft to steer the watercraft in response to movement of the at least one steering actuator relative to the watercraft.

96. The method of any one of examples 1 to 95, wherein the steering input comprises an electronic helm on the watercraft.

97. An apparatus for controlling movement, relative to a watercraft, of at least one steering device on the watercraft in response to movement of a steering input relative to the watercraft, the apparatus comprising:

at least one controller configured to, at least, control a target association, between steering-input positions of the steering input relative to the watercraft and respective steering positions of the at least one steering device relative to the watercraft, in response to at least uncoordinated movement comprising previous movement of the steering input relative to the watercraft uncoordinated with any movement of the at least one steering device relative to the watercraft, previous movement of the at least one steering device relative to the watercraft uncoordinated with any movement of the steering input relative to the watercraft, or both.

98. The apparatus of example 97, wherein the steering input is rotatable relative to the watercraft entirely around an axis of rotation.

99. The apparatus of example 97 or 98, wherein the target association has a predefined ratio of amounts of change of steering angle relative to the watercraft to amounts of change of steering-input positions of the steering input relative to the watercraft.

100. The apparatus of example 97, 98, or 99, wherein the target association has a ratio, modified by the at least one controller from a predefined ratio, of amounts of change of steering angle relative to the watercraft to amounts of change of steering-input positions of the steering input relative to the watercraft.

101. The apparatus of example 100, wherein the ratio is modified by the at least one controller according to at least a rate of movement over time of the steering input relative to the watercraft.

102. The apparatus of example 99, 100, or 101, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and the at least one controller is configured to control the target association by, at least, causing the target association to comprise the reference association, for at least some time, in response to the steering input reaching a steering-input position relative to the watercraft when the at least one steering device reaches a steering position relative to the watercraft associated with the steering-input position according to the reference association.

103. The apparatus of example 98, wherein the at least one controller is further configured to, at least:

identify at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation; and select a selected one of the at least two possible target associations;

wherein the at least one controller is configured to control the target association by, at least, causing the target association to be, for at least some time, the selected one of the at least two possible target associations.

104. An apparatus for controlling movement, relative to a watercraft, of at least one steering device on the watercraft in response to movement of a steering input relative to the watercraft, the steering input rotatable relative to the watercraft entirely around an axis of rotation, the apparatus comprising:

at least one controller configured to, at least:

identify at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation;

select a selected one of the at least two possible target associations; and control a target association, between steering-input positions of the steering input relative to the watercraft and respective steering positions of the at least one steering device relative to the watercraft, wherein controlling the target association comprises causing the target association to be, for at least some time, the selected one of the at least two possible target associations.

105. The apparatus of example 103 or 104, wherein at least one possible target association of the at least two possible target associations comprises a linear association between steering-input positions of the steering input relative to the watercraft and respective steering positions of the at least one steering device relative to the watercraft.

106. The apparatus of example 103, 104, or 105, wherein at least one possible target association of the at least two possible target associations comprises a non-linear association between steering-input positions of the steering input relative to the watercraft and respective steering positions of the at least one steering device relative to the watercraft.

107. The apparatus of example 103, 104, 105, or 106, wherein the at least one controller is configured to select the selected one of the at least two possible target associations by, at least, selecting, as the selected one of the at least two possible target associations, one of the at least two possible target associations closest to a reference association between steering-input positions of the steering input relative to the watercraft and respective steering positions of the at least one steering device relative to the watercraft.

108. The apparatus of example 107, wherein the reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft.

109. The apparatus of example 107 or 108, wherein the reference association associates steering-input positions of the steering input relative to the watercraft with respective steering positions of the at least one steering device relative to the watercraft such that rotation of the steering input relative to the watercraft around the axis of rotation, by a required amount of rotation associated with the reference association, causes the steering input to reach the reference steering-input position relative to the watercraft and is associated with causing the at least one steering device to reach the reference steering position relative to the watercraft when the steering input reaches the reference steering-input position relative to the watercraft.

110. The apparatus of example 103, 104, 105, or 106, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and the reference association associates steering-input positions of the steering input relative to the watercraft with respective steering positions of the at least one steering device relative to the watercraft such that rotation of the steering input relative to the watercraft around the axis of rotation, by a required amount of rotation associated with the reference association, causes the steering input to reach the reference steering-input position relative to the watercraft and is associated with causing the at least one steering device to reach the reference steering position relative to the watercraft when the steering input reaches the reference steering-input position relative to the watercraft.

111. The apparatus of example 109 or 110, wherein the required amount of rotation associated with the reference association and the required amount of rotation associated with at least one possible target association of the at least two possible target associations differ by at least one complete rotation of the steering input relative to the watercraft around the axis of rotation.

112. The apparatus of example 109 or 110, wherein the required amount of rotation associated with the reference association and the required amount of rotation associated with the selected one of the at least two possible target associations differ by at least one complete rotation of the steering input relative to the watercraft around the axis of rotation.

113. The apparatus of any one of examples 107 to 112, wherein the at least one controller is configured to control the target association by, at least, causing the target association to comprise the reference association, for at least some time, in response to the steering input reaching the reference steering-input position relative to the watercraft.

114. The apparatus of any one of examples 107 to 113, wherein the at least two possible target associations comprise at least one possible target association having a predefined ratio of amounts of change of steering angle relative to the watercraft to amounts of change of steering-input positions of the steering input relative to the watercraft.

115. The apparatus of any one of examples 107 to 113, wherein each target association of the at least two possible target associations has a respective different predefined ratio of amounts of change of steering angle relative to the watercraft to amounts of change of steering-input positions of the steering input relative to the watercraft.

116. The apparatus of any one of examples 107 to 114, wherein the at least two possible target associations comprise at least one possible target association having a ratio, modified from a predefined ratio, of amounts of change of steering angle relative to the watercraft to amounts of change of steering-input positions of the steering input relative to the watercraft.

117. The apparatus of example 116, wherein the ratio is modified according to at least a rate of movement over time of the steering input relative to the watercraft.

118. The apparatus of any one of examples 107 to 113, wherein each target association of the at least two possible target associations has a respective different ratio, modified from a respective different predefined ratio, of amounts of change of steering angle relative to the watercraft to amounts of change of steering-input positions of the steering input relative to the watercraft.

119. The apparatus of example 118, wherein each respective ratio of the at least two possible target associations is modified according to at least a rate of movement over time of the steering input relative to the watercraft.

120. The apparatus of example 97 or 98, wherein the target association associates steering-input positions of the steering input relative to the watercraft with respective steering positions of the at least one steering device relative to the watercraft such that movement of the steering input relative to the watercraft, by a required amount of movement associated with the target association, causes the steering input to reach a reference steering-input position relative to the watercraft and is associated with causing the at least one steering device to reach a reference steering position relative to the watercraft when the steering input reaches the reference steering-input position relative to the watercraft.

121. The apparatus of example 120, wherein the required amount of movement associated with the target association comprises movement of the steering input relative to the watercraft past the reference steering-input position at least once.

122. The apparatus of example 120 or 121, when directly or indirectly dependent from example 98, wherein the required amount of movement associated with the target association comprises more than one complete rotation of the steering input relative to the watercraft around the axis of rotation.

123. The apparatus of example 120, 121, or 122, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and the at least one controller is configured to control the target association by, at least, causing the target association to comprise the reference association, for at least some time, in response to the steering input reaching the reference steering-input position relative to the watercraft.

124. The apparatus of any one of examples 103 to 119, wherein the target association associates steering-input positions of the steering input relative to the watercraft with respective steering positions of the at least one steering device relative to the watercraft such that rotation of the steering input relative to the watercraft around the axis of rotation, by a required amount of rotation associated with the target association, causes the steering input to reach the reference steering-input position relative to the watercraft and is associated with causing the at least one steering device to reach the reference steering position relative to the watercraft when the steering input reaches the reference steering-input position relative to the watercraft.

125. The apparatus of example 124, wherein the required amount of rotation associated with the target association comprises movement of the steering input relative to the watercraft past the reference steering-input position at least once.

126. The apparatus of example 124 or 125, wherein the required amount of rotation associated with the target association comprises more than one complete rotation of the steering input relative to the watercraft around the axis of rotation.

127. The apparatus of any one of examples 107 to 119, of example 123, or of example 124, 125, or 126, when directly or indirectly dependent from example 107 or 110, wherein the reference association comprises a linear association between steering-input positions of the steering input relative to the watercraft and respective steering positions of the at least one steering device relative to the watercraft.

128. The apparatus of any one of examples 107 to 119, of example 123, of example 124, 125, or 126, when directly or indirectly dependent from example 107 or 110, or of example 127, wherein the reference association comprises a non-linear association between steering-input positions of the steering input relative to the watercraft and respective steering positions of the at least one steering device relative to the watercraft.

129. The apparatus of any one of examples 107 to 119 or 123 to 128, when directly or indirectly dependent from example 97, wherein the uncoordinated movement comprises previous movement of the steering input relative to the watercraft to a steering-input position different from a steering-input position associated, according to the reference association, with a steering position of the at least one steering device.

130. The apparatus of any one of examples 107 to 119 or 123 to 128, when directly or indirectly dependent from example 97, or of example 129, wherein the uncoordinated movement comprises previous movement of the at least one steering device relative to the watercraft to a steering position different from a steering position associated, according to the reference association, with a steering-input position of the steering input.

131. The apparatus of any one of examples 103 to 130, wherein the reference steering position is a central steering position of the at least one steering device relative to the watercraft.

132. The apparatus of any one of examples 103 to 131, wherein the reference steering-input position is a central steering position of the steering input relative to the watercraft.

133. The apparatus of any one of examples 97 to 132, wherein the target association comprises a linear association between steering-input positions of the steering input relative to the watercraft and respective steering positions of the at least one steering device relative to the watercraft.

134. The apparatus of any one of examples 97 to 133, wherein the target association comprises a non-linear association between steering-input positions of the steering input relative to the watercraft and respective steering positions of the at least one steering device relative to the watercraft.

135. The apparatus of any one of examples 97 to 134, wherein the at least one controller is further configured to, at least, control the at least one steering device according to at least the target association.

136. The apparatus of any one of examples 97 to 134, wherein the at least one controller is further configured to, at least, control the at least one steering device according to the target association and according to movement of the steering input relative to the watercraft.

137. The apparatus of any one of examples 97 to 136, wherein the at least one controller is configured to control the target association by, at least, modifying the target association in response to a change of direction of movement of the steering input relative to the watercraft.

138. The apparatus of any one of examples 97 to 137, wherein the at least one controller is further configured to, at least, cause the at least one steering device to move in response to, at least:

a steering-input position of the steering input relative to the watercraft; and an estimated non-steering influence on movement of the watercraft.

139. An apparatus for controlling movement, relative to a watercraft, of at least one steering device on the watercraft, the apparatus comprising:

at least one controller configured to, at least, cause the at least one steering device to move relative to the watercraft in response to, at least:

a steering-input position of a steering input relative to the watercraft; and an estimated non-steering influence on movement of the watercraft.

140. The apparatus of example 138 or 139, wherein the estimated non-steering influence on movement of the watercraft comprises an estimated non-steering influence on a direction of movement of the watercraft.

141. The apparatus of example 138 or 139, wherein the estimated non-steering influence on movement of the watercraft comprises an estimated non-steering influence on a rate of change over time of a direction of movement of the watercraft.

142. The apparatus of example 140 or 141, wherein the direction of movement of the watercraft is a direction of movement of the watercraft relative to ground.

143. The apparatus of any one of examples 138 to 142, wherein the at least one controller is further configured to, at least, estimate the estimated non-steering influence on movement of the watercraft.

144. The apparatus of example 143, wherein the at least one controller is configured to estimate the estimated non-steering influence on movement of the watercraft in response to at least an estimation of a mass of the watercraft.

145. The apparatus of example 143 or 144, wherein the at least one controller is configured to estimate the estimated non-steering influence on movement of the watercraft in response to at least an estimation of a fluid resistance of the watercraft.

146. The apparatus of example 143, 144, or 145, wherein the at least one controller is configured to estimate the estimated non-steering influence on movement of the watercraft in response to at least an estimation of speed of the watercraft relative to surrounding water.

147. The apparatus of example 143, 144, 145, or 146, wherein the at least one controller is configured to estimate the estimated non-steering influence on movement of the watercraft in response to at least an estimation of engine thrust force on the watercraft.

148. The apparatus of any one of examples 143 to 147, wherein the at least one controller is configured to estimate the estimated non-steering influence on movement of the watercraft in response to at least estimated positions of trim tabs of the watercraft.

149. The apparatus of any one of examples 143 to 148, wherein the at least one controller is configured to estimate the estimated non-steering influence on movement of the watercraft in response to at least a ballast configuration of a ballast system of the watercraft.

150. The apparatus of any one of examples 97 to 137, wherein the at least one controller is further configured to, at least, cause the at least one steering device to move in response to, at least:

a steering-input position of the steering input relative to the watercraft; and an association between steering-input positions of the steering input relative to the watercraft and respective target quantities related to direction of the watercraft.

151. The apparatus of any one of examples 138 to 149, wherein the at least one controller is further configured to, at least, cause the at least one steering device to move in response to, at least:

the steering-input position of the steering input relative to the watercraft; and an association between steering-input positions of the steering input relative to the watercraft and respective target quantities related to direction of the watercraft.

152. An apparatus for controlling movement, relative to a watercraft, of at least one steering device on the watercraft, the apparatus comprising:

at least one controller configured to, at least, cause the at least one steering device to move in response to, at least:

a steering-input position of a steering input relative to the watercraft; and an association between steering-input positions of the steering input relative to the watercraft and respective target quantities related to direction of the watercraft.

153. The apparatus of example 150, 151, or 152, wherein causing the at least one steering device to move comprises causing the at least one steering device to move in response to, at least, a direction difference between:

a measured direction quantity related to the direction of travel of the watercraft; and a desired direction quantity related to the direction of travel of the watercraft.

154. The apparatus of example 153, wherein the at least one controller is further configured to, at least, identify the desired direction quantity according to, at least:

the steering-input position of the steering input; and the association between steering-input positions of the steering input relative to the watercraft and respective target quantities.

155. The apparatus of example 153 or 154, wherein the at least one controller is configured to cause the at least one steering device to move in response to at least the direction difference comprises by, at least, causing the at least one steering device to move to reduce the direction difference.

156. The apparatus of example 153, 154, or 155, wherein the measured direction quantity is measured by at least a geopositioning system.

157. The apparatus of example 153, 154, or 155, wherein the measured direction quantity is measured by at least a GPS.

158. The apparatus of example 153, 154, or 155, wherein the at least one controller is further configured to, at least, identify the measured direction quantity from at least one signal from a geopositioning system.

159. The apparatus of example 153, 154, or 155, wherein the at least one controller is further configured to, at least, identify the measured direction quantity from at least one signal from a GPS.

160. The apparatus of any one of examples 150 to 159, wherein the target, measured, and desired quantities are respective directions of travel of the watercraft.

161. The apparatus of any one of examples 150 to 159, wherein the target, measured, and desired quantities are respective rates of change over time of the direction of travel of the watercraft.

162. The apparatus of any one of examples 150 to 161, wherein the directions of travel of the watercraft are directions of travel of the watercraft relative to ground.

163. The method of example 150, 151, or 152, wherein the target quantities are respective rates of change over time of heading of the watercraft.

164. The apparatus of any one of examples 150 to 163, wherein the association between steering-input positions of the steering input relative to the watercraft and respective target quantities comprises a linear association the association between steering-input positions of the steering input relative to the watercraft and respective target quantities.

165. The apparatus of any one of examples 150 to 164, wherein the association between steering-input positions of the steering input relative to the watercraft and respective target quantities comprises a non-linear the association between steering-input positions of the steering input relative to the watercraft and respective target quantities.

166. The apparatus of any one of examples 97 to 165, wherein the at least one controller is further configured to, at least, cause the at least one steering device to move in response to, at least, a heading difference between:

a measured heading quantity related to a heading of the watercraft; and a measured direction quantity related to a direction of travel of the watercraft.

167. An apparatus of controlling movement, relative to a watercraft, of at least one steering device on the watercraft, the apparatus comprising:

at least one controller configured to, at least, cause the at least one steering device to move in response to, at least, a heading difference between:

a measured heading quantity related to a heading of the watercraft; and a measured direction quantity related to a direction of travel of the watercraft.

168. The apparatus of examples 166 or 167, wherein the measured heading quantity is a measured heading of the watercraft, and the measured direction quantity is a measured direction of travel of the watercraft.

169. The apparatus of examples 166 or 167, wherein the measured heading quantity is a measured rate of change over time of heading of the watercraft, and the measured direction quantity is a measured rate of change over time of direction of travel of the watercraft.

170. The apparatus of examples 166, 167, 168, or 169, wherein the at least one controller is configured to cause the at least one steering device to move in response to at least the heading difference by, at least, causing the at least one steering device to move to reduce the heading difference.

171. The apparatus of any one of examples 166 to 170, wherein the direction of travel of the watercraft is a direction of travel of the watercraft relative to ground.

172. The apparatus of any one of examples 166 to 171, wherein the measured direction quantity is measured by at least a geopositioning system.

173. The apparatus of any one of examples 166 to 171, wherein the measured direction quantity is measured by at least a GPS.

174. The apparatus of any one of examples 166 to 171, wherein the at least one controller is further configured to, at least, identify the measured direction quantity from at least one signal from at least a geopositioning system.

175. The apparatus of any one of examples 166 to 171, wherein the at least one controller is further configured to, at least, identify the measured direction quantity from at least one signal from a GPS.

176. The apparatus of any one of examples 166 to 175, wherein the measured heading quantity is measured by at least a magnetic compass.

177. The apparatus of any one of examples 166 to 175, wherein the measured heading quantity is measured by at least a gyroscope.

178. The apparatus of any one of examples 166 to 175, wherein the at least one controller is further configured to, at least, identify the measured heading quantity from at least one signal from at least a magnetic compass.

179. The apparatus of any one of examples 166 to 175, wherein the at least one controller is further configured to, at least, identify the measured heading quantity from at least one signal from at least a gyroscope.

180. The apparatus of any one of examples 97 to 179, further comprising the at least one steering device.

181. The apparatus of example 180, wherein the at least one steering device comprises at least one steering actuator operable to steer the watercraft.

182. The apparatus of example 181, wherein the at least one steering actuator is coupled to at least one engine on the watercraft and operable to change a steering angle of the at least one engine relative to the watercraft to steer the watercraft in response to movement of the at least one steering actuator relative to the watercraft.

183. The apparatus of example 181 or 182, wherein the at least one steering actuator is coupled to at least one rudder on the watercraft and operable to change a steering angle of the at least one rudder relative to the watercraft to steer the watercraft in response to movement of the at least one steering actuator relative to the watercraft.

184. The apparatus of any one of examples 97 to 183, further comprising the steering input.

185. The apparatus of example 184, wherein the steering input comprises an electronic helm on the watercraft.

186. A system comprising:

the watercraft; and the apparatus of any one of examples 97 to 185 on the watercraft.

187. The method of any one of examples 1 to 96, or the system of example 186, wherein the watercraft comprises a wake boat.

The invention claimed is:

1. A method of controlling movement, relative to a watercraft, of at least one steering device on the watercraft in response to movement of a steering input relative to the watercraft, the method comprising:

controlling a target association, between steering-input positions of the steering input relative to the watercraft and respective steering positions of the at least one steering device relative to the watercraft, in response to at least uncoordinated movement comprising previous movement of the steering input relative to the watercraft uncoordinated with any movement of the at least one steering device relative to the watercraft, previous movement of the at least one steering device relative to the watercraft uncoordinated with any movement of the steering input relative to the watercraft, or both; and controlling the movement, relative to the watercraft, of the at least one steering device in response to the movement of the steering input relative to the watercraft and according to the target association.

2. The method of claim 1, wherein the uncoordinated movement comprises previous movement of the steering input relative to the watercraft uncoordinated with any movement of the at least one steering device relative to the watercraft.

3. The method of claim 2, wherein the previous movement of the steering input uncoordinated with any movement of the at least one steering device comprises previous movement of the steering input relative to the watercraft when the steering input is in a mode in which movement of the steering input relative to the watercraft does not control movement of the at least one steering device relative to the watercraft.

4. The method of claim 2, wherein the previous movement of the steering input uncoordinated with any movement of the at least one steering device comprises previous movement of the steering input relative to the watercraft beyond a steering-input position associated with an end of a steering range of the at least one steering device.

5. The method of claim 1, wherein the uncoordinated movement comprises previous movement of the at least one steering device relative to the watercraft uncoordinated with any movement of the steering input relative to the watercraft.

6. The method of claim 1, wherein controlling the movement, relative to the watercraft, of the at least one steering device in response to the movement of the steering input relative to the watercraft and according to the target association comprises causing the at least one steering device to move toward a target steering position associated, according to the target association, with a steering-input position of the steering input following the movement of the steering input.

7. An apparatus for controlling movement, relative to a watercraft, of at least one steering device on the watercraft in response to movement of a steering input relative to the watercraft, the apparatus comprising:

at least one controller configured to, at least:

control a target association, between steering-input positions of the steering input relative to the watercraft and respective steering positions of the at least one steering device relative to the watercraft, in response to at least uncoordinated movement comprising previous movement of the steering input relative to the watercraft uncoordinated with any movement of the at least one steering device relative to the watercraft, previous movement of the at least one steering device relative to the watercraft uncoordinated with any movement of the steering input relative to the watercraft, or both; and control the movement, relative to the watercraft, of the at least one steering device in response to the movement of the steering input relative to the watercraft and according to the target association.

8. The apparatus of claim 7, wherein the target association has a predefined ratio of amounts of change of steering angle relative to the watercraft to amounts of change of steering-input positions of the steering input relative to the watercraft.

9. The apparatus of claim 7, wherein the target association has a ratio, modified by the at least one controller from a predefined ratio, of amounts of change of steering angle relative to the watercraft to amounts of change of steering-input positions of the steering input relative to the watercraft.

10. The apparatus of claim 9, wherein the ratio is modified by the at least one controller according to at least a rate of movement over time of the steering input relative to the watercraft.

11. The apparatus of claim 7, wherein:

a reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft; and the at least one controller is configured to control the target association by, at least, causing the target association to comprise the reference association, for at least some a time having a duration greater than zero units of time, in response to the steering input reaching a steering-input position relative to the watercraft when the at least one steering device reaches a steering position relative to the watercraft associated with the steering-input position according to the reference association.

12. The apparatus of claim 7, wherein the steering input is rotatable relative to the watercraft entirely around an axis of rotation.

13. The apparatus of claim 12, wherein the at least one controller is further configured to, at least:

identify at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation; and select a selected one of the at least two possible target associations;

wherein the at least one controller is configured to control the target association by, at least, causing the target association to be, for at least some a time having a duration greater than zero units of time, the selected one of the at least two possible target associations.

14. The apparatus of claim 13, wherein the at least one controller is configured to select the selected one of the at least two possible target associations by, at least, selecting, as the selected one of the at least two possible target associations, one of the at least two possible target associations closest to a reference association between steering-input positions of the steering input relative to the watercraft and respective steering positions of the at least one steering device relative to the watercraft.

15. The apparatus of claim 14, wherein the reference association is an association, between steering-input positions of the steering input relative to the watercraft and respective steering positions of the at least one steering device relative to the watercraft, absent any movement of the steering input relative to the watercraft uncoordinated with any movement of the at least one steering device relative to the watercraft, and absent any movement of the at least one steering device relative to the watercraft uncoordinated with any movement of the steering input relative to the watercraft.

16. The apparatus of claim 15, wherein the reference association associates steering-input positions of the steering input relative to the watercraft with respective steering positions of the at least one steering device relative to the watercraft such that rotation of the steering input relative to the watercraft around the axis of rotation, by a required amount of rotation associated with the reference association, causes the steering input to reach the reference steering-input position relative to the watercraft and is associated with causing the at least one steering device to reach the reference steering position relative to the watercraft when the steering input reaches the reference steering-input position relative to the watercraft.

17. The apparatus of claim 13, wherein the reference steering-input position is a central steering position of the steering input relative to the watercraft.

18. The apparatus of claim 7, wherein the target association associates steering-input positions of the steering input relative to the watercraft with respective steering positions of the at least one steering device relative to the watercraft such that movement of the steering input relative to the watercraft, by a required amount of movement associated with the target association, causes the steering input to reach a reference steering-input position relative to the watercraft and is associated with causing the at least one steering device to reach a reference steering position relative to the watercraft when the steering input reaches the reference steering-input position relative to the watercraft.

19. The apparatus of claim 18, wherein the reference steering-input position is a central steering position of the steering input relative to the watercraft.

20. A system comprising:

the watercraft; and the apparatus of claim 6 on the watercraft.

21. The apparatus of claim 7, wherein the at least one controller is configured to control the movement, relative to the watercraft, of the at least one steering device in response to the movement of the steering input relative to the watercraft and according to the target association by, at least, causing the at least one steering device to move toward a target steering position associated, according to the target association, with a steering-input position of the steering input following the movement of the steering input.

22. An apparatus for controlling movement, relative to a watercraft, of at least one steering device on the watercraft in response to movement of a steering input relative to the watercraft, the steering input rotatable relative to the watercraft entirely around an axis of rotation, the apparatus comprising:

at least one controller configured to, at least:

identify at least two possible target associations between steering-input positions of the steering input relative to the watercraft and respective steering positions of the at least one steering device relative to the watercraft, each possible target association of the at least two possible target associations associated with a respective required amount of rotation of the steering input relative to the watercraft around the axis of rotation such that rotation of the steering input relative to the watercraft around the axis of rotation by the required amount of rotation causes the steering input to reach a reference steering-input position relative to the watercraft and is associated with causing the at least one steering device to reach a reference steering position relative to the watercraft when the steering input reaches the reference steering-input position relative to the watercraft, the respective required amounts of rotation of the steering input associated with each possible target association of the at least two possible target associations differing by at least one complete rotation of the steering input relative to the watercraft around the axis of rotation;

select a selected one of the at least two possible target associations; and control a target association, between steering-input positions of the steering input relative to the watercraft and respective steering positions of the at least one steering device relative to the watercraft, wherein controlling the target association comprises causing the target association to be, for at least some a time having a duration greater than zero units of time, the selected one of the at least two possible target associations.

* * * * *